US011658411B2

(12) United States Patent
Evans

(10) Patent No.: US 11,658,411 B2
(45) Date of Patent: May 23, 2023

(54) ELECTRICALLY-CONTROLLED RF, MICROWAVE, AND MILLIMETER WAVE DEVICES USING TUNABLE MATERIAL-FILLED VIAS

(71) Applicant: Dr. Alan Evans Business and Scientific Consulting, LLC, Beaver Dams, NY (US)

(72) Inventor: Alan Frank Evans, Beaver Dams, NY (US)

(73) Assignee: DR. ALAN EVANS BUSINESS AND SCIENTIFIC CONSULTING, LLC, Beaver Dams, NY (US)

( * ) Notice: Subject to any disclaimer, the term of this patent is extended or adjusted under 35 U.S.C. 154(b) by 274 days.

(21) Appl. No.: 17/099,062

(22) Filed: Nov. 16, 2020

(65) Prior Publication Data

US 2022/0013903 A1 Jan. 13, 2022

Related U.S. Application Data

(60) Provisional application No. 63/049,817, filed on Jul. 9, 2020.

(51) Int. Cl.
*H01Q 15/14* (2006.01)
*H01Q 3/34* (2006.01)

(52) U.S. Cl.
CPC ..... *H01Q 3/34* (2013.01); *H01Q 15/14* (2013.01)

(58) Field of Classification Search
CPC ..... H01Q 15/14; H01Q 3/34; H01Q 15/00; H01Q 15/0086; H01Q 1/38; H01P 3/00; H01P 3/006; H01P 3/08; H01P 3/081
See application file for complete search history.

(56) References Cited

U.S. PATENT DOCUMENTS 6,700,463 B2 * 3/2004 Killen ..... H05K 1/024 333/236
10,287,446 B2 5/2019 Haghzadeh et al.
(Continued)

OTHER PUBLICATIONS

Karabey et al., "A 2-D Electronically Steered Phased-Array Antenna With 2×2 Elements in LC Display Technology", IEEE Transactions on Microwave Theory and Techniques, vol. 60, No. 5, May 2012, pp. 1297-1306.

(Continued)

*Primary Examiner* — Tho G Phan
(74) *Attorney, Agent, or Firm* — Greenberg Traurig, LLP

(57) ABSTRACT

A dielectric substrate for RF, microwave, or millimeter wave devices, circuits, or surfaces includes a propagating region for transmitting or reflecting an electromagnetic field, and one or more material-filled vias located within the propagating region. The application of an external electric or magnetic field to the material-filled vias may be used to tune the electric permittivity or the magnetic permeability of the fill material and hence control the effective electric permittivity or the effective magnetic permeability of the dielectric substrate within the propagating region. A dimension of the material-filled vias may be less than half of a wavelength of the propagating electromagnetic field. The fill material may include liquid crystals, a ferroelectric crystal composite, a ferromagnetic crystal composite, organic semiconductors, and/or electro-optic or magneto-optic polymers.

20 Claims, 46 Drawing Sheets

(56) References Cited

U.S. PATENT DOCUMENTS

| | | | | |
|---|---|---|---|---|
| 10,490,903 | B2 | 11/2019 | Foo | |
| 10,637,133 | B2 | 4/2020 | Lu et al. | |
| 10,720,712 | B2 | 7/2020 | Foo | |
| 2004/0174223 | A1 | 9/2004 | Achyut | |
| 2005/0136646 | A1* | 6/2005 | Larnerd | H05K 3/429 174/250 |
| 2008/0023804 | A1 | 1/2008 | Dutta | |
| 2016/0164155 | A1 | 6/2016 | Wang et al. | |

OTHER PUBLICATIONS

Qiu et al., "Conductive Polymer Metallized Vias: A New Approach for Substrate Integrated Waveguide Development", IEEE Transactions on Components, Packaging and Manufacturing Technology, vol. 9, No. 6, Jun. 2019, pp. 1111-1118.

Liu et al., "Microwave CSIW Filter Based on the High Anisotropy Electro-Optic Nematic Liquid Crystal", 11th International Conference on Microwave and Millimeter Wave Technology, IEEE, May 19-22, 2019, pp. 1-3.

Hasek et al., "Photonic crystals for on-off switching of sub-terahertz electromagnetic waves", 33rd International Conference on Infrared and Millimeter Waves, Sep. 15-19, 2008, 2 pages.

Haghzadeh et al., "All-printed, flexible, reconfigurable frequency selective surfaces," Journal of Applied Physics, vol. 120, No. 18, Nov. 8, 2016, 11 pages.

Yaghmaee et al., "Electrically Tuned Microwave Devices Using Liquid Crystal Technology", International Journal of Antennas and Propagation, vol. 2013, Article ID 824214, 2013, pp. 1-9.

Shen et al., "A Tunable Dual-Mode Bandstop Filter Based on Liquid Crystal Technology", IEEE International Conference on Communication Problem-Solving, Oct. 16-18, 2015, pp. 485-487.

Tebbe et al., "Manufacturing and testing of liquid crystal phase shifters for an electronically steerable array", IEEE Aerospace Conference, AERO, Mar. 4-11, 2017, pp. 1-12.

Chen et al., "Substrate Integrated Waveguides with Corrugated Wall", IEEE Electronic Components and Technology Conference, May 26-29, 2015, 4 pages.

Xu et al., "Guided-Wave and Leakage Characteristics of Substrate Integrated Waveguide", IEEE Transactions on Microwave Theory and Techniques, vol. 53, No. 1, Jan. 2005, pp. 66-73.

Eccleston et al., "Mode Analysis of the Corrugated Substrate Integrated Waveguide", IEEE Transactions on Microwave Theory and Techniques, vol. 60, No. 10, Oct. 2012, pp. 3004-3012.

Ahmed et al., "Electrically Tunable Materials for Microwave Applications", Journal of Applied Physics, vol. 2, Article 011302, 2015, pp. 1-17.

Pan et al., "Recent progress in liquid crystal THz optics", Liquid Crystal Materials, Devices, and Applications XI, Proceedings of SPIE, vol. 6135, Article 61350D, 2006, 14 pages.

Stevenson et al., "Advanced antenna design using radio frequency liquid crystals and LCD manufacturing", Emerging Liquid Crystal Technologies XV, Proceedings of SPIE, vol. 11303, Article 113030N, 2020, 8 pages.

Stevenson et al., "High-Throughput Satellite Connectivity for the Constant Contact Vehicle", Proceedings of the 48th European Microwave Conference, Sep. 25-27, 2018, pp. 316-319.

Stevenson et al., "Metamaterial surface antenna technology: Commercialization through diffractive metamaterials and liquid crystal display manufacturing", 10th International Congress on Advanced Electromagnetic Materials in Microwaves and Optics, Metamaterials, Sep. 19-22, 2016, pp. 349-351.

Manabe, Atsutaka, "Liquid crystals for microwave applications", Emerging Liquid Crystal Technologies VIII, Proceedings of SPIE, vol. 8642, Article 86420S, 2013, 7 pages.

Parka et al., "Measurements of anisotropic complex permittivity of liquid crystals at microwave frequencies", Journal of the European Ceramic Society, vol. 27, No. 8-9, 2007, pp. 2903-2905.

Fritzsch et al., "Recent Developments in Liquid Crystals for Microwave Applications", IEEE International Symposium on Antennas and Propagation and USNC-URSI Radio Science Meeting, APSURSI, Jul. 9-14, 2017, pp. 1217-1218.

* cited by examiner

ELECTRICALLY-CONTROLLED RF, MICROWAVE, AND MILLIMETER WAVE DEVICES USING TUNABLE MATERIAL-FILLED VIAS

CROSS-REFERENCE TO RELATED APPLICATION

This application claims the benefit of priority under 35 U.S.C. § 119(e) of U.S. Provisional Application No. 63/049,817, filed Jul. 9, 2020, the contents of which are incorporated herein by reference in their entirety.

BACKGROUND

Wireless communication and sensing networks are becoming increasingly prevalent, particularly for 5G cellular networks and autonomous vehicles. Of importance in such systems is the ability to change the frequency, phase, amplitude, and/or polarization of the propagating electromagnetic field of an RF, microwave, or millimeter wave device, circuit, or surface to enable tuning or dynamically reconfigurable control. Example devices and structures include resonators, oscillators, filters, phase shifters, delay lines, antennae, frequency-selective surfaces, and metamaterials.

The ability to continuously tune oscillator, filter, and/or antenna frequencies of a wireless communication link, for example, may allow for effective utilization of the scarce frequency spectrum accordingly using fewer devices than for discrete, fixed frequency approaches, and enable dynamic frequency allocation. Frequency reuse in cellular networks, for instance, may increase link bandwidth for the limited number of available frequency bands. Additionally, frequency-hopping spread spectrum (FHSS) is a transmitting technique to avoid electromagnetic interference and make signals difficult to intercept. Phase shifters and delay line components of phased array antennae can be used for beam forming and steering to increase the gain of a wireless communication channel. Tunability is also desired in other adaptive RF, microwave, and millimeter wave applications such as tunable frequency selective surfaces that can act as bandpass or band stop filters when integrated with a MIMO (multiple input/multiple output) antenna or for electromagnetic (EM) shielding from electromagnetic interference that may be either unintended as with multipath effects, or intentional as with signal jamming in military applications.

Of the ways to change the frequency, phase, amplitude, and/or polarization of an electromagnetic field, tuning the electric permittivity or magnetic permeability of the material in which it is propagating using an applied, external electric or magnetic field, may offer the benefits of continuous rather than discrete change, a high quality factor, small size, and low manufacturing costs. The term "external" in this regard may be used to distinguish a second field (e.g., created by an applied voltage to create an applied electric field, or an applied current to create an applied magnetic field in the case of an electromagnet) that is separate from the (principal) propagating electromagnetic field of the device, circuit, or surface.

As a propagating medium, liquid crystals (LCs) may be advantageous for their low bias voltage and high electrically-induced birefringence at frequencies above 10 GHz, e.g., 0.2 to 1.2 THz. As passive materials, liquid crystals are low loss, low cost, and avoid the nonlinear response of diodes, transistors, and ferrite materials.

Current device configurations place the liquid crystal in a single capacitive cell between two conductive electrode plates. An applied voltage across the electrodes creates an electric field that re-orients the axes of LC molecules thereby changing the electric permittivity of the material for a propagating electromagnetic field. The electric permittivity change may be associated with zero applied voltage where the LC molecules may be oriented parallel to the plates, to a maximum applied voltage where the molecules may be oriented perpendicular to the plates.

One issue with liquid crystal materials is that their relative electric permittivity is low compared to conventional printed circuit board (PCB), ceramic, silicon, or glass substrates. Typically, liquid crystals have a relative electric permittivity of 2.3-3.3 compared to 5-6 for fiberglass-embedded epoxy resin PCBs or glass, for example. As used herein, the relative electric permittivity is the ratio of the electric permittivity of a material to the electric permittivity of vacuum and is also known as the dielectric constant.

Such a step change in the relative electric permittivity (e.g., from 2.3 to 5) may cause electromagnetic field reflections for a propagating EM field at the boundary between the LC cavity and the dielectric substrate, e.g., such as for a microstrip transmission line or metal waveguide. Reflections are detrimental to the performance of a device. EM field reflections may cause ripples in the frequency response of the device leading to a degradation in performance associated with such low relative electric permittivity materials in RF, microwave, or millimeter wave devices. At the other extreme, but in a similar vein, ferroelectric nanocomposite-based dielectric inks have a high relative electric permittivity (e.g., 35 to 45 for continuous direct current (DC) to 20 GHz applications), which may cause unwanted reflections at the nanocomposite-dielectric substrate boundary.

Besides the potential mismatch in electric permittivity, a substrate architecture having a single, large LC cavity may be susceptible to leakage, air bubbles, and even structural failure by insufficiently accommodating thermal expansion of the liquid crystal relative to the substrate over the operating temperature range. Additionally, the cavity may need to be machine milled with a dimensional tolerance of ±20 micrometers and can require multiple manual assembly steps to position it within the waveguide, which may add significantly to manufacturing costs and adversely impact manufacturing yield. Notwithstanding recent developments, it would be advantageous to have a technology solution that is compatible with a wide variety of device configurations and operating frequencies, as well as with existing manufacturing processes, such as planar processing paradigms used in the semiconductor industry.

Wireless communication and sensing networks are moving to higher frequencies driven by various benefits, including: 1) higher carrier frequency and hence higher channel bandwidth; 2) better signal-to-noise ratio and lower power consumption from higher gain antennae and more highly directive links due to narrower beam widths, beam forming, and beam steering capability; 3) flexible and resilient networks from rapid configuration/reconfiguration and lower electromagnetic interference; and 4) the desirability for adaptive convert, tamper-prove, and jam-resistant attributes for military applications.

In particular, 5G networks will likely use spectra in two frequency bands, e.g., from approximately 450 MHz to approximately 6 GHz and from approximately 24.25 GHz to approximately 52.6 GHz. One advantage of 5G in the higher frequency band is the smaller antenna size, which scales with wavelength, allowing for more compact antenna arrays. Antenna arrays where multiple antennae are used in the transmitter and receiver (e.g., multiple input, multiple output, MIMO) enable higher bandwidth through beam shaping, beam steering, and avoidance of multi-path interference.

Millimeter wave frequencies (30-300 GHz) are also important to radio astronomy, remote sensing, automotive radar, imaging, and security screening. And for military applications, millimeter wave technology is becoming increasingly relevant to eliminate cabling for rapid installation/dismantling of command HQ to reduce vulnerability to attack and maintain extremely fast tactical operations; for lower size, weight and power in vehicle communications; for the massive amount of data from the number of sensors on the battlefield (e.g., unmanned aerial vehicle swarms); to address the need for real-time artificial intelligence for decision making and back-haul links between higher and lower HQs and with tactical elements; and even virtual reality for virtual visits of commanders to subordinate units.

Yet for frequencies higher than about 10 GHz, comparative microstrip transmission lines and coplanar waveguides become impermissibly lossy due to radiation. Rectangular metal waveguides are typically used because they can confine the propagating EM field to the four surrounding metal walls for lower radiation loss than microstrip and strip lines and the conductive losses from the metal are also lower because there is a greater cross-sectional area of free carriers in the metal engaged by the electromagnetic field of the signal resulting in lower ohmic loss. The result is low overall insertion loss. However, standard rectangular waveguides are not sufficiently compact for most applications. Along with their size, standard fabrication processes such as metal milling are costly and not easy to integrate with other planar devices and their planar fabrication processes.

To overcome these and other issues, a new type of dielectric-filled rectangular waveguide referred to as a substrate-integrated waveguide (SIW) has emerged. It retains the loss advantages of rectangular waveguides at higher frequencies in addition to being compatible with planar fabrication technologies. Substrate-integrated waveguides may therefore be low cost, easy to integrate with other devices, have scalable manufacturing, and high yield.

Despite the introduction of SIWs, it remains a challenge to arrange the electric permittivity- or magnetic permeability-modifying material in devices that may be integrated into a full system and that spans the RF to millimeter wave spectrum so that they may operate as a platform for a multitude of wireless communication and sensing applications. It is therefore desired that the resulting system has a broad bandwidth response, a low tuning drive voltage, and is compact and compatible with existing microelectronic manufacturing processes for low cost fabrication and assembly.

SUMMARY

A substrate for use in RF, microwave, or millimeter wave devices, circuits, or as a surface for transmitting or reflecting an electromagnetic field may, according to certain embodiments, include one or more vias within a propagating region thereof that include a fill material where the electric permittivity or the magnetic permeability of the fill material may be electrically or magnetically tuned such that an effective electric permittivity or an effective magnetic permeability of the propagating region within the substrate may be tuned or controlled, e.g., during operation of the device, circuit, or surface. To decrease the propensity for scattering, the vias may be dimensioned to have a diameter of less than half of a wavelength of the propagating electromagnetic field.

A distribution (e.g., location, size, shape, etc.) of the material-filled vias may be uniform across the propagating region or the distribution may vary, i.e., along a direction parallel or transverse to a propagation direction of the electromagnetic field. As used herein, a substrate having one or more material-filled vias embedded within a propagating region of the substrate may be referred to as a composite substrate.

The composite substrate may be distinguished from a photonic crystal material. Whereas photonic crystal materials necessarily possess a periodic structure, the material-filled vias need not be arranged in a periodic array. Moreover, in a photonic crystal, the refractive index differential between the fill material and the surrounding substrate needs to be large, and the periodicity is unavoidably configured to be equal to or substantially equal to half the wavelength of the EM field to induce the strong constructive or destructive interference necessary to create a bandgap in the material. In contrast, in accordance with various embodiments, the material-filled vias advantageously do not exhibit a large refractive index differential with the substrate and the diameter of the material-filled vias may be significantly less than half the wavelength of the propagating EM field.

The substrate may include any suitable dielectric material, such as a ceramic, glass, or polymer composition. A glass substrate, for instance, may provide various advantages including a comparatively low total thickness variation (TTV), which may facilitate the precise and accurate formation of vias having a desired size, shape, location, etc., which may in turn enable control of the fill material volume and the realization of a desired effective electric permittivity or effective magnetic permeability and related attributes such as transmission line impedance. This may result in higher performance and greater yield in manufacturing. Additionally, smaller vias can be fabricated in glass than in PCB materials, which allows for higher operating frequencies. Finally, the transparency of some glass compositions may allow for unobstructed exposure to light to facilitate UV curing of an adhesive bonding material for ease of assembly in certain manufacturing processes.

Example fill materials may include liquid crystals, a ferroelectric crystal composite, a ferromagnetic crystal composite, organic semiconductors, electro-optic and magneto-optic polymers, including combinations thereof. The fill material may include a homogeneous composition, or the fill material may be configured as an ordered composite, such as a bilayer where the respective layers include an electron donor and an electron acceptor such that the material-filled vias act like a diode or a p-n junction. In the example of a liquid crystal fill material, a polymer or other templating layer may be disposed adjacent to the vias to induce a desired alignment of the liquid crystals within the vias.

In certain embodiments, an RF, microwave, or millimeter wave device or surface may be electrically controlled using an applied, external electric field. Application of the external electric field can induce a change in the electric permittivity of the material-filled vias and an attendant change in an effective electric permittivity of the substrate within the propagating region, which may impact the transmission properties of an EM field incident on or propagating through the substrate.

In some embodiments, an upper conductive layer (i.e., upper electrode) may be disposed over an upper surface of the dielectric substrate and a lower conductive layer (i.e., lower electrode) may be disposed over a lower surface of the dielectric substrate. The upper conductive layer may constitute a blanket electrode or, in alternate embodiments, the upper conductive layer may be patterned and include a first segment disposed over a first plurality of the material-filled vias and a second segment electrically isolated from the first segment and disposed over a second plurality of the material-filled vias. Multiple independent electrode segments may enable the application of a spatially-localized electric field and hence a spatially-localized programming of an effective electric permittivity.

In some embodiments, patterning of the upper conductive layer may enable an external electric field to be applied to the material-filled vias within the propagating region to the exclusion of the electric field being applied to other areas of the substrate. The external electric field, in some examples, may be applied along a direction substantially parallel to or transverse to a propagation direction of an electromagnetic signal or an electromagnetic power field through the propagating region of the substrate.

The substrate may be configured as a single layer structure or as a multilayer structure. For instance, the substrate may include a central layer disposed between an upper cladding layer and a lower cladding layer, where upper and lower conductive layers are disposed respectively over the upper and lower cladding layers and the material-filled vias are disposed within the central layer. The upper cladding layer, the central layer, and the lower cladding layer may be independently manufactured and bonded together using a suitable adhesive, such as a pressure sensitive adhesive or epoxy, or using other suitable bonding processes, such as van der Waals forces.

Further to the foregoing, an RF, microwave, or millimeter wave device or surface may be magnetically controlled by an applied, external magnetic field. In such devices and structures, a first electromagnet may be disposed over an upper surface of the substrate and a second electromagnet may be disposed over a lower surface of the substrate such that the material-filled vias are located between the first and second electromagnets. Application of the external magnetic field can induce a change in the magnetic permeability of the material-filled vias and an attendant change in an effective magnetic permeability of the substrate within the propagating region, which may impact the transmission properties of an EM field incident on or propagating through the substrate.

According to some embodiments, a composite substrate may additionally include a plurality of metal-filled vias that extend through the substrate and along opposing lateral edges of the propagating region. In connection with the metal-filled vias, an upper conductive layer may be disposed over an upper surface of the substrate, where the upper conductive layer may include (i) a first segment for applying the external electric or magnetic field to the material-filled vias, and (ii) a second segment overlying the metal-filled vias and electrically isolated from the first segment for applying a drive voltage to the metal-filled vias.

The material-filled vias, which may extend partially or entirely through the dielectric substrate, and the metal-filled vias may be formed using mechanical drilling, laser exposure, chemical or physical etching, or a combination thereof followed by any suitable technique for depositing a fill material within the respective vias.

Example devices and structures that may include a composite substrate as disclosed herein include transmission lines, waveguides, voltage-controlled oscillators, current-controlled oscillators, resonators, filters, antennae, phase shifters, phase arrays, delay line dividers/combiners, varicaps (voltage-controlled capacitors), Mach-Zehnder modulators, wavelength selective surfaces, or metamaterials. In certain embodiments, these and other such devices may be formed as part of an RF, microwave, or millimeter wave device or circuit.

For instance, the RF, microwave, or millimeter wave device may be configured to form a Mach-Zehnder (MZ) modulator having two paths for a propagating EM signal or power field. The MZ modulator may include material-filled vias in one or both paths. In further aspects, the RF, microwave, or millimeter wave device may be configured as an antenna where the material-filled vias are located within the antenna cavity. The antenna may be a SIW-backed patch antenna, for example.

In still further aspects, the RF, microwave, or millimeter wave device may be configured to form a metamaterial surface containing a repeating pattern of a conductive layer over a top surface of the substrate, where the conductive pattern may include an intra-pattern dimension that is smaller than the wavelength of an interacting EM field. Material-filled vias incorporated into the substrate may change the EM resonance or coupling within or between the repeating pattern. A pattern shape can include a split ring, spiral, cross, I-beam, or other shapes that have suitable inductive and capacitive characteristics. The material-filled vias may be located in regions of high electromagnetic field intensity so as to have a desirable impact on the resonance or coupling. In one implementation, 2-dimensional metamaterial sheets may be interlocked to form a 3-dimensional metamaterial.

As described herein, the formation or deposition of a layer or structure, including electrically conductive layers such as electrode layers, may involve one or more techniques suitable for the material or layer being deposited or the structure being formed. In addition to techniques or methods specifically mentioned, various techniques include, but are not limited to, chemical vapor deposition (CVD), low-pressure chemical vapor deposition (LPCVD), plasma enhanced chemical vapor deposition (PECVD), microwave plasma chemical vapor deposition (MPCVD), metal organic CVD (MOCVD), atomic layer deposition (ALD), molecular beam epitaxy (MBE), electroplating, electroless plating, ion beam deposition, spin-on coating, thermal oxidation, and physical vapor deposition (PVD) techniques such as sputtering or evaporation.

As will be appreciated by those skilled in the art, patterned layers or structures may be formed using a selective deposition technique or by using a suitable masking layer to block areas where a layer or structure is not wanted, or by using photolithographic techniques such as patterning and etching to selectively remove one or more portions of a deposited layer or structure to form the desired pattern in the unremoved portion(s).

Additional features and advantages will be set forth in the detailed description which follows, and in part will be readily apparent to those skilled in the art from that description or recognized by practicing the embodiments as described herein, including the detailed description which follows, as well as the appended drawings.

It is to be understood that both the foregoing general description and the following detailed description are merely exemplary and are intended to provide an overview or framework to understanding the nature and character of the claims. The accompanying drawings are included to provide a further understanding and are incorporated in and constitute a part of this specification. The drawings illustrate one or more embodiments, and together with the description serve to explain principles and operation of the various embodiments.

BRIEF DESCRIPTION OF THE DRAWINGS

The accompanying drawings, which are incorporated in and form a part of the specification, illustrate several aspects of the present disclosure and, together with the description, serve to explain the principles of the disclosure. In the drawings.

Figure 1A:
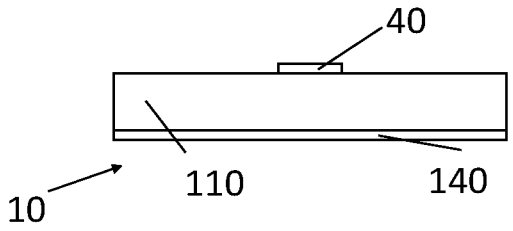
FIG. 1A is an end view of a comparative microstrip transmission line.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure relates generally to a substrate configured for use in devices, circuits, and the like, or as a surface for operation within the radio frequency (RF), microwave frequency, and/or millimeter or terahertz frequency ranges of the electromagnetic spectrum, e.g., from approximately 20 kHz to approximately 3 THz. Such a substrate may include a propagating region for transmitting an electromagnetic field and one or more material-filled vias disposed within the propagating region. The substrate may include a solid dielectric medium and the fill material disposed within the via(s) may include a liquid crystal composition, for example. In certain embodiments, a diameter of the vias may be less than a wavelength of the propagating electromagnetic field. In certain embodiments, an effective electric permittivity or an effective magnetic permeability of the substrate within the propagating region may be tuned in response to an external electric or magnetic field that is applied to the material-filled vias.

An applied voltage may be used to create an external electric field whereas a current applied to the wire coil of an electromagnet, for instance, may be used to create an external magnetic field. As will be appreciated, the external electric field or the external magnetic field are independent of the propagating electromagnetic field. In examples where the propagating electromagnetic field is a continuous wave or of sufficient power, it may be implemented as a power field. In examples where the propagating electromagnetic field is encoded with information, such as with a non-continuous wave, it may be implemented as a signal field.

As used herein, an element or a structure such as a dielectric substrate or a material-filled via may be characterized by its electric permittivity and/or its magnetic permeability, whereas a composite having two or more elements or structures, such as a propagating region having one or more material-filled vias distributed throughout a selected area of a dielectric substrate, may be characterized by an "effective" electric permittivity or an "effective" magnetic permeability. In some aspects, an effective electric permittivity or an effective magnetic permeability may be determined from an effective medium approximation.

In some embodiments, a substrate having one or more material-filled vias incorporated within a propagating region thereof may be used to form a planar device, such as a transmission line or a waveguide, where electromagnetic radiation may be transmitted within the substrate, i.e., parallel to a major surface thereof. In some embodiments, such a substrate may be used to form a metamaterial, where electromagnetic radiation may be transmitted through the substrate, i.e., orthogonal to, or at a finite angle ($\theta$) ($0° < \theta < 90°$), with respect to a major surface of the substrate.

The presently-disclosed substrates can be used to create an individual device or a number of devices and an attendant circuit or surface that interacts with an electromagnetic field. Without loss of generality to other devices, circuits, and surfaces, exemplary structures may include microstrip transmission lines, coplanar waveguides, substrate-integrated waveguides (SIWs), microstrip resonators, microstrip transmission lines, Mach-Zehnder modulators, patch and SIW-backed cavity antennae, and split ring resonator metamaterials.

The following will provide, with reference to FIGS. 1-44, detailed descriptions of methods and systems that include a tunable substrate or surface for RF, microwave, or millimeter wave devices or circuits that are configured to manipulate electromagnetic signals or power fields.

Figure 1B:
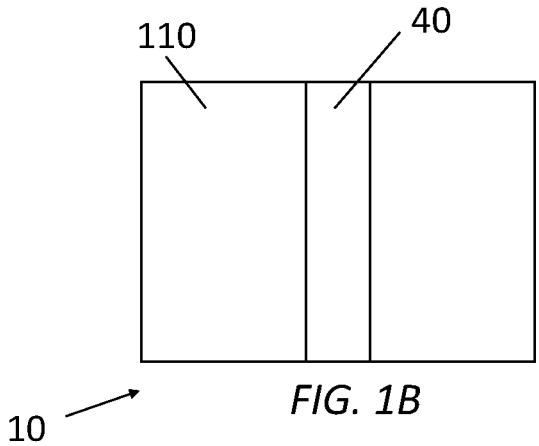
FIG. 1B is a top view of the comparative microstrip transmission line of FIG. 1A.

Transmission lines and waveguides for conveying electromagnetic fields between locations are fundamental building blocks of RF, microwave, or millimeter wave circuits. Comparative microstrip transmission lines and coplanar waveguides are shown in FIGS. 1A-1E. FIGS. 1A and 1B are end and top views, respectively, of a comparative microstrip transmission line. The microstrip transmission line 10 includes a dielectric substrate 110 having a lower conductive electrode layer 140 overlying the substrate bottom surface and an upper conductive electrode line 40 overlying the top surface. The lower conductive electrode layer 140 may serve as a ground plane for an electromagnetic field traveling along the microstrip transmission line 10. The width of conductive electrode line 40 may be designed to achieve a desired electric impedance of the transmission line.

Figure 1C:
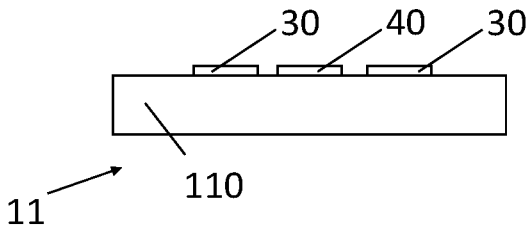
FIG. 1C is an end view of a comparative coplanar waveguide.
Figure 1D:
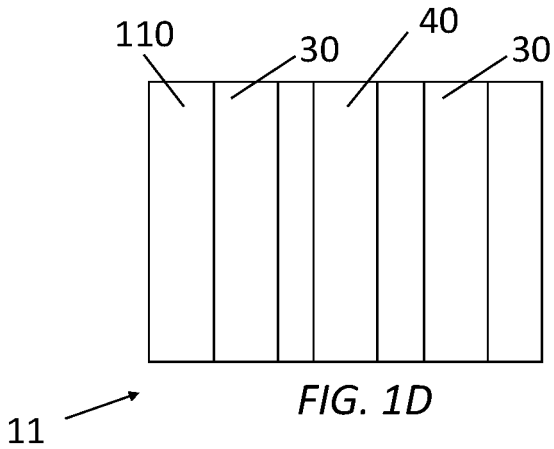
FIG. 1D is a top view of the comparative coplanar waveguide of FIG. 1C.
Figure 1E:
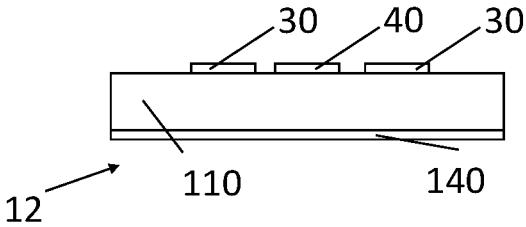
FIG. 1E is an end view of a comparative conductor-backed waveguide, also known as a grounded coplanar waveguide.

FIGS. 1C and 1D are end and top views, respectively, of a coplanar waveguide 11 where ground conductive electrodes 30 have a finite width and are co-located with conductive electrode line 40 over a top surface of dielectric substrate 110, hence "coplanar." A variant of coplanar waveguide 11 is shown in FIG. 1E where coplanar waveguide 12 further includes a ground plane conductive layer 140 overlying the bottom surface of dielectric substrate 110.

In various embodiments, the loss tangent (tan δ) of a substrate 110 is desirably low to decrease its contribution to the total propagation loss. Example substrate materials include organic laminates and low-loss printed circuit board materials, which are readily available and leverage a mature fabrication infrastructure. Relative to organic laminates and PCB materials, however, various glass compositions have several advantages in addition to a comparable or lower loss tangent, including high dimensional stability and insensitivity to moisture, which may be desirable for precise, high-performance devices as carrier frequencies increase; smoother surfaces for lower interface scattering, which also may become desirable as carrier frequencies increase (i.e., due to the skin effect); a low total thickness variation (TTV); and the ability to scale to ultra-thin and large panel sizes for low cost. Mechanical design flexibility may be available by adjusting the glass composition to tailor its coefficient of thermal expansion for improved interface interconnect reliability.

Figure 2A:
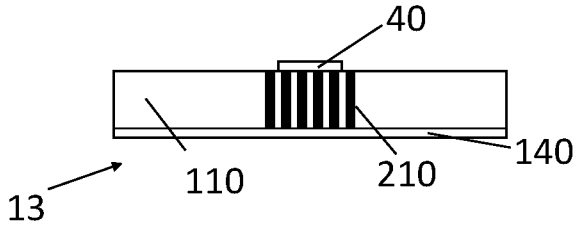
FIG. 2A is an end view of a microstrip transmission line including material-filled vias according to one embodiment.
Figure 2B:
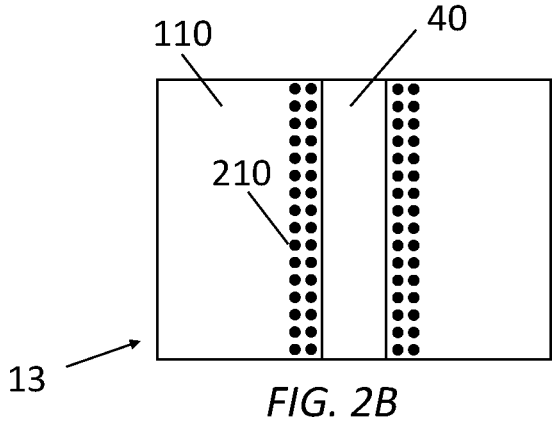
FIG. 2B is a top view of the microstrip transmission line of FIG. 2A according to one embodiment.
Figure 2C:
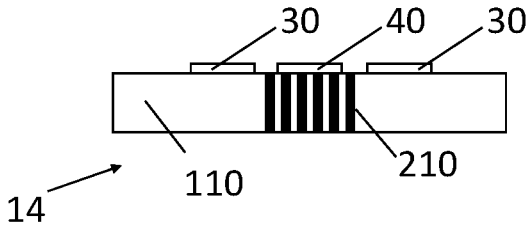
FIG. 2C is an end view of a coplanar waveguide including material-filled vias located within a propagating region of the waveguide according to one embodiment.
Figure 2D:
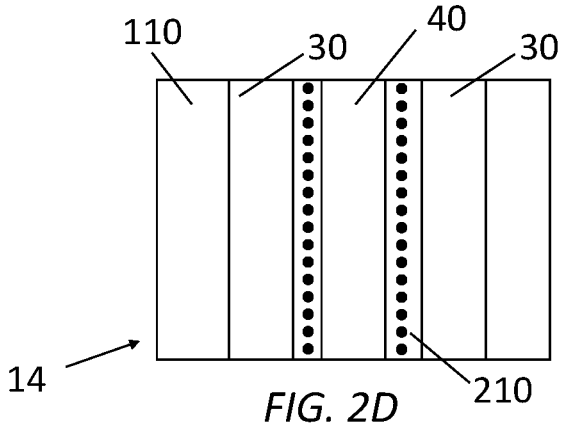
FIG. 2D is a top view of the coplanar waveguide of FIG. 2C according to one embodiment.
Figure 2E:
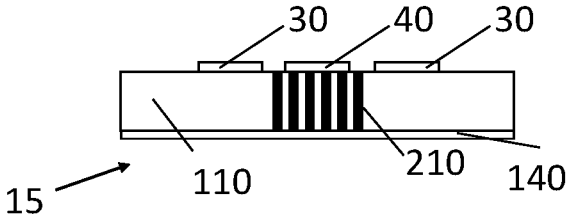
FIG. 2E is an end view of a conductor-backed coplanar waveguide with material-filled vias located within a propagating region of the waveguide according to one embodiment.

Example microstrip transmission lines and coplanar waveguides according to some embodiments are shown in FIGS. 2A-2E. FIGS. 2A and 2B are end and top views, respectively, of a microstrip transmission line 13, FIGS. 2C and 2D are end and top views, respectively, of a coplanar waveguide 14; and FIG. 2E shows a conductor-backed coplanar waveguide 15.

In addition to dielectric substrate 110, ground conductive electrode(s) 30, conductive electrode line 40, and optional ground plane conductive layer 140, the microstrip transmission line 13 and the coplanar waveguides 14, 15 of FIGS. 2A-2E may further include one or more (e.g., an array of) material-filled vias 210. In some embodiments, the material-filled vias 210 may extend through dielectric substrate 110 and may be located directly under and/or adjacent to conductive electrode line 40. For coplanar waveguides the material-filled vias 210 may be located in the gap between the ground conductive electrodes 30 and the conductive electrode line 40.

As discussed further herein, the electric permittivity or the magnetic permeability of the fill material within the vias can be controlled or changed with the application of an external electric field or an external magnetic field. In some embodiments, as shown in FIGS. 2A-2E, the material-filled vias 210 may extend completely through dielectric substrate 110. In alternate aspects, the material-filled vias may extend partially through the dielectric substrate 110.

In connection with various embodiments, material-filled vias may be incorporated into a substrate-integrated waveguide. At high frequencies, substrate-integrated waveguides (SIWs) may more effectively contain a propagating electromagnetic field and accordingly exhibit less radiation loss than microstrip transmission lines or coplanar waveguides. Example SIWs may include a top and bottom metal-plated substrate and two parallel arrays of densely-spaced, metal-filled vias extending through the substrate to electrically connect the plates. As used herein, the terms "metal-filled via," "metal-filled via array," and the like may be used interchangeably unless the context clearly indicates otherwise.

Figure 3A:
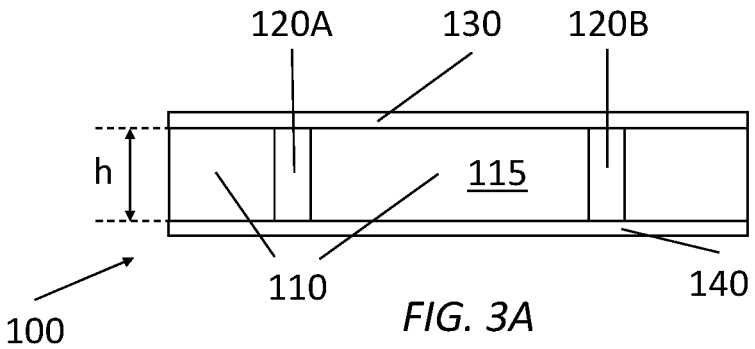
FIG. 3A is an end cross-sectional view of a comparative substrate-integrated waveguide through two sidewall metal-filled via arrays.
Figure 3B:
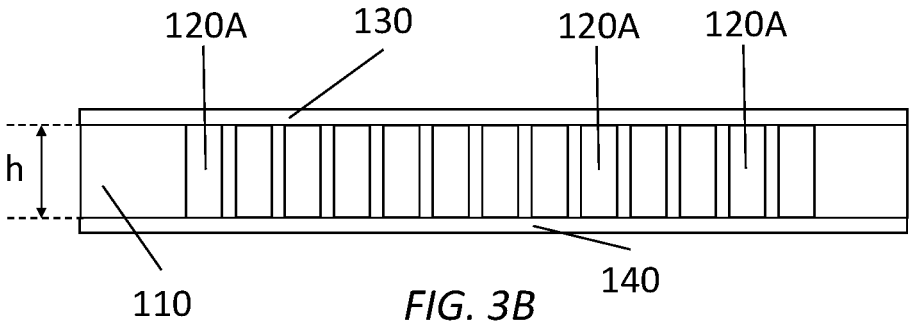
FIG. 3B is a side cross-sectional view of the substrate-integrated waveguide of FIG. 3A through one of the sidewall metal-filled via arrays.
Figure 3C:
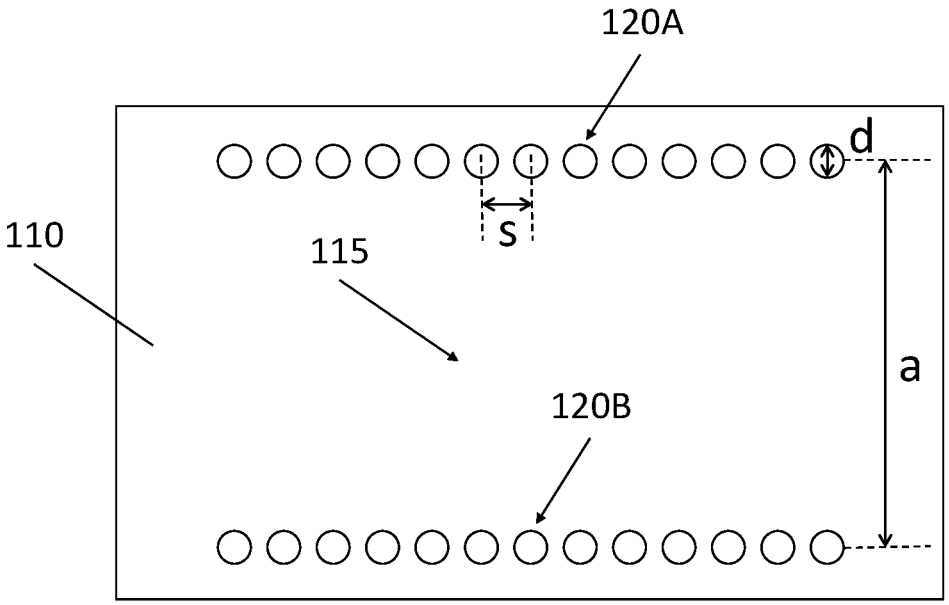
FIG. 3C is a top plan view of the substrate-integrated waveguide of FIGS. 3A and 3B below the top conductive layer.

Referring to FIG. 3A, shown is an end cross-sectional view of a substrate-integrated waveguide 100 formed from a dielectric substrate 110 and including a pair of sidewall metal-filled via arrays, 120A and 120B. The substrate 110 may have a height or thickness h. Top conductive layer 130 and bottom conductive layer 140 may be arranged to confine a propagating electromagnetic (EM) field therebetween, i.e., in the vertical direction, and the metal-filled via arrays 120A and 120B may be arranged to confine the propagating electromagnetic (EM) field in a horizontal direction, i.e., transverse to a propagation direction of the EM field. FIG. 3B shows a side cross-sectional view of the substrate-integrated waveguide 100 of FIG. 3A through the left sidewall array 120A of metal-filled vias. FIG. 3C is a top plan view of the substrate-integrated waveguide 100 of FIG. 3A below the top conductive layer 130 (or before the top conductive layer has been formed).

As illustrated in FIG. 3C, the metal-filled vias may be characterized by a diameter (d), a pitch or center-to-center distance between two successive vias (s), and a spacing (a) between the two arrays. For SIWs having low radiation loss, the parallel arrays 120A, 120B of side wall vias may form an effectively continuous barrier to the propagating EM field where, in certain embodiments, $s/d<2.0$ and $d/a<0.2$, or alternatively for even lower loss, $s/d<2.5$ and $d/a<0.125$. When these conditions are met, the EM field may be well confined to a propagating region 115 within the substrate 110.

Figure 3D:
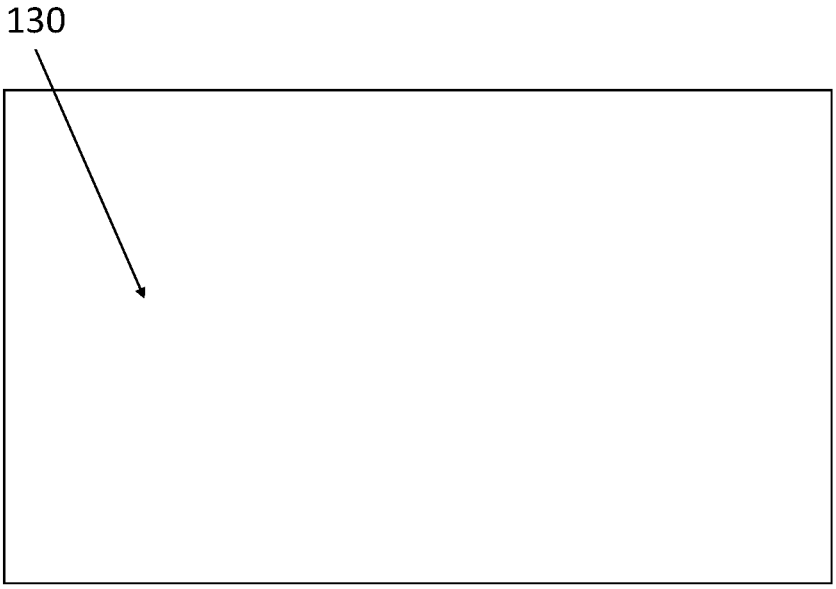
FIG. 3D is a top view of the substrate-integrated waveguide of FIG. 3A showing the top conductive layer overlying the substrate.

In the illustrated embodiment of FIG. 3C, propagation of an EM field may be in the horizontal direction and, without loss of generality, could be input from the left and propagate through low loss region 115 of waveguide 100 before exiting at the right. Conversely the EM propagating field could enter from the right, propagate through the low loss region 115, and exit waveguide 100 on the left. FIG. 3D is a top view of the substrate-integrated waveguide of FIG. 3A showing top conductive layer 130 overlying the entire top surface of the substrate.

Figure 4:
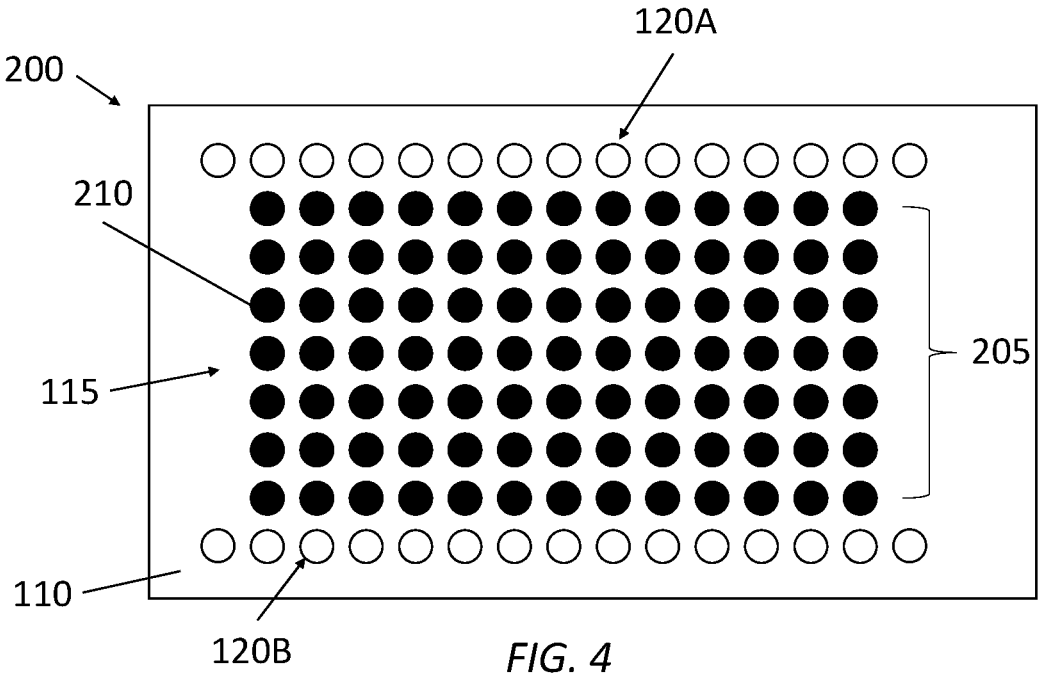
FIG. 4 is a top plan view of a substrate-integrated waveguide below a top conductive layer according to an exemplary embodiment.

One exemplary embodiment of a substrate-integrated waveguide having an array of material-filled vias incorporated into the propagating region thereof is shown in FIG. 4. Substrate-integrated waveguide 200 may include a dielectric substrate 110 having a propagating region 115 located within the substrate that extends between parallel arrays 120A, 120B of metal-filled vias. An array 205 of material-filled vias 210 is located within propagating region 115 between the array 120A of metal-filled vias and the array 120B of metal-filled vias.

The metal-filled via arrays 120A, 120B may be entirely or partially filled with a suitable conductive material. The individual metal-filled vias may include an electrically conductive material such as copper, for example. According to some embodiments, a layer of copper metal may coat the internal sidewalls of the vias, e.g., to a thickness greater than that of the skin depth of a propagating EM field at the operating frequency.

Material-filled vias 210 may be at least partially filled with a material whose electric permittivity or magnetic permeability can be controlled or changed with the application of an external electric or magnetic field.

Substrate-integrated waveguide 200 may constitute a component of a larger microwave circuit, for example, with other structures and/or devices located upstream or downstream of low loss propagating region 115. For instance, as shown schematically in FIG. 4, metal-filled vias 120A, 120B may extend beyond the array 205 of material-filled vias 210, i.e., along a propagation direction extending from left to right (or right to left).

The respective configurations of the metal-filled via arrays and the array(s) of material-filled vias may be independently selected, e.g., to satisfy the SIW conditions for low radiation loss in the case of the metal-filled vias and, in the case of the material-filled vias, to satisfy the effective medium approximation for the composite substrate with respect to electric permittivity or magnetic permeability.

A distribution of the material-filled vias may, in certain examples, relate to one or more of a via diameter or orientation, as well as a location, size, shape, etc., of a material-filled via array within a propagating region, including the inter-via spacing and the periodicity of vias within the array. According to some embodiments, plural material-filled vias may have a constant or variable diameter. In further embodiments, the vias may have substantially vertical sidewalls, e.g., with respect to a major surface of the substrate, or the via sidewalls may be inclined. In still further embodiments, the material-filled vias may be arrayed periodically or randomly.

Figure 5A:
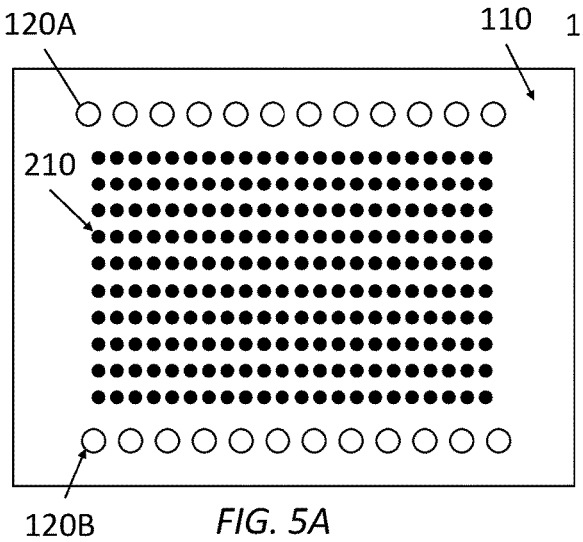
FIG. 5A is a top plan view of a substrate-integrated waveguide below the top conductive layer where a diameter of the material-filled vias is less than a diameter of the metal-filled vias according to one embodiment.
Figure 5B:
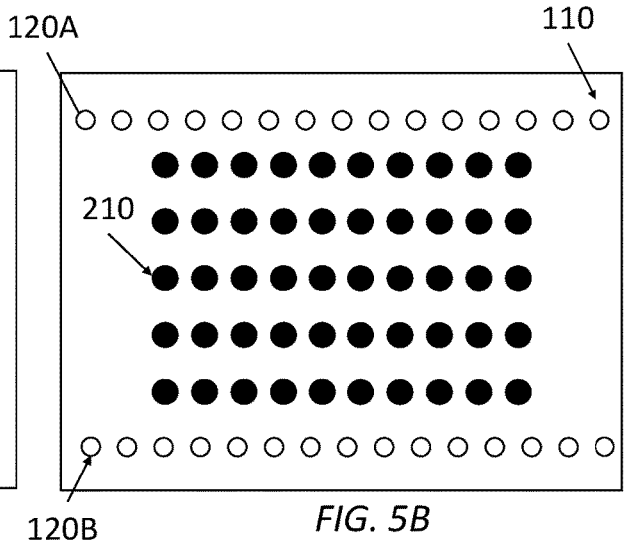
FIG. 5B is a top plan view of a substrate-integrated waveguide below the top conductive layer where a diameter of the material-filled vias is greater than a diameter of the metal-filled vias according to one embodiment.

Various example configurations of via diameter and spacing are shown in FIGS. 5A-5D. Referring to FIG. 5A, metal-filled vias 120A, 120B and material-filled vias 210 may respectively have a constant diameter and a constant pitch, where the material-filled vias 210 may have a smaller diameter and a smaller spacing than the metal-filled vias 120A, 120B. Referring to FIG. 5B, metal-filled vias 120A, 120B and material-filled vias 210 may respectively have a constant diameter and a constant pitch, where the material-filled vias 210 may have a greater diameter and a greater spacing than the metal-filled vias 120A, 120B. In FIGS. 5A and 5B, the material-filled via arrays may have a rectangular (or square) footprint.

Figure 5C:
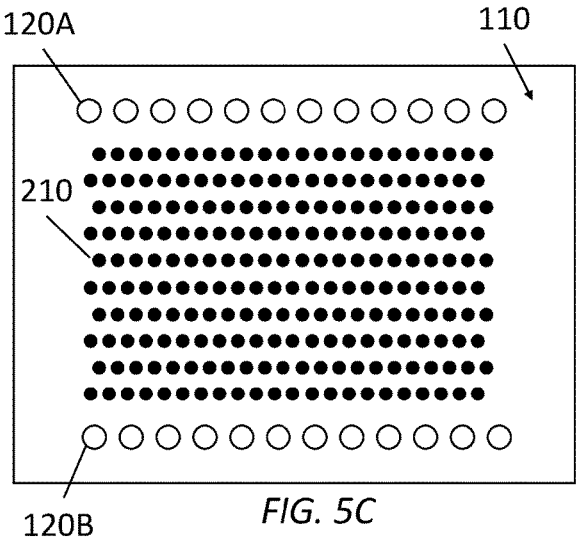
FIG. 5C is a top plan view of a substrate-integrated waveguide below the top conductive layer where alternating rows of material-filled vias are horizontally offset from intervening rows by half the pitch between the vias according to one embodiment.
Figure 5D:
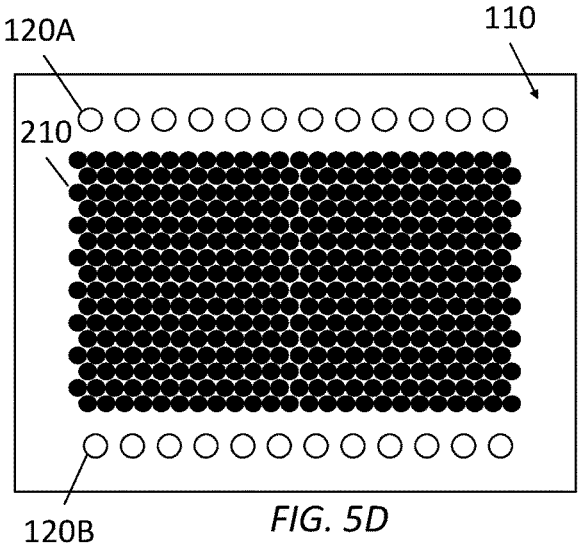
FIG. 5D is a top plan view of a substrate-integrated waveguide below the top conductive layer where diameters of the material-filled vias are approximately equal to a pitch between the material-filled vias to create a close-packed array of equal material-filled vias that maximizes the density of the material-filled vias in the propagating region between the metal-filled sidewall vias according to one embodiment.

Referring to FIG. 5C, adjacent horizontal rows within an array of material-filled vias may be offset with respect to each other, e.g., by half the pitch of the array. As the diameter of the vias approaches the pitch between each via, the vias may form a close packed array of equal cylinders, as illustrated in FIG. 5D, which may be used to maximize the density of the fill material within the propagating region.

According to some embodiments, an array of material-filled vias may be configured to tune the electric permittivity or the magnetic permeability of the substrate within the propagating region along a direction either parallel or perpendicular to the direction of propagation of an EM field. Referring to FIGS. 6A-6F, shown are various architectures where the material-filled via diameter, pitch and/or placement may be locally varied.

Figure 6A:
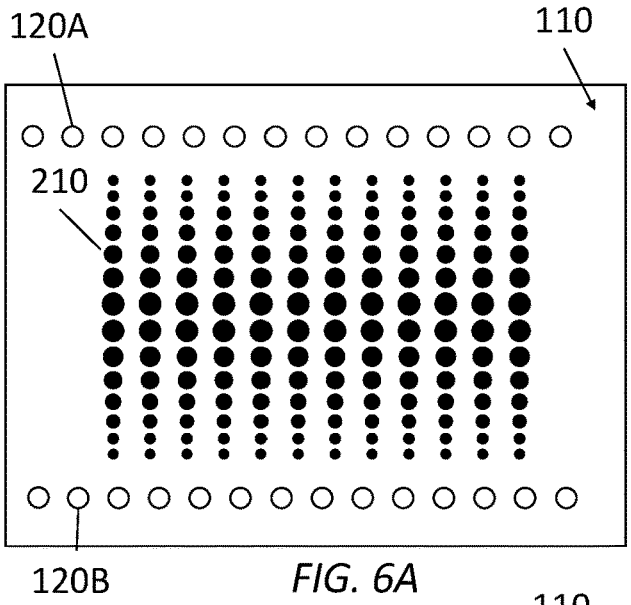
FIG. 6A is a top plan view of a substrate-integrated waveguide below the top conductive layer where diameters of the material-filled vias vary from larger in the middle of the substrate-integrated waveguide cross-section to smaller near the edge adjacent to the metal-filled via arrays to create a varying density of the fill material transverse to the substrate-integrated waveguide direction of propagation according to one embodiment.
Figure 6B:
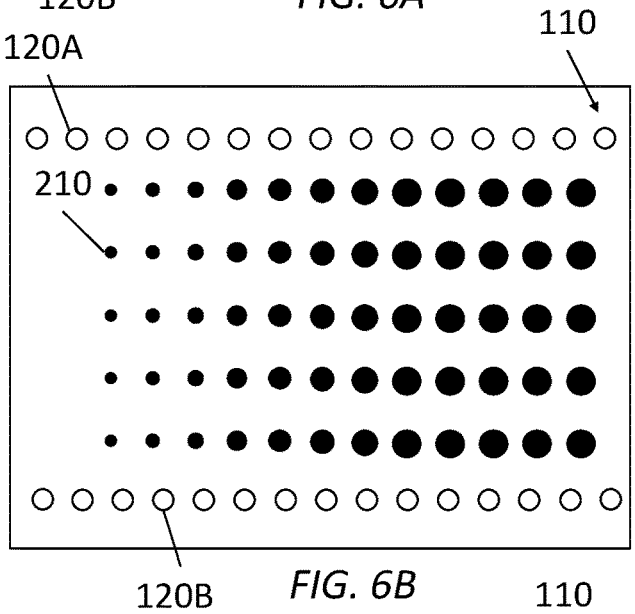
FIG. 6B is a top plan view of a substrate-integrated waveguide below the top conductive layer where diameters of the material-filled vias vary from smaller on the left side of the substrate-integrated waveguide cross-section to larger on the right side to create a varying density of the fill material along the substrate-integrated waveguide direction of propagation according to one embodiment.
Figure 6C:
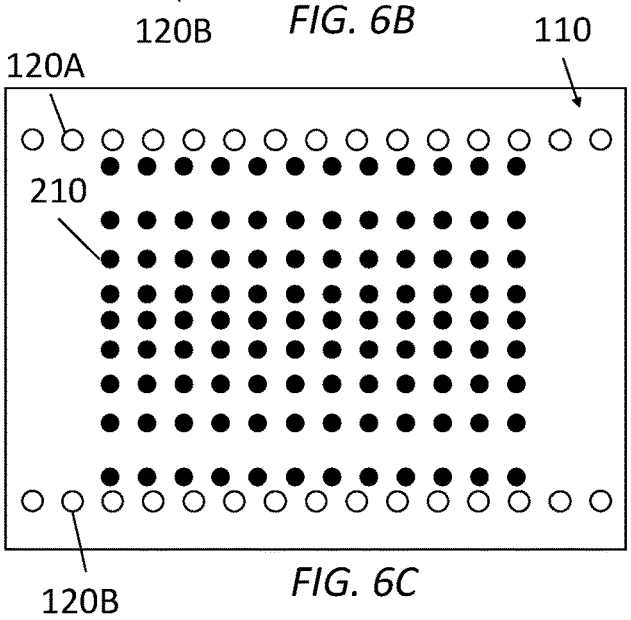
FIG. 6C is a top plan view of a substrate-integrated waveguide below the top conductive layer where a spacing between adjacent rows of the material-filled vias vary from smaller in the middle of the substrate-integrated waveguide cross-section to larger near the edges adjacent to the metal-filled via arrays to create a varying density of the fill material transverse to the substrate-integrated waveguide direction of propagation according to one embodiment.
Figure 6D:
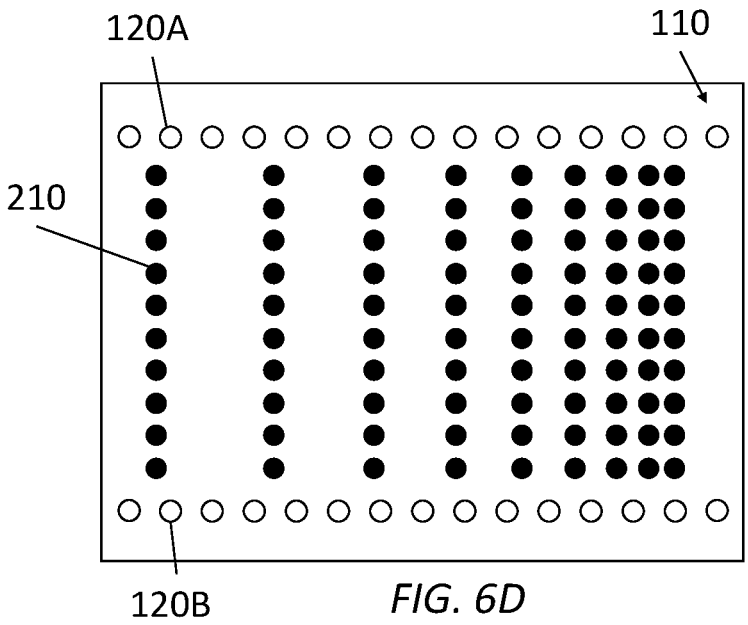
FIG. 6D is a top plan view of a substrate-integrated waveguide below the top conductive layer where a spacing between adjacent columns of the material-filled vias vary from larger on the left side of the substrate-integrated waveguide cross-section to smaller on the right side to create a varying density of the fill material along the substrate-integrated waveguide direction of propagation according to one embodiment.
Figure 6E:
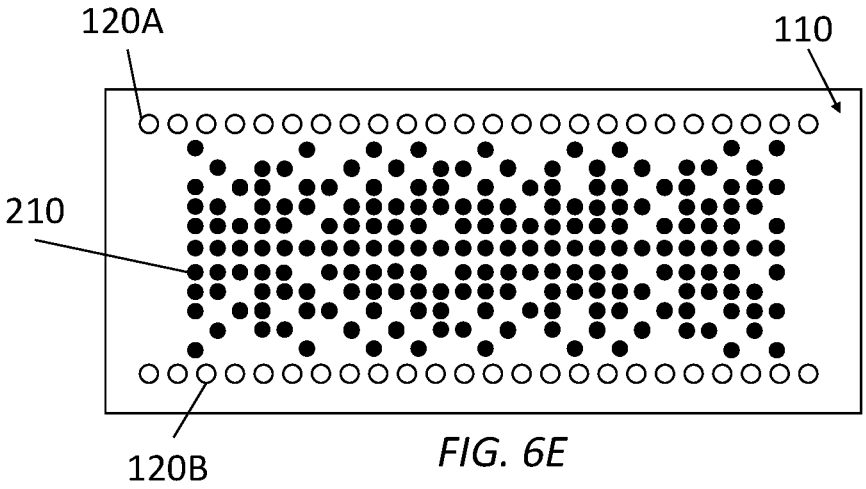
FIG. 6E is a top plan view of a substrate-integrated waveguide below the top conductive layer where a number of material-filled vias in adjacent rows decreases from the middle of the substrate-integrated waveguide cross-section to the edge proximate to the metal-filled via arrays to create a varying density of the fill material transverse to the substrate-integrated waveguide direction of propagation according to one embodiment.
Figure 6F:
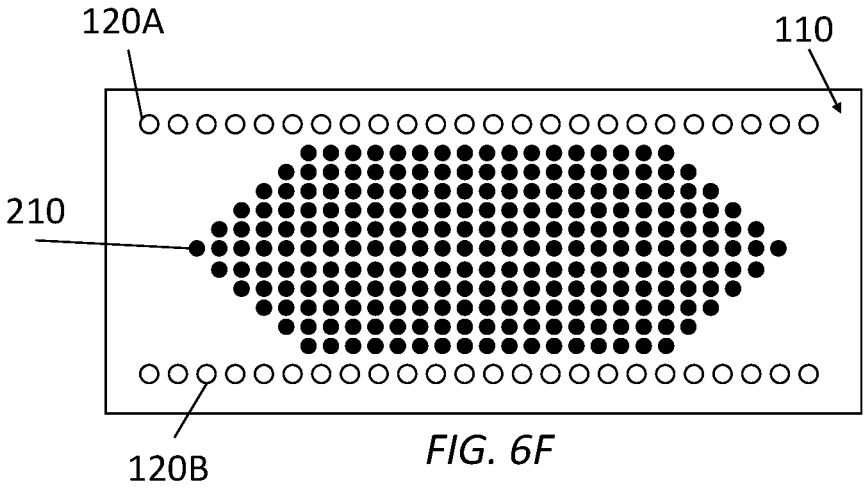
FIG. 6F is a top plan view of a substrate-integrated waveguide below the top conductive layer where the material-filled vias form a chevron pattern on the left side and right side to create a varying density of the fill material both along and transverse to the substrate-integrated waveguide direction of propagation according to one embodiment.

FIG. 6A shows an embodiment where the diameters of the material-filled vias vary from larger in a central area of the propagating region to smaller near each array of metal-filled vias. FIG. 6B shows an array of material-filled vias where the via diameter increases (or decreases) along a propagation direction within the propagating region. FIG. 6C illustrates an embodiment where an inter-via spacing varies along a transverse direction within the propagating region, e.g., from smaller in a central area of the propagating region to larger near each array of metal-filled vias. FIG. 6D illustrates an embodiment where an inter-via spacing varies along a propagation direction within the propagating region. FIG. 6E shows an embodiment where the number of material-filled vias in each row decreases from along a centerline of the propagating region toward each metal-filled via array 120A, 120B. FIG. 6F shows an embodiment where the material-filled vias form a chevron pattern proximate to the input and output zones of the propagating region.

Referring also to FIG. 5, as will be appreciated, for a propagation direction from left to right, an EM field may experience an increasing, decreasing or invariant change in tunable material density within a propagating region. In certain embodiments, the variation in diameter, pitch, and/or placement of the material-filled vias may be used to create a slowly-varying change in the effective electric permittivity or the effective magnetic permeability of the substrate, which may decrease the propensity for undesired scattering and reflection of the propagating EM field.

The composite substrate may be configured to conform to the effective medium approximation so that the EM field interacts with the propagating region as if it was effectively homogeneous thus avoiding unwanted EM field scattering or reflection. In some embodiments, an effective medium approximation may be used to determine the length scale where the respective electric permittivity or magnetic permeability of the substrate and material-filled vias averages to the value for the composite material. According to some embodiments, the diameter of the individual material-filled vias may be less than 0.5 times the operating wavelength of the EM radiation, e.g., less than 0.4 times the operating wavelength, less than 0.3 times the operating wavelength, less than 0.2 times the operating wavelength, or less than 0.1 times the operating wavelength, including ranges between any of the foregoing values.

Figure 7:
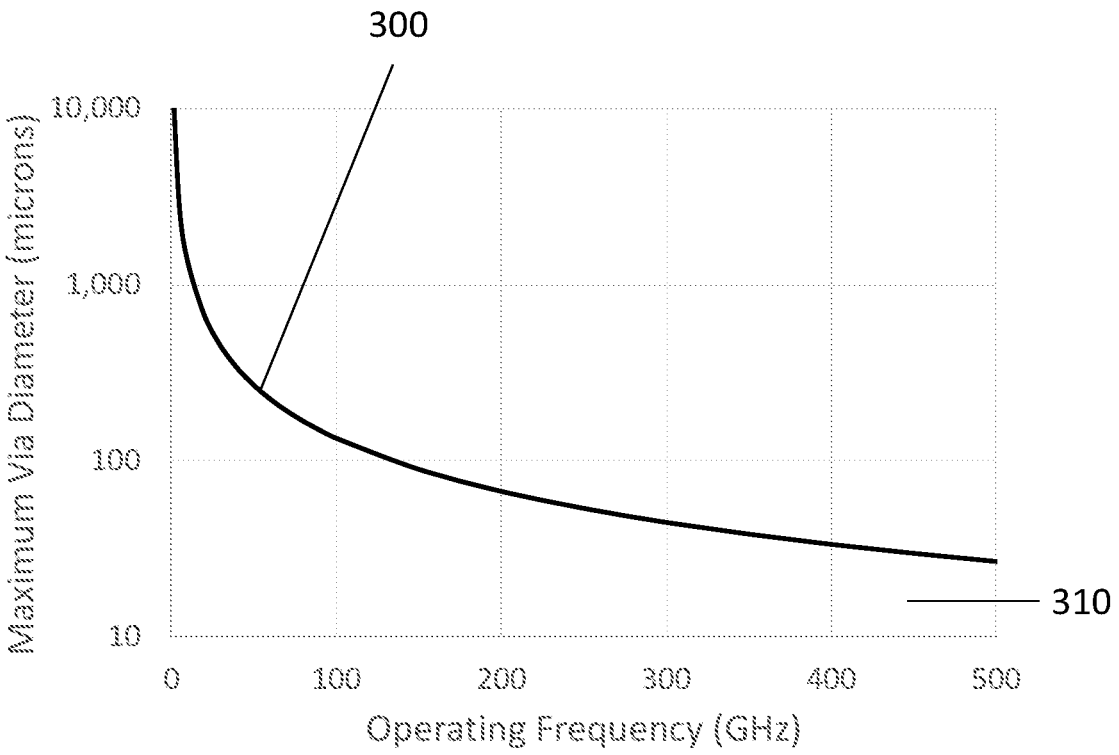
FIG. 7 is a graph of maximum via diameter in microns verses operating frequency in GHz providing an effective medium approximation of the composite substrate electric permittivity or magnetic permeability for a material-filled via-containing substrate.

FIG. 7 is a plot of maximum via diameter versus operating frequency where the curve 300 approximates the condition where the maximum via diameter is about 0.1 times the operating wavelength. The substrate refractive index was assumed to be 2.236 over the plotted frequency range, which approximates the refractive index of many common glass and polymer substrate materials. For the instant example, suitable values for the material-filled via diameter lie within region 310 below curve 300.

Material-filled vias, as an effective medium for the composite substrate, enable a high degree of design flexibility in the spatial control of the substrate dielectric constant (i.e., relative electric permittivity or magnetic permeability). Control of the real and imaginary parts of the dielectric constant may provide various advantages. For instance, the material-filled vias may be arranged to decrease the change in the real part of the dielectric constant as a function of the propagation direction of a signal or power EM field (e.g., as shown in FIGS. 6B, 6D, and 6F) to decrease or eliminate discontinuities that can cause reflections or scattering. Also, the material-filled vias can be arranged to decrease the change in the real part of the dielectric constant as a function of the cross-sectional area of a waveguide or transmission line (e.g., as shown in FIGS. 6A, 6C, and 6E).

While these designs are merely illustrative, such configurations may be used independently or in combination to provide a graded index profile within the propagating region of a dielectric substrate, which may be used, for example, to decrease the radiation loss from the sides of a parallel plate, strip, or microstrip transmission line or, as a further example, to match the propagation constants or speeds of different modes supported by a substrate-integrated waveguide. Finally, the material-filled vias can be arranged to decrease or even minimize their overlap with the propagating electric field for certain parts of a circuit. Devices such as resonators and filters, where the tunable material may have a higher loss tangent than the substrate material, may advantageously exhibit a high cavity resonator quality factor, or Q-factor.

In accordance with some embodiments, an externally-applied voltage may be used to control, i.e., spatially tune, the electric permittivity of the material-filled vias, and hence the effective electric permittivity of the propagating region within the dielectric substrate.

Figure 8A:
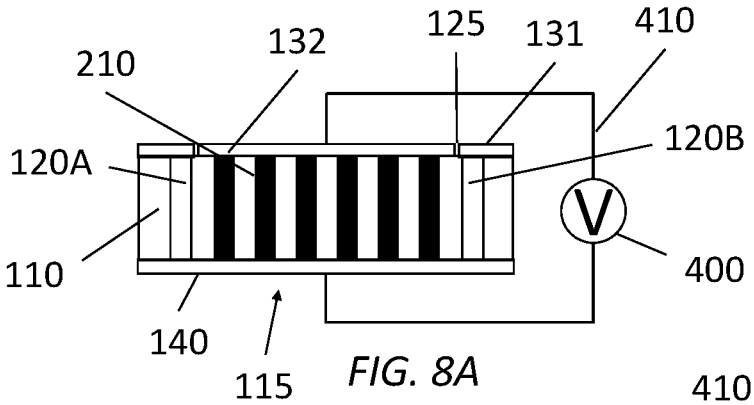
FIG. 8A is an end cross-sectional view through two parallel arrays of metal sidewall vias of a substrate-integrated waveguide with material-filled vias and an external voltage applied to a separate conductive region overlying the material-filled vias.
Figure 8B:
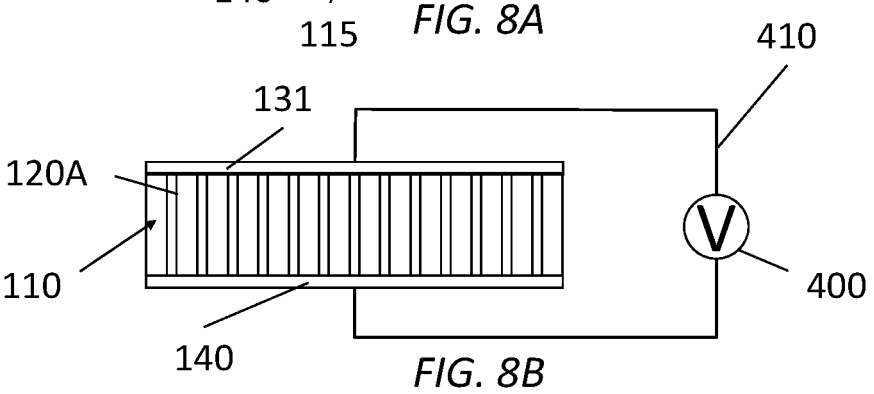
FIG. 8B is a side cross-sectional view through one of the sidewall arrays of metal-filled vias of the substrate-integrated waveguide of FIG. 8A.

Mutually transverse cross-sectional views of an example system architecture are shown in FIG. 8A and FIG. 8B, where FIG. 8A is an end view and FIG. 8B is a corresponding side view of a SIW system that includes a dielectric substrate 110, parallel metal-filled via arrays 120A, 120B extending along a longitudinal direction of the substrate 110 (i.e., parallel to a propagation direction of an EM field through the substrate) and defining a propagating region 115 therebetween, an electrode 131 for the metal-filled vias proximate to the metal-filled via arrays 120A, 120B, an electrode 132 for the material-filled vias electrically isolated from the metal-filled via electrode 131 and proximate to an array 205 of material-filled vias 210 located within the propagating region 115, and a ground plane electrode 140 overlying a bottom surface of the dielectric substrate 110 adjacent to both the metal-filled vias and the material-filled vias. A gap 125 extending through the electrode layers overlying the dielectric substrate separates the metal-filled via electrode 131 from the material-filled via electrode 132 such that a tuning voltage may be applied across the material-filled vias 210 within propagating region 115 independent of a drive voltage applied across metal-filled vias 120A, 120B. In the illustrated embodiment, an external voltage source 400 is configured to apply a voltage across material-filled vias 210 through an external circuit 410. The applied voltage may be either AC or DC driven.

The gap 125 in the top conductive layer may block the DC component of the tuning voltage applied through circuit 410 and with the gap width properly defined, may create a capacitance to inhibit or prevent low frequencies associated with the drive voltage from interacting with the propagating EM signal. For instance, the gap width can be decreased to allow strong coupling of the propagating field across the gap without reflection.

Figure 8C:
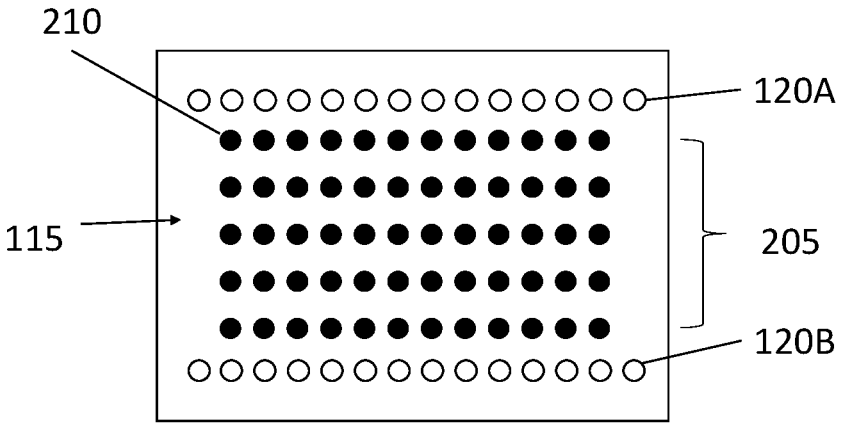
FIG. 8C is a top plan view of the substrate-integrated waveguide of FIGS. 8A and 8B below the top conductive layers.
Figure 8D:
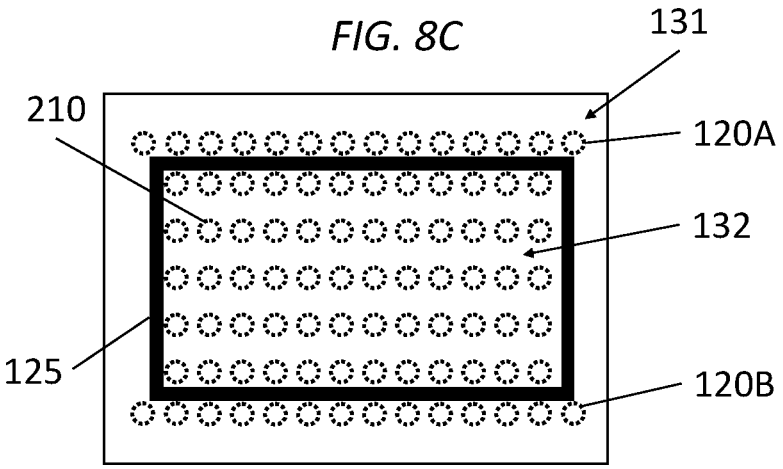
FIG. 8D is a top view of the substrate-integrated waveguide of FIG. 8A showing the top conductive layers separated by a gap.

FIG. 8C is a top plan view of the substrate-integrated waveguide of FIGS. 8A and 8B below the top conductive layers 131, 132 showing the array 205 of material-filled vias 210 within propagating region 115 and the pair of sidewall metal-filled vias 120A, 120B. Conductive layers 131, 132 and the intervening gap 125 are shown in the top down view of FIG. 8D.

Figure 9A:
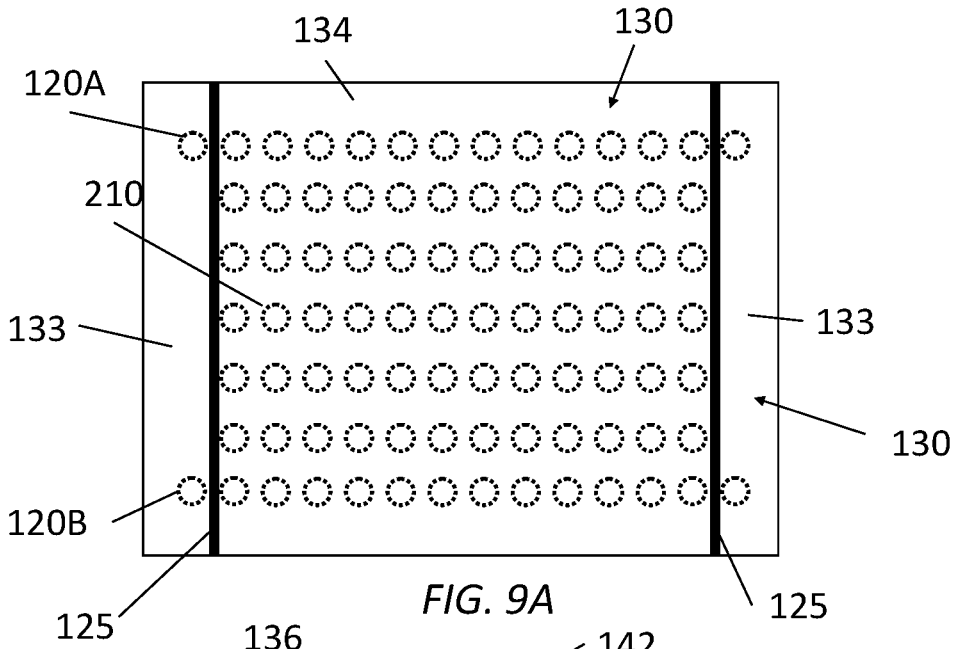
FIG. 9A is a top view of a substrate-integrated waveguide including an array of material-filled vias located within the EM field propagating region according to some embodiments.
Figure 9B:
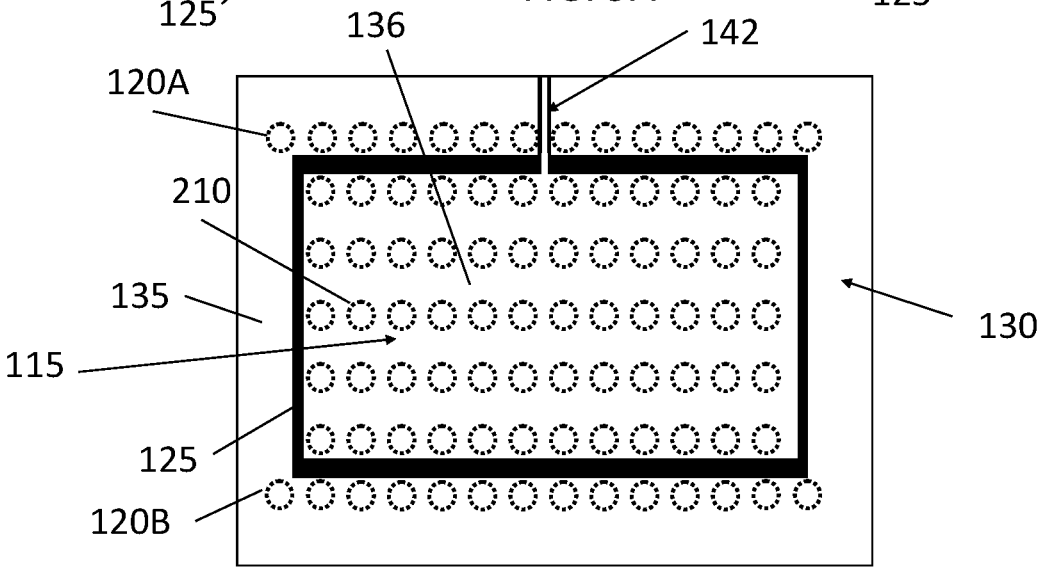
FIG. 9B is a top view of a substrate-integrated waveguide including an array of material-filled vias located within the EM field propagating region and including inner and outer top conductive layers separated by a gap according to certain embodiments.
Figure 9C:
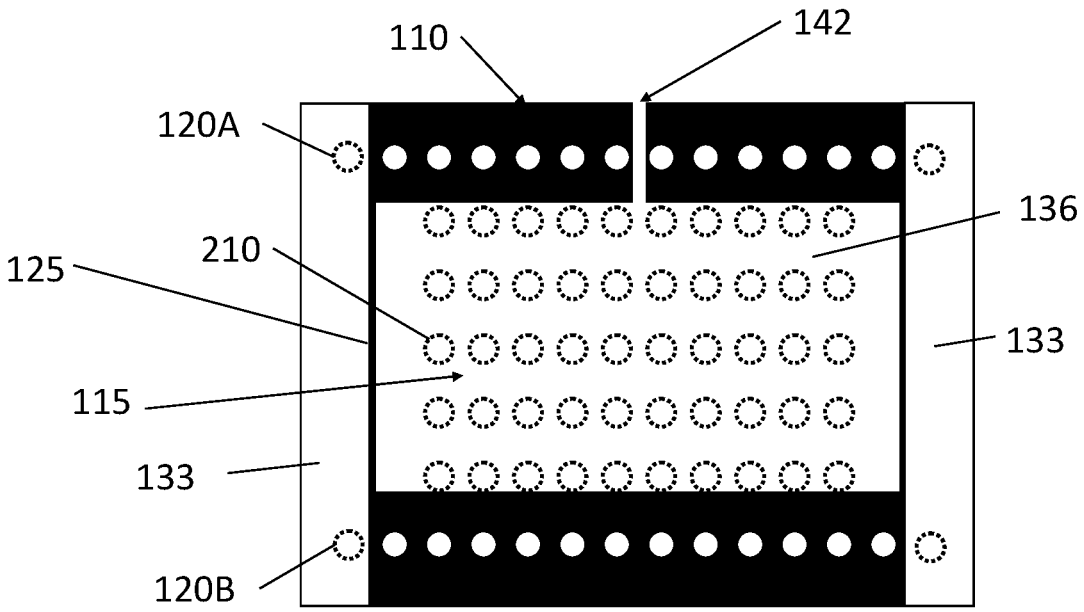
FIG. 9C is a top view of a substrate-integrated waveguide including an array of material-filled vias located within the EM field propagating region according to further embodiments.
Figure 9D:
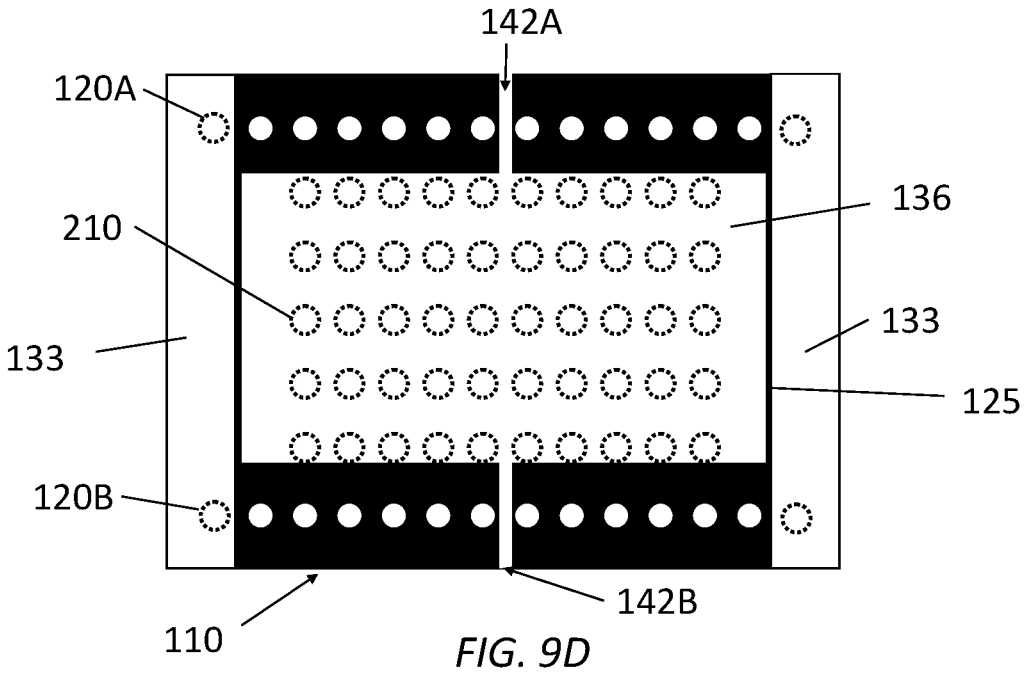
FIG. 9D is a top view of a substrate-integrated waveguide including an array of material-filled vias located within the EM field propagating region according to still further embodiments.

Various electrode configurations may be used to apply a voltage to the material-filled vias while electrically isolating the applied voltage from the propagating EM field, i.e., upstream of the propagating region, within the propagating region, and/or downstream of the propagating region of a device such as a substrate-integrated waveguide. Referring to FIG. 9A, in an example waveguide, parallel gaps 125 extend across the entire top surface of the top conductive layer 130 and partition the top conductive layer 130 into upstream/downstream segments 133 and an intermediate segment 134 that overlies material-filled vias 210. Referring to FIG. 9B, a gap 125 partially circumvents propagating region 115 defining an outer conductive layer 135, i.e., overlying metal-filled vias 120A, 120B, and an inner conductive layer 136, i.e., overlying material-filled vias 210 within the propagating region 115. A microstrip transmission line 142 may traverse gap 125 allowing access to inner conductive layer 136. Referring to FIG. 9C and FIG. 9D, in further embodiments, the top conductive layer may be omitted from edges of the waveguide, i.e., proximate to metal-filled vias 120A, 120B adjacent to the propagating region 115. One or more microstrip transmission lines (i.e., transmission line 142 in FIG. 9C and transmission lines 142A, 142B in FIG. 9D) may provide electrical continuity with inner conductive layer 136. In certain embodiments, transmission lines 142, 142A, 142B may have a width that is less than the difference between the pitch of the metal-filled vias and the diameter of the metal-filled vias, although larger transmission line dimensions are contemplated.

An aspect of a traveling wave design may co-integrate the electrical path for applying a tuning voltage with a transmission line. The number and the position of one or more transmission lines may be selected to phase match the tuning voltage to that of the propagating EM field. Such temporal overlap may transfer the electric permittivity change caused by the applied field to the SIW propagating field.

Figure 9E:
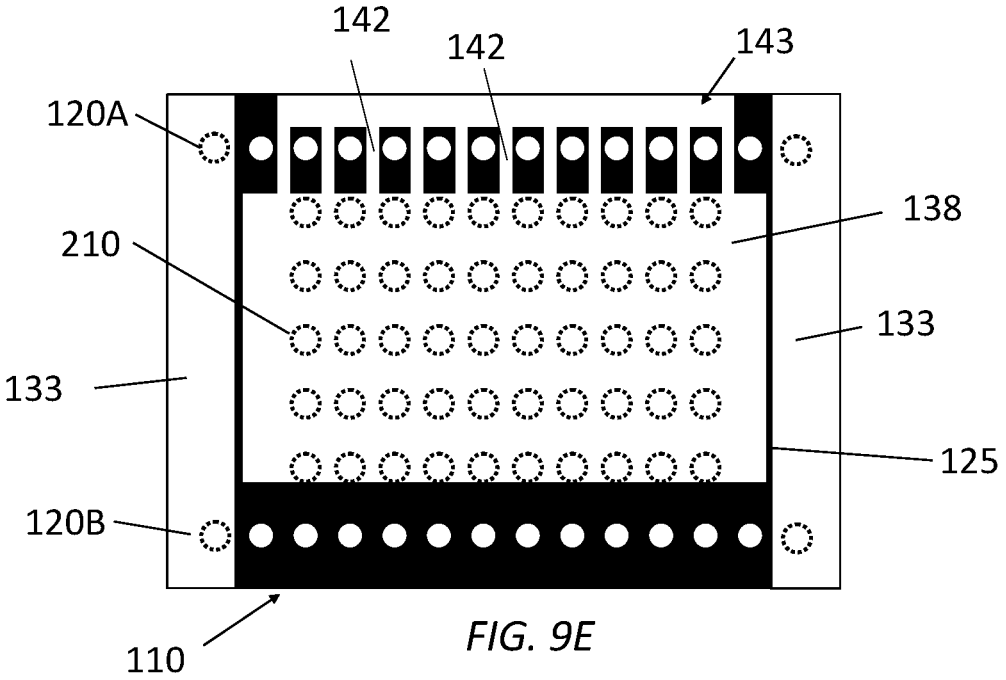
FIG. 9E is a top view of a substrate-integrated waveguide including an array of material-filled vias located within the EM field propagating region according to certain embodiments.
Figure 9F:
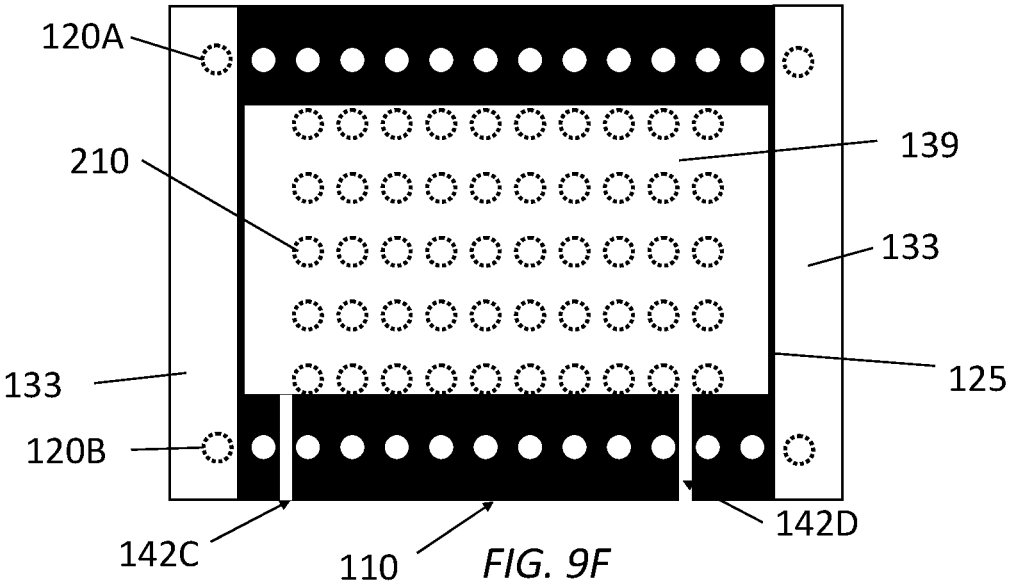
FIG. 9F is a top view of a substrate-integrated waveguide including an array of material-filled vias located within the EM field propagating region according to certain embodiments.

Referring to FIG. 9E, for example, multiple transmission lines 142 may be interconnected through a common conductive region 143 and may each contact conductive layer 138 overlying material-filled vias 210. Referring to FIG. 9F, shown is a traveling wave design where a tuning voltage may enter and exit conductive region 139 through an input transmission line 142C and an output transmission line 142D, respectively. In some embodiments, transmission lines (e.g., transmission lines 142C, 142D in FIG. 9F) may pass between adjacent metal filled vias 1206. In other embodiments, a transmission line width may be greater so that the transmission line may overlie one or more metal-filled vias. Furthermore, as in the illustrated embodiment of FIG. 9F, transmission lines 142C, 142D may be oriented substantially orthogonal to the array 1206 of metal-filled vias. In alternate embodiments, transmission lines 142C, 142D may be oriented at any suitable oblique angle with respect to an adjacent metal-filled via array.

Figure 9G:
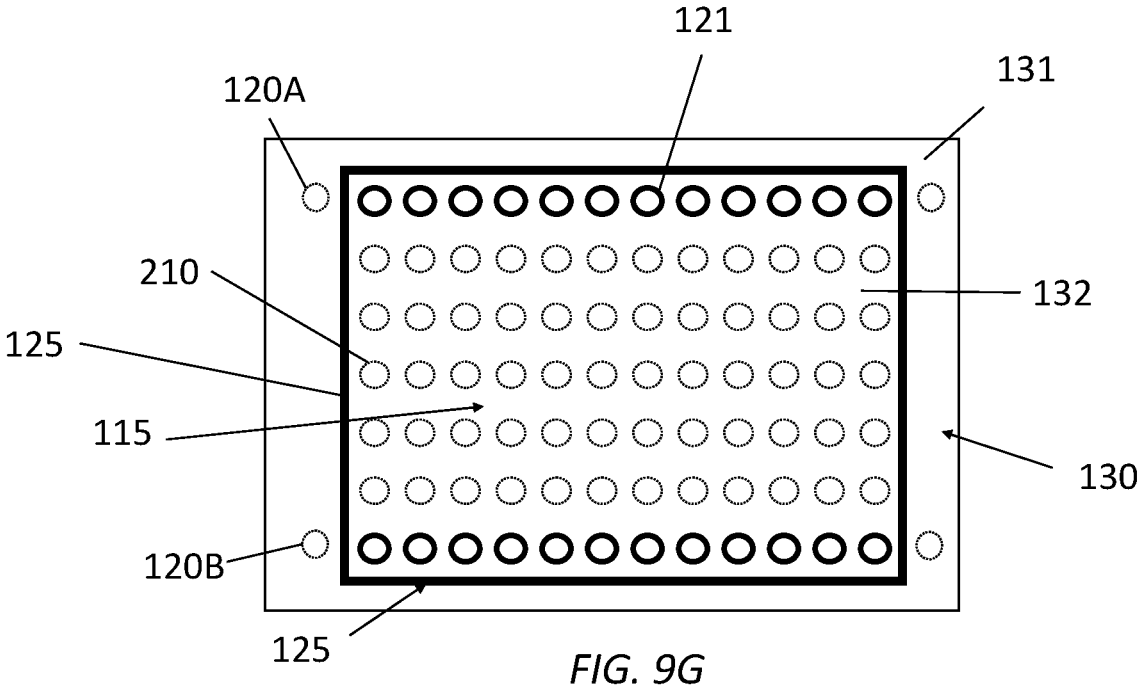
FIG. 9G is a top view of a substrate-integrated waveguide including an array of material-filled vias located within the EM field propagating region according to some embodiments.
Figure 9H:
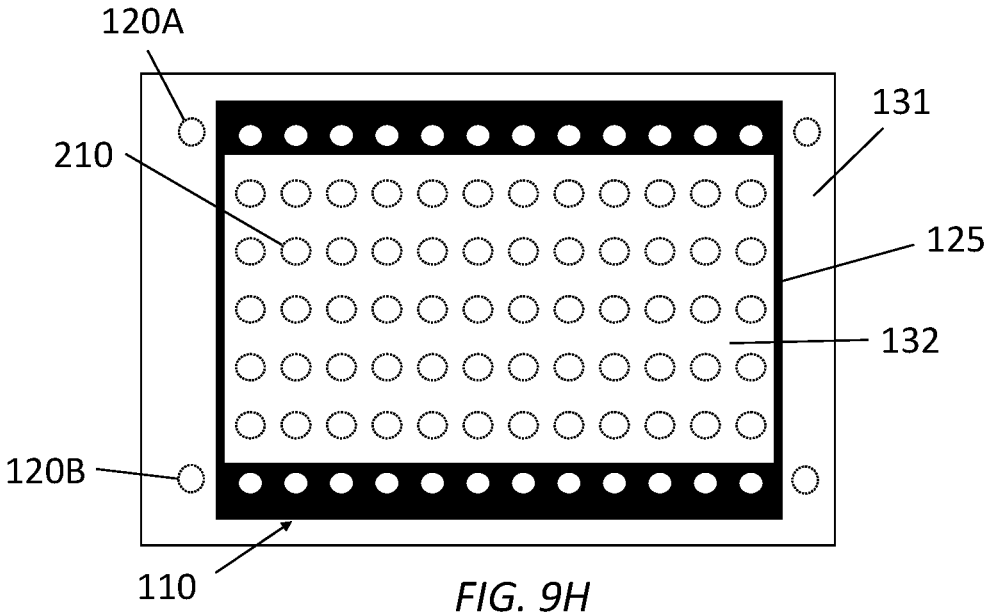
FIG. 9H is a top view of a substrate-integrated waveguide including an array of material-filled vias located within the EM field propagating region according to some embodiments.

Referring to FIG. 9G, top conductive layer 130 may be divided by a gap 125 into (i) a metal-filled via electrode 131 overlying portions of the metal-filled via arrays 120A, 120B located upstream and downstream of propagating area 115, and (ii) a material-filled via electrode 132 electrically isolated from the metal-filled via electrode 131 and overlying material-filled vias 210 located within the propagating region 115. A gap 121 may be used to isolate selected metal-filled vias from the material-filled via electrode 132. FIG. 9H is a variant of FIG. 9G where in lieu of gaps 121, the material-filled via electrode 132 may be omitted from a region proximate to selected metal-filled vias 120A, 120B.

As will be appreciated, the electrode configurations illustrated in FIGS. 9A-9H may be implemented to contain a propagating EM field while decreasing insertion losses and unwanted reflections as well as undesirable interference from one or more applied voltages.

According to further embodiments, a patterned (e.g., interdigitated) top conductive electrode architecture may be used to improve the coupling efficiency of a propagating EM field. With reference to the planar waveguides of FIG. 10A and FIG. 10B, for example, and without loss of generality, an input propagating EM field may come from the left and pass through propagating region 115 before exiting the waveguide at the right. Metallized sidewall via arrays 120A and 120B may extend beyond an array of material-filled vias 210 and laterally confine the propagating EM field. A gap 125 in the top conductive layer may separate metal-filled via electrode 131 from material-filled via electrode 132.

An interdigitated pattern 144 in the top conductive layer 130 may be located at the entrance and exit interfaces respectively between upstream and downstream regions and propagating region 115. The dimensions of the interdigitated, comb-shaped conductive regions may beneficially impact passage of a propagating EM field into and out of the propagating region 115 and accordingly decrease reflections and create a higher capacitance between adjacent regions.

Figure 10A:
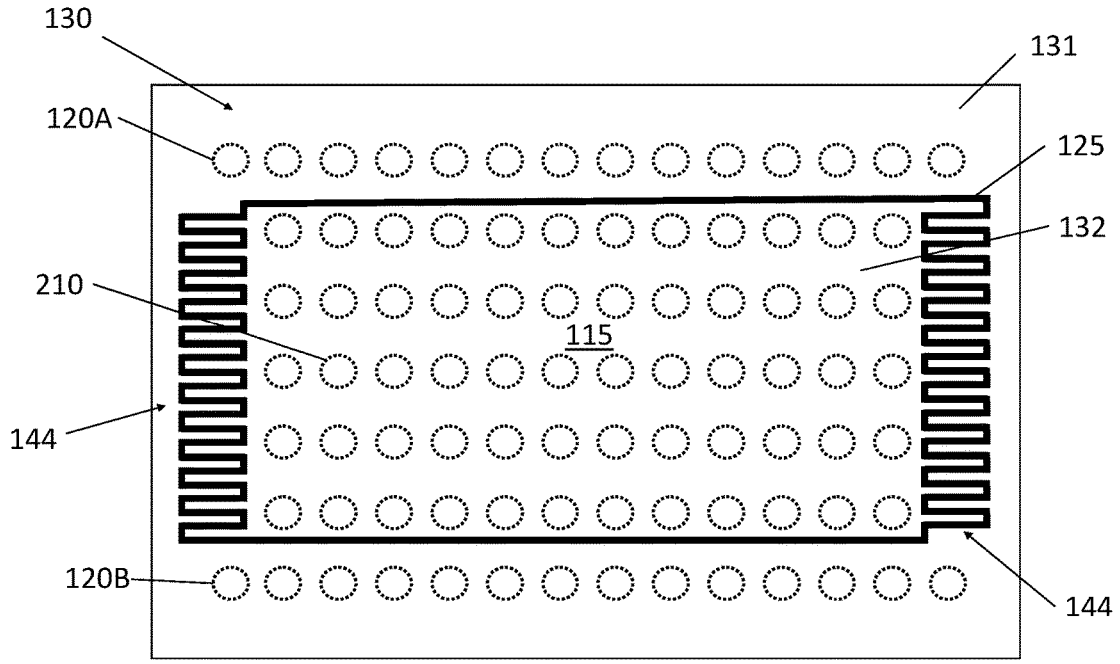
FIG. 10A is a top view of a substrate-integrated waveguide including material-filled vias within the EM field propagating region and having a zig-zag gap in the top conductive layer along the left and right borders that electrically separates the material-filled vias from the metal-filled vias.
Figure 10B:
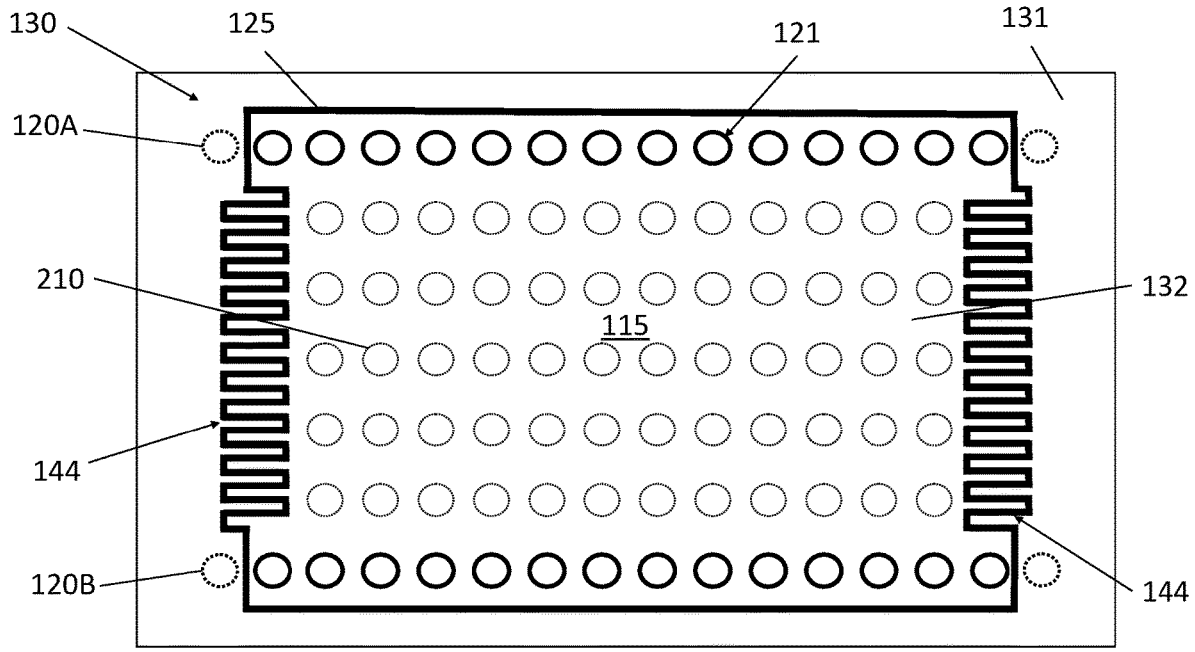
FIG. 10B is a top view of a substrate-integrated waveguide including material-filled vias within the EM field propagating region and having a zig-zag gap in the top conductive layer along the left and right borders that circumvents the material-filled vias and a portion of the conductive sidewall metal-filled vias.

An alternative interdigitated conductive pattern is shown in FIG. 10B. FIG. 10B is a top view of a substrate-integrated waveguide having material-filled vias 210 within the EM field propagating region 115 where a gap 125 in the top conductive layer circumvents both the material-filled vias 210 and the adjacent sidewall via arrays 120A and 120B proximate to the propagating region 115. Metal-filled vias within the area enclosed by the gap 125 are electrically isolated from the electrical field applied to conductive layer 132 by a thin gap 121 in the conductive layer 132 around each metal-filled via 120A, 120B.

Figure 11A:
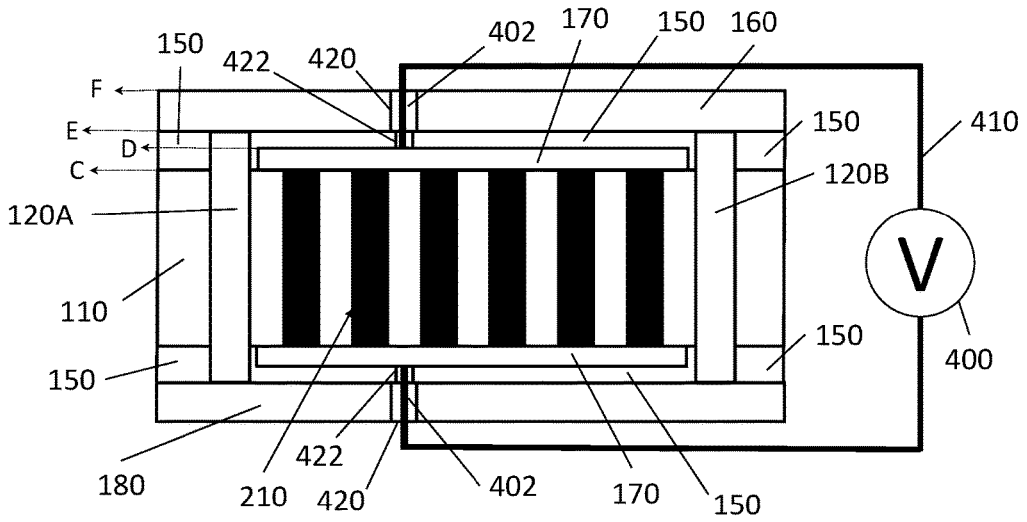
FIG. 11A is an end cross-sectional view through two of the parallel metal sidewall via arrays of a substrate-integrated waveguide with material-filled vias and an external voltage applied to a separate conductive region adjacent to the material-filled vias through an added dielectric layer on the top and bottom surfaces.
Figure 11B:
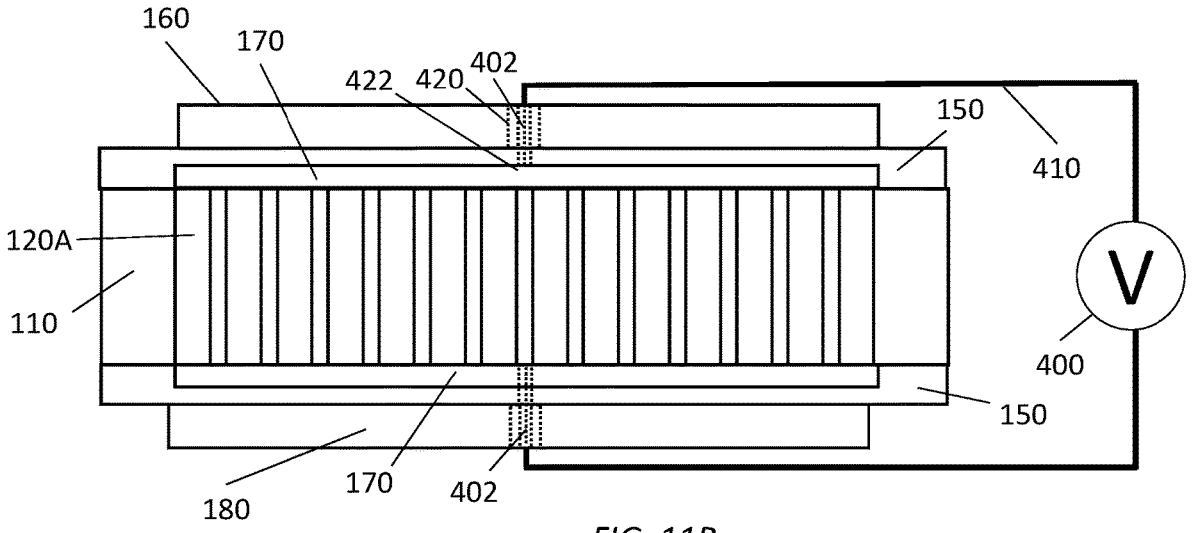
FIG. 11B is a side cross-sectional view through one of the sidewall metal-filled via arrays of the substrate-integrated waveguide of FIG. 11A.
Figure 11C:
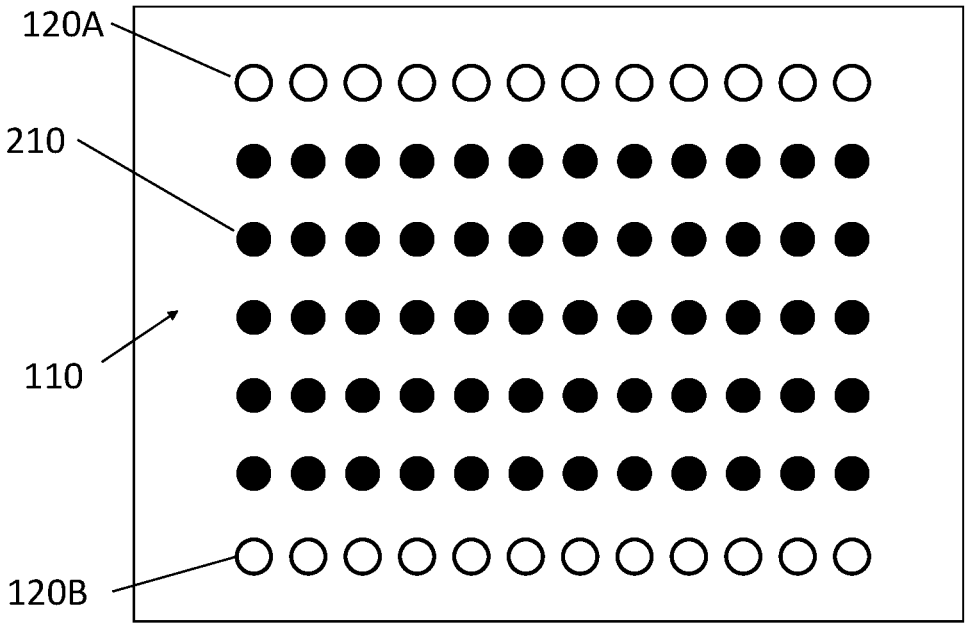
FIG. 11C is a top plan view of the substrate-integrated waveguide of FIG. 11A at the cross-section marked as C.
Figure 11D:
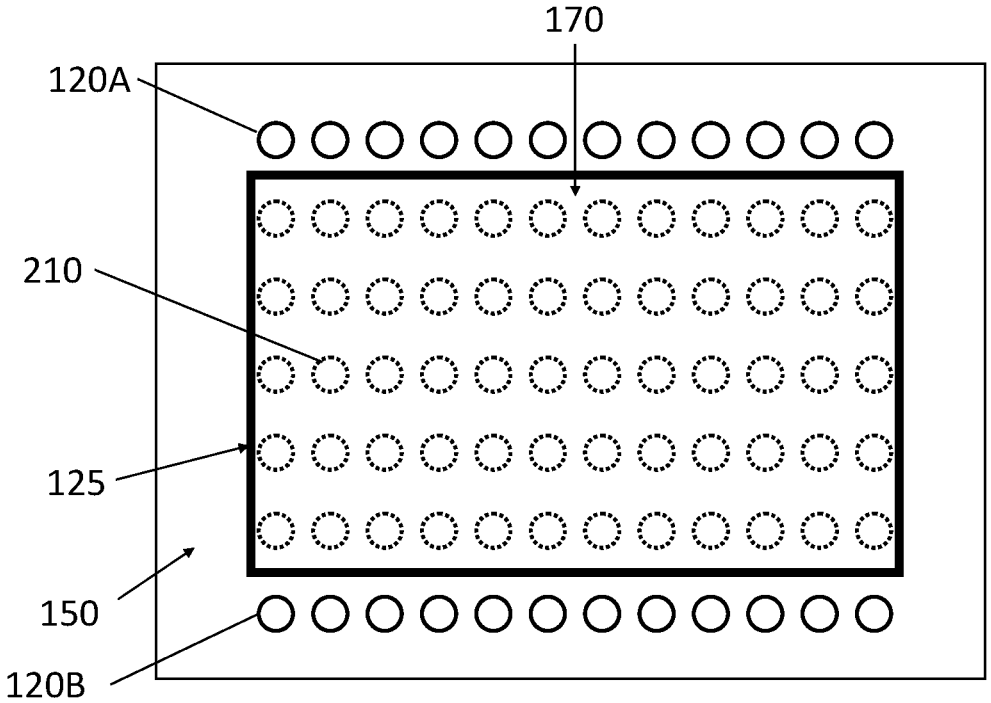
FIG. 11D is a top view of the substrate-integrated waveguide of FIG. 11A at the cross-section marked as D.
Figure 11E:
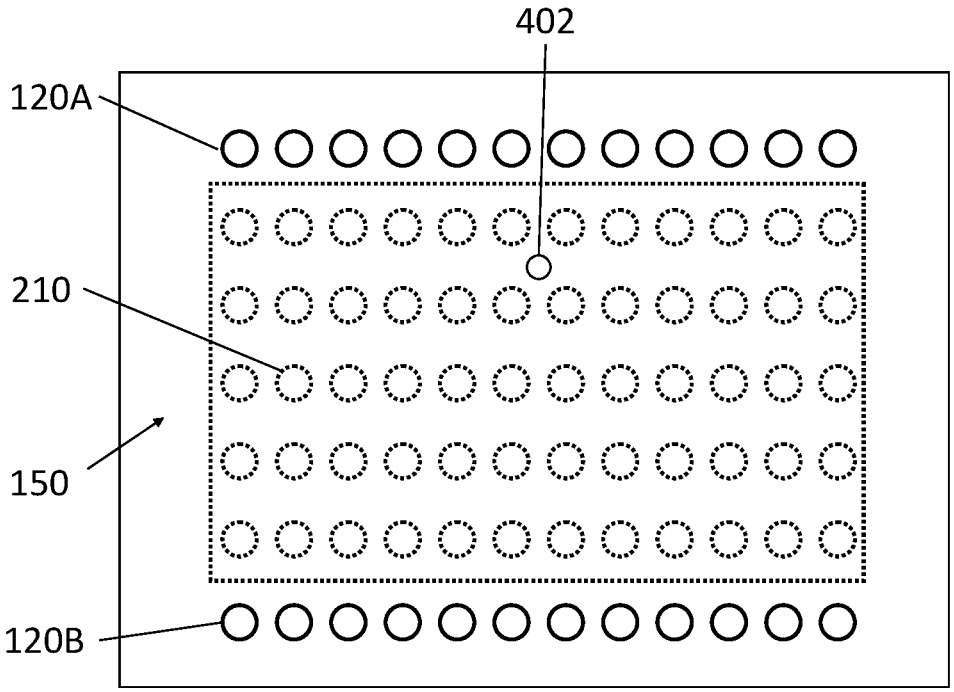
FIG. 11E is a top view of the substrate-integrated waveguide of FIG. 11A at the cross-section marked as E.
Figure 11F:
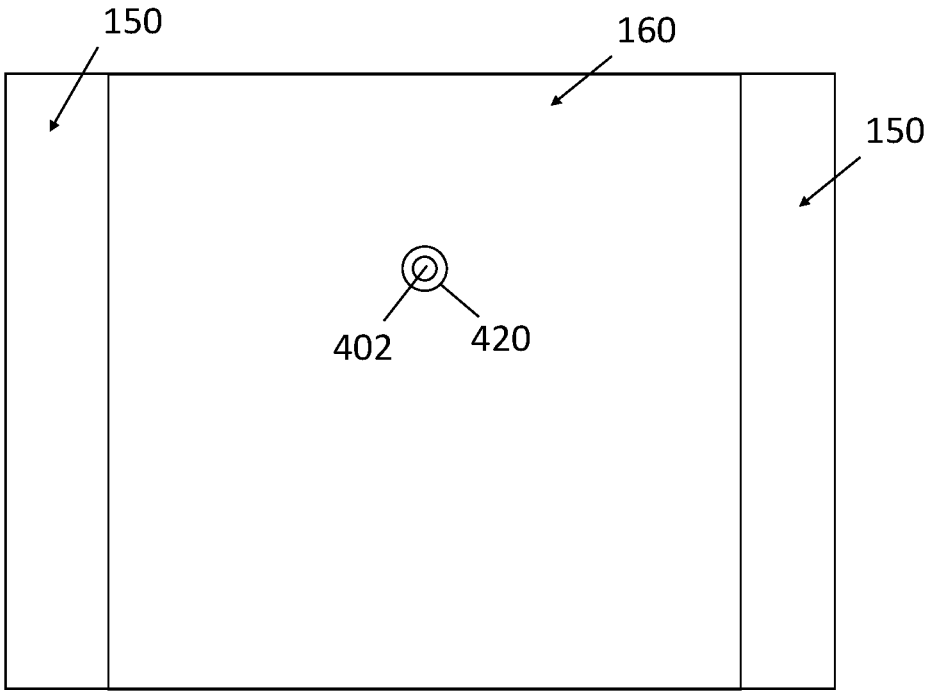
FIG. 11F is a top view of the substrate-integrated waveguide of FIG. 11A at the cross-section marked as F.

According to some embodiments, a composite substrate may further include a dielectric layer configured to improve isolation between a propagating field and a drive or control voltage. Referring to FIG. 11A and FIG. 11B, which are end and side cross-sectional views respectively of an exemplary substrate-integrated waveguide, a dielectric layer 150 may be disposed over one or both major surfaces of dielectric substrate 110. A dielectric layer 150 may include silicon dioxide, for example, or a low loss tangent dielectric polymer.

Dielectric layers 150 may be located between the substrate 110 and respective top and bottom conductive layers 160, 180. A schoopage layer 170 may be disposed between each dielectric layer 150 and the substrate 110 to provide electrical contact to the array 210 of material-filled vias. Metal-filled via arrays 120A, 120B may extend entirely through the substrate 110 and through the overlying and underlying dielectric layers 150.

Circuit 410 may extend through a contact via 402 and may be electrically isolated within via 402 from top and bottom conductive layers 160, 180 using an isolation dielectric 420, as well as from schoopage layers 170 using an isolation dielectric 422. Top down illustrations viewed along cross-sections C-F of FIG. 11A are shown in FIGS. 11C-11F.

Figure 12A:
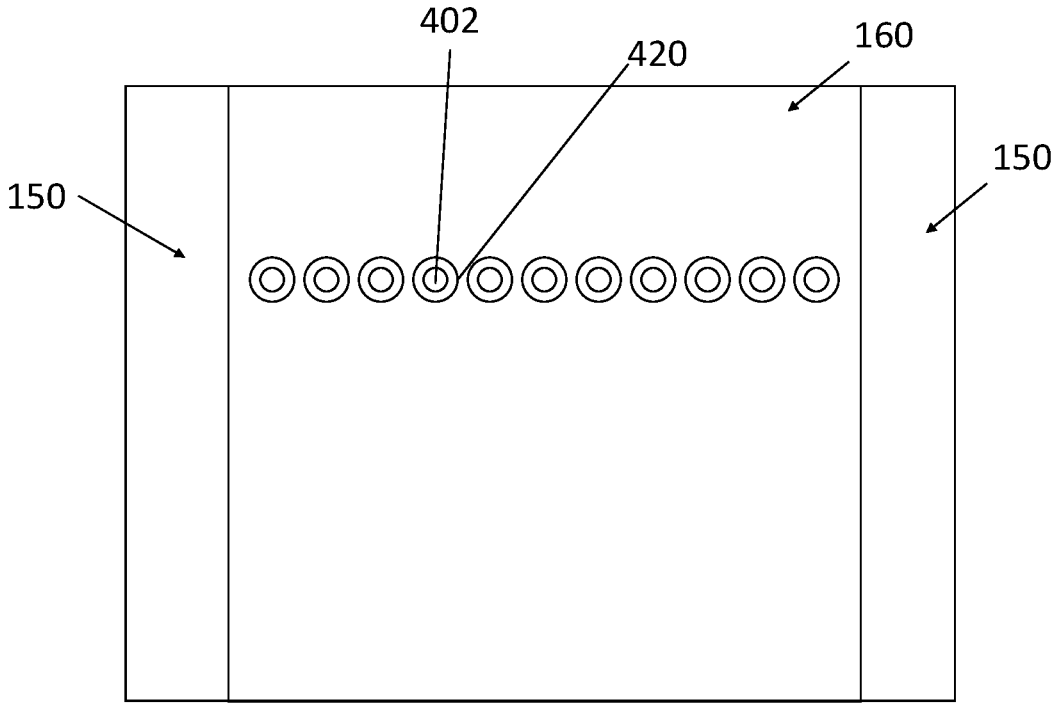
FIG. 12A is an alternate embodiment of FIG. 11F showing an array of dielectrically-isolated metallized vias.
Figure 12B:
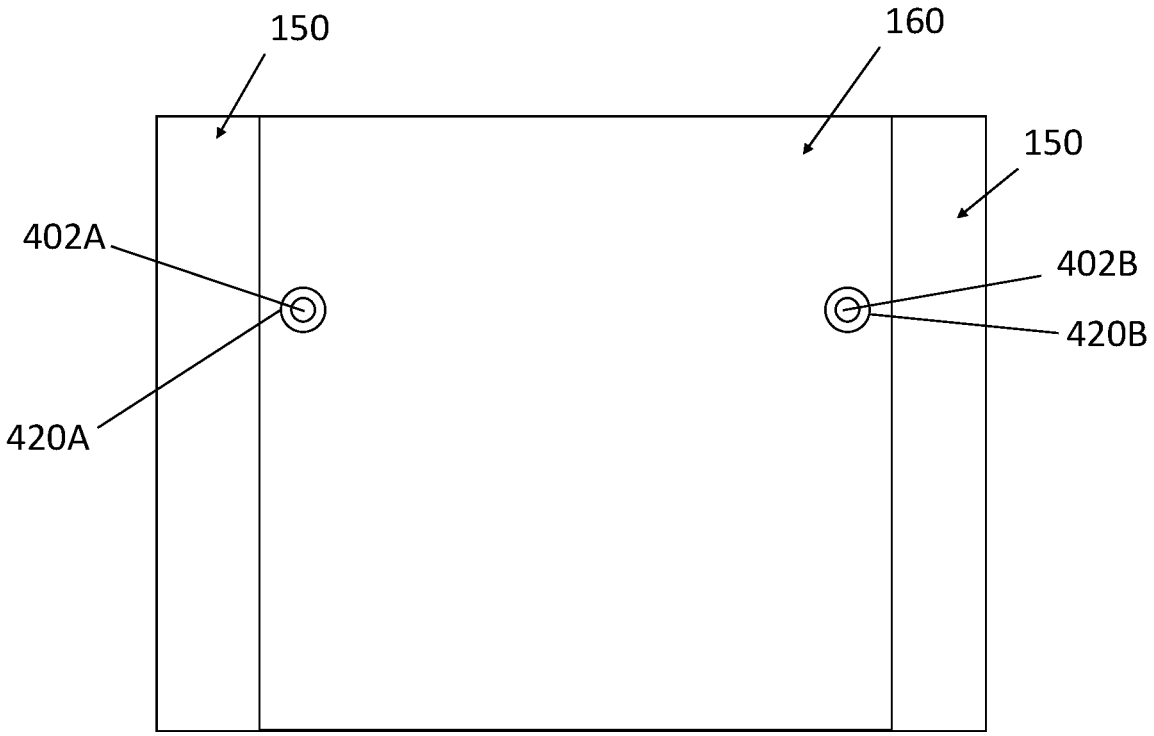
FIG. 12B is an alternate embodiment of FIG. 11F showing metallized and dielectrically-isolated input and output vias.

According to certain embodiments, more than one electrical contact may be made between the circuit 410 of an external voltage source 400 and an array of material-filled vias. Referring also to the single contact via embodiment of FIG. 11F, further example substrate-integrated waveguides having plural contact vias 402 that extend through, and are isolated from, a top conductive layer 160 are shown in the top down views of FIG. 12A and FIG. 12B. FIG. 12A shows an array of contact vias 402 each insulated by an isolation dielectric layer 420. FIG. 12B shows a pair of contact vias 402A, 402B each lined with a respective isolation dielectric 420A, 420B.

By way of example, the architecture of FIG. 12B may be used in a traveling wave configuration with the input on the left and the output on the right, or conversely the input on the right and the output on the left. In certain embodiments, the tuning voltage input may be on the same side of the waveguide as that of the propagating EM field and may propagate along a direction substantially parallel to a propagation direction of the EM field. Such a voltage may be supplied at the same frequency as, and in phase with, the propagating wave, which may beneficially increase the overlap of the applied voltage with the propagating EM field to correspondingly increase the change in electric permittivity or magnetic permeability of the substrate that the EM field propagates through.

Figure 13A:
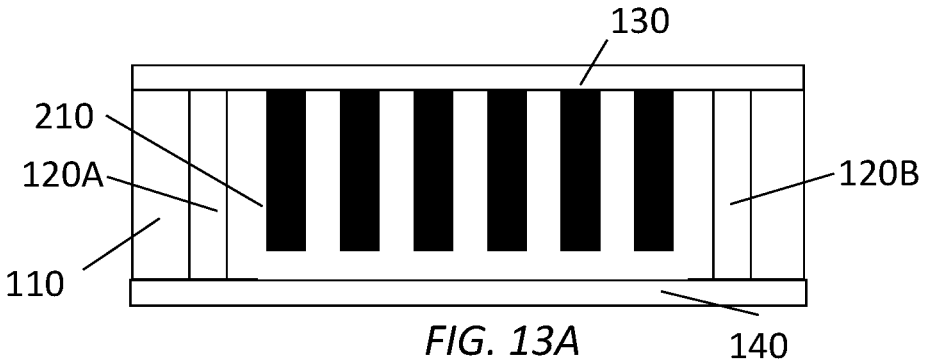
FIG. 13A is an end cross-sectional view through parallel sidewall metal-filled via arrays of a substrate-integrated waveguide with material-filled vias that terminate at the top surface of the substrate but not at the bottom surface.
Figure 13B:
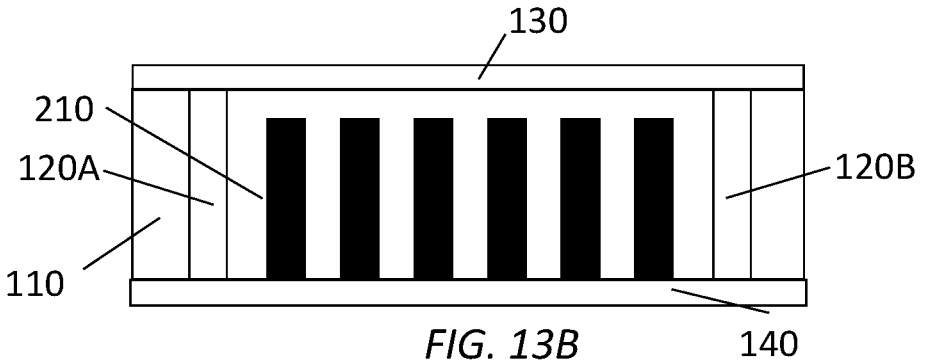
FIG. 13B is an end cross-sectional view through parallel sidewall metal-filled via arrays of a substrate-integrated waveguide with material-filled vias that terminate at the bottom surface of the substrate but not at the top surface.
Figure 13C:
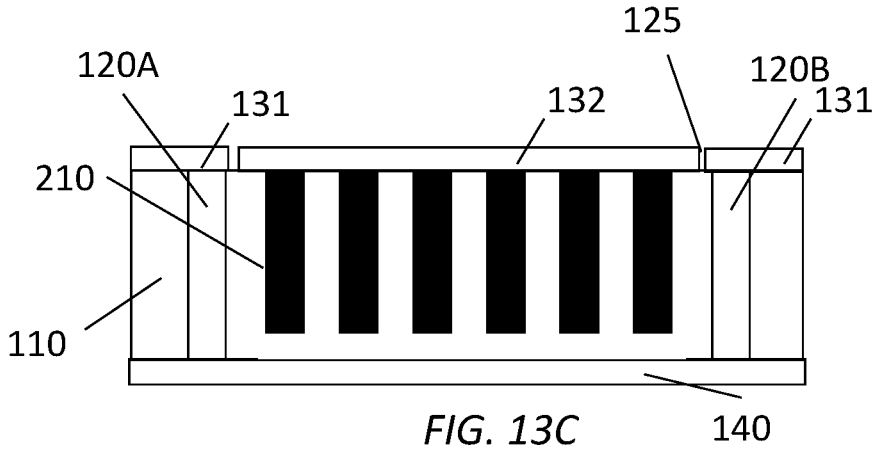
FIG. 13C is an end cross-sectional view through parallel sidewall metal-filled via arrays of a substrate-integrated waveguide with material-filled vias that terminate at the top substrate surface but not at the bottom surface.
Figure 13D:
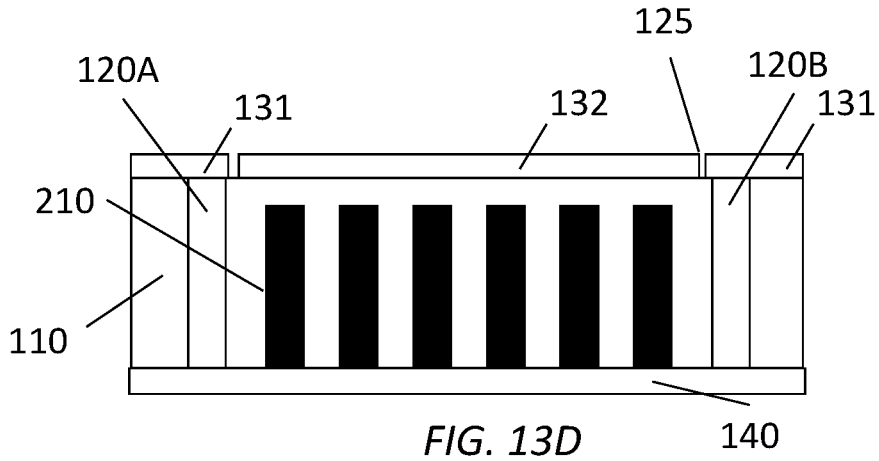
FIG. 13D is an end cross-sectional view through parallel sidewall metal-filled via arrays of a substrate-integrated waveguide with material-filled vias that terminate at the bottom substrate surface but not at the top surface.

As shown in the cross-sectional views of FIG. 8A and FIG. 11A, material-filled vias 210 may extend entirely through dielectric substrate 110. In alternative embodiments, a composite substrate may include blind vias, i.e., that extend only partially through the substrate. That is, example blind material-filled vias may be exposed at one surface of the substrate but may terminate within the substrate. Material-filled vias may terminate at a top surface of a substrate 110, i.e., in contact with a top conductive layer 130, as shown in FIG. 13A. Alternatively, material-filled vias may terminate at a bottom surface of a substrate 110, i.e., in contact with a bottom conductive layer 140, as shown in FIG. 13B. Referring also to FIG. 13C and FIG. 13D, according to further embodiments, a top conductive layer in example blind material-filled via structures may be divided by a gap 125 into an electrode 131 for the metal-filled vias overlying the metal-filled via arrays 120A, 120B, and an electrode 132 for the material-filled vias electrically isolated from the metal-filled via electrode 131 and overlying the material-filled vias 210.

Figure 14A:
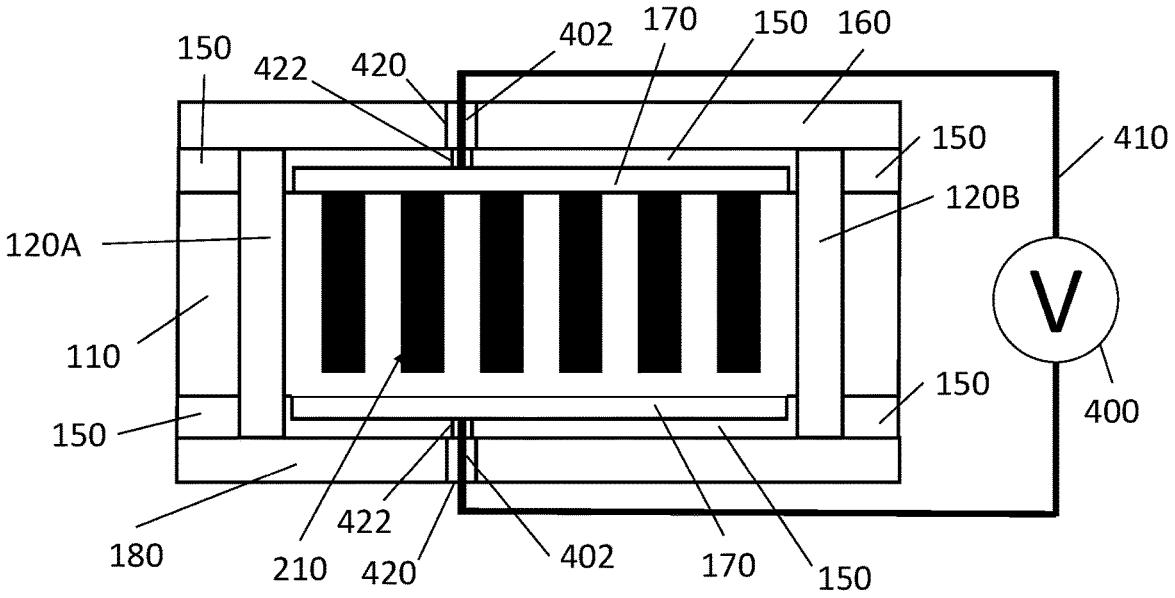
FIG. 14A is an alternative embodiment to FIG. 11A where material-filled vias terminate at the top surface but not at the bottom surface of the substrate.
Figure 14B:
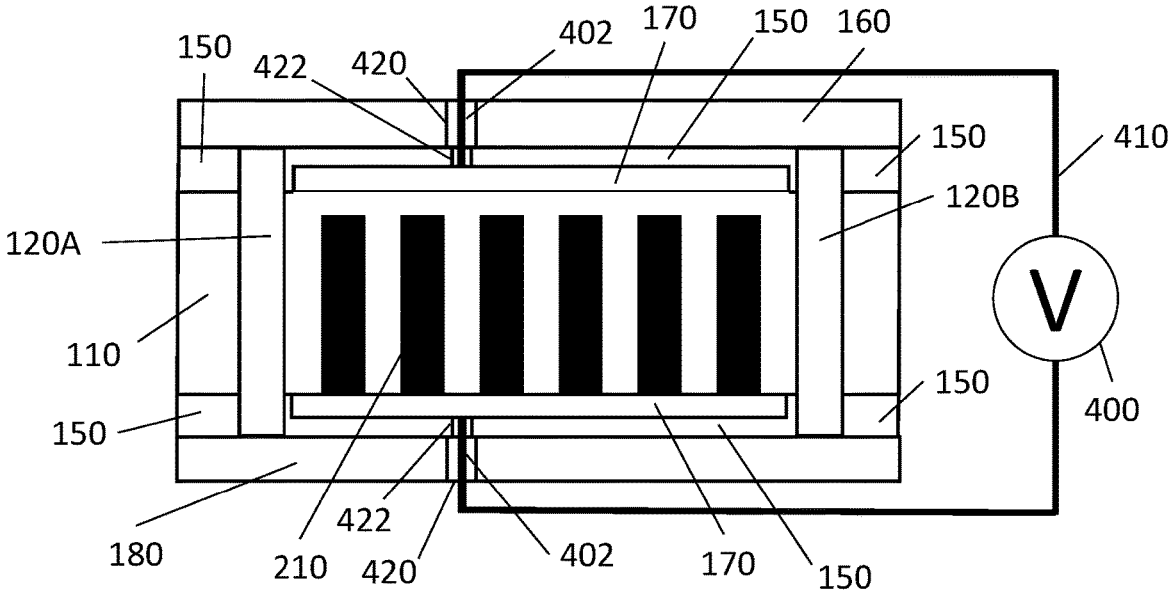
FIG. 14B is an alternative embodiment to FIG. 11A where material-filled vias terminate at the bottom surface but not at the top surface of the substrate.

According to still further embodiments, and with reference to FIG. 14A and FIG. 14B, the blind material-filled via architectures of FIGS. 13A-13D may be integrated with the dielectric layer-containing architectures shown in FIG. 11A and FIG. 11B.

Relative to entirely open (i.e., through) vias, blind material-filled vias may provide a number of advantages, including the creation of a natural well that may confine a low viscosity fill material within the via during manufacture. Furthermore, with blind vias, a continuous substrate may provide a more effective physical and chemical barrier than a perforated substrate. Finally, in examples where the material-filled vias include a liquid crystal, a photoalignment technique for orienting the liquid crystals within the via may include depositing a photoactive alignment layer (i.e., templating layer) into the vias prior to filling the vias with the liquid crystal composition. A photoalignment technique may benefit from the ability to accumulate a thin layer of photoactive alignment material at the bottom of a blind via. Example photoactive alignment materials may include various polyimides.

As disclosed herein, the application of an external voltage to a substrate that includes an array of material-filled vias may modify the electric permittivity of the fill material and consequently change the effective electric permittivity of the substrate. In some embodiments, more than one electrode pair may be used to apply two voltages that create mutually orthogonal applied electric fields. Multiple voltages may be used in concert with material-filled vias that include an anisotropic liquid crystal composition, for example.

Rod-shaped organic LC molecules, for instance, may have a directionally-dependent electric permittivity, e.g., along the long and short axes. An applied electric field can be used to align the organic molecules along the direction of the applied field. By varying the voltage across two sets of electrodes, the electric permittivity of the substrate may additionally be tuned along a direction transverse to the propagation direction of an electromagnetic field.

Figure 15:
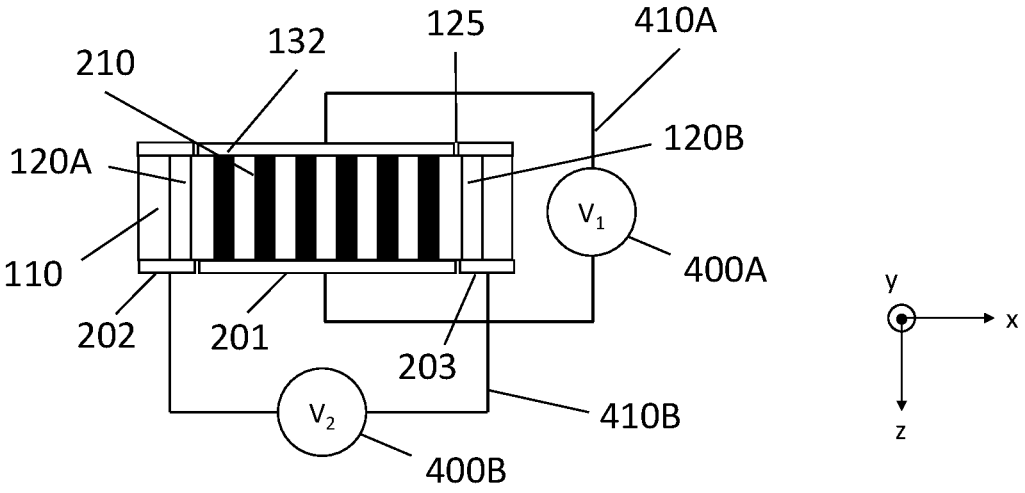
FIG. 15 is an end cross-sectional view through two of the parallel metal sidewall via arrays of a substrate-integrated waveguide including material-filled vias with a first external voltage applied to a conductive region overlying the material-filled vias and a second external voltage applied orthogonal to the first external voltage to a separate conductive region adjacent to the sides of the material-filled vias.

Referring to FIG. 15, shown is an end cross-sectional view of an example composite substrate 110 that includes an array of material-filled vias 210 located between two parallel arrays 120A, 120B of metal sidewall vias. A top conductive layer may be partitioned across a gap 125 to include an electrode 132 overlying material-filled vias 210. In a similar vein, a bottom conductive layer may be partitioned to include an electrode 201 proximate to the material-filled vias 210 and electrodes 202, 203 proximate to a respective one of each metal-filled via array 120A, 120B.

During operation, a first voltage source 400A and corresponding circuit 410A may apply an external voltage and create an applied electric field predominately in the z-direction along the length of the material-filled vias 210. A second voltage source 400B and corresponding circuit 410B may apply an external voltage and create an applied electric field predominately in the x-direction, orthogonal to the applied field created by the first voltage source 400A. According to some embodiments, mutually transverse voltages may be applied simultaneously, alternatively, or in overlapping combinations thereof.

Figure 16:
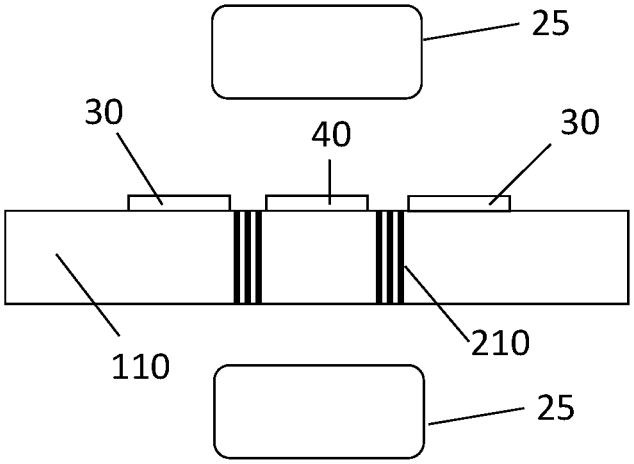
FIG. 16 is an end cross-sectional view of a coplanar waveguide with material-filled vias and an external magnetic field applied above and below the coplanar waveguide.
Figure 17A:
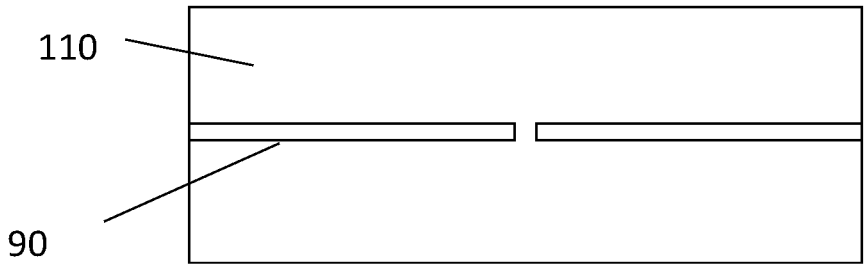
FIG. 17A is a top view of a comparative microstrip resonator.
Figure 17B:
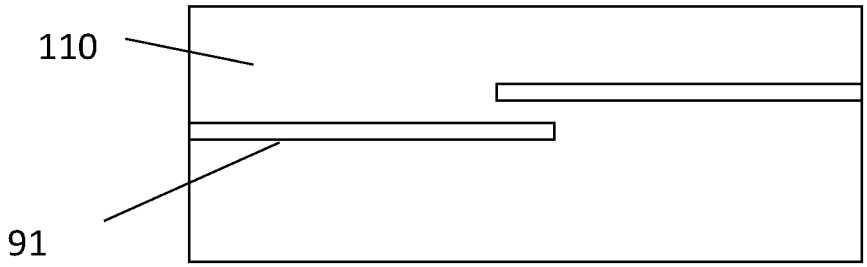
FIG. 17B is a top view of a second comparative microstrip resonator.
Figure 17C:
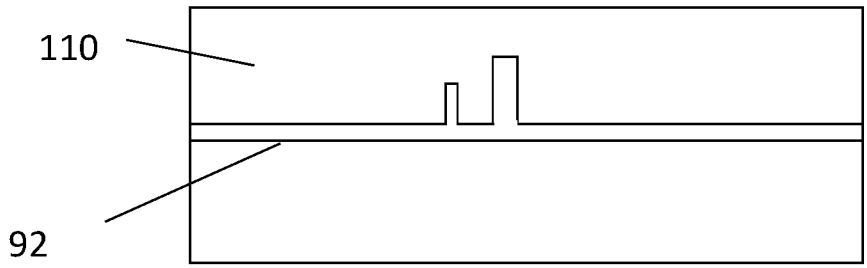
FIG. 17C is a top view of a third comparative microstrip resonator.
Figure 17D:
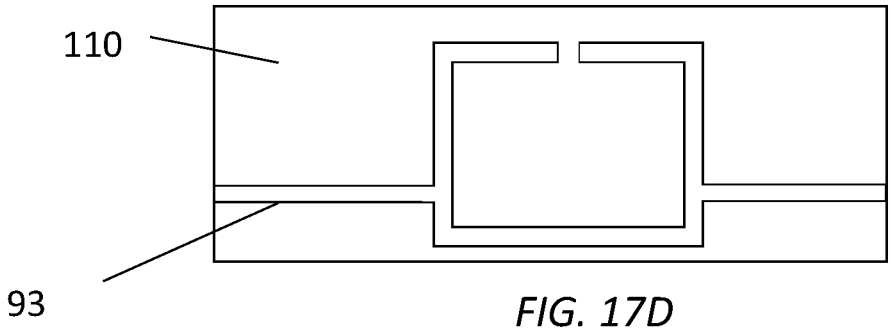
FIG. 17D is a top view of a fourth comparative microstrip resonator.
Figure 18A:
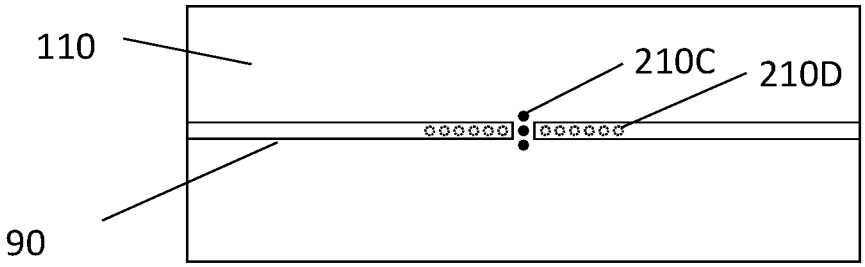
FIG. 18A is a top view of a microstrip resonator including material-filled vias according to an embodiment.
Figure 18B:
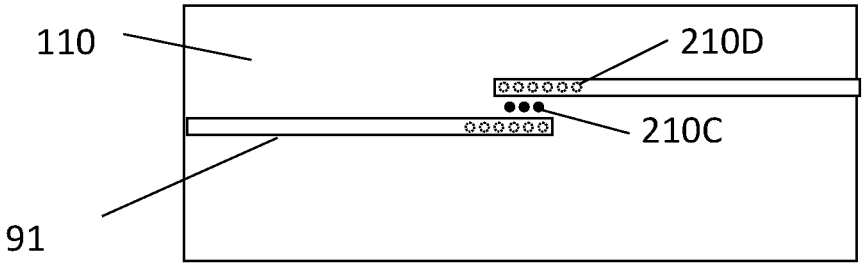
FIG. 18B is a top view of a second microstrip resonator including material-filled vias according to an embodiment.
Figure 18C:
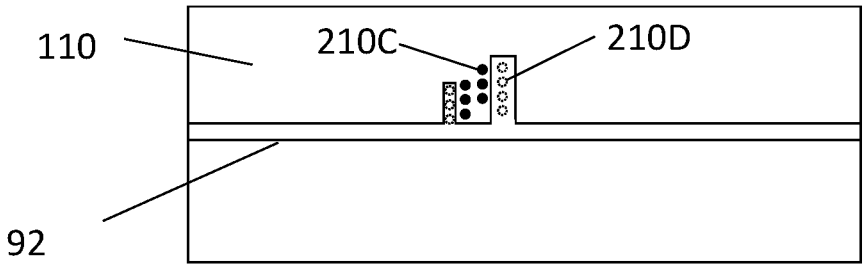
FIG. 18C is a top view of a third microstrip resonator including material-filled vias according to an embodiment.
Figure 18D:
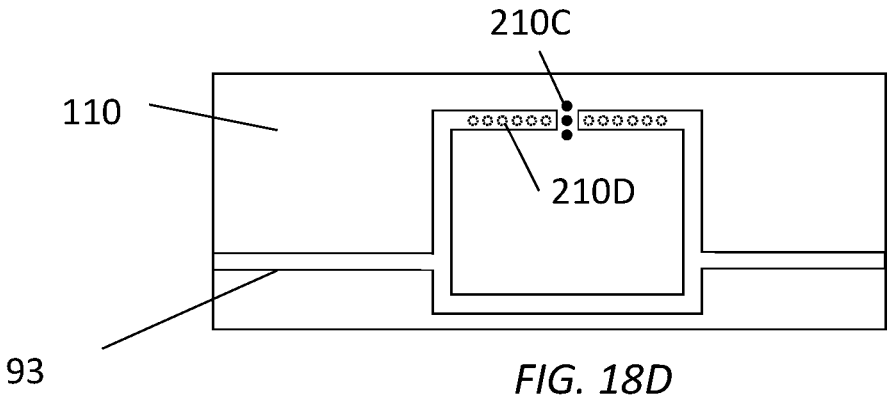
FIG. 18D is a top view of a fourth microstrip resonator including material-filled vias according to an embodiment.

As disclosed herein, the application of an external magnetic field to a substrate that includes an array of material-filled vias may modify the magnetic permeability of the fill material and consequently change the effective magnetic permeability of the substrate. Turning to FIG. 16, illustrated is an end cross-sectional view of a coplanar waveguide with material-filled vias 210 where an external magnetic field may be applied above and below the coplanar waveguide. The material-filled vias 210 may include a ferromagnetic material that responds to the magnetic field induced by magnets 25 (e.g., electromagnets) located above and below the substrate 110. By adjusting the magnitude and sign of a current passing through coils within the magnets 25, the magnetic field can be tuned to control the magnetic permeability experienced by an EM field propagating through the coplanar waveguide.

According to further embodiments, by varying the structure of transmission lines or waveguides, resonators can be formed as building blocks for filters, oscillators, etc. By way of example, FIGS. 17A-17D show top down views of comparative microstrip resonator architectures each having a substrate 110 and one or more electrodes 90, 91, 92, 93 disposed over the substrate 110 and dimensioned to create resonance. Referring to FIGS. 18A-18D, material-filled vias may be incorporated into the resonator structures. For instance, material-filled vias 210C may be located adjacent to a given electrode or between neighboring electrodes, such as within a gap between electrodes. In addition to or in lieu of adjacent material-filled vias 210C, material-filled vias 210D may be located beneath a given electrode.

Figure 19:
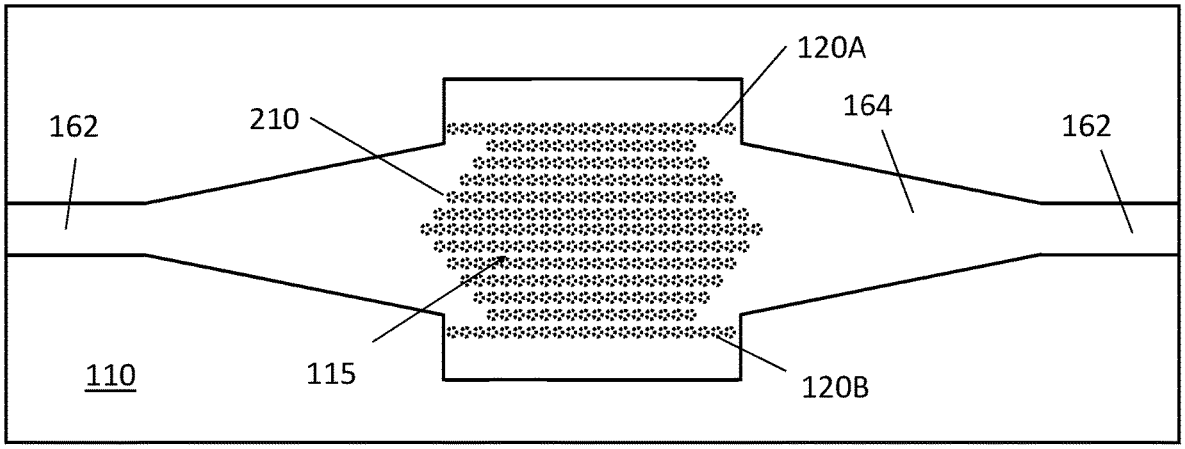
FIG. 19 is a top view of an exemplary microstrip transmission line transitioning into a SIW that has material-filled vias within the propagating region of the waveguide.

Referring to FIG. 19, shown is a top view of a composite substrate that includes a conductive microstrip transmission line 162 that transitions through taper regions 164 into and out of a substrate-integrated waveguide having material-filled vias 210 located within a propagating region 115 between parallel arrays of metal-filled vias 120A, 120B. The taper regions 164 are designed to adiabatically transfer a propagating EM field into a waveguide mode for matching between the mode of the microstrip transmission line 162 and the mode of the SIW.

Figure 20:
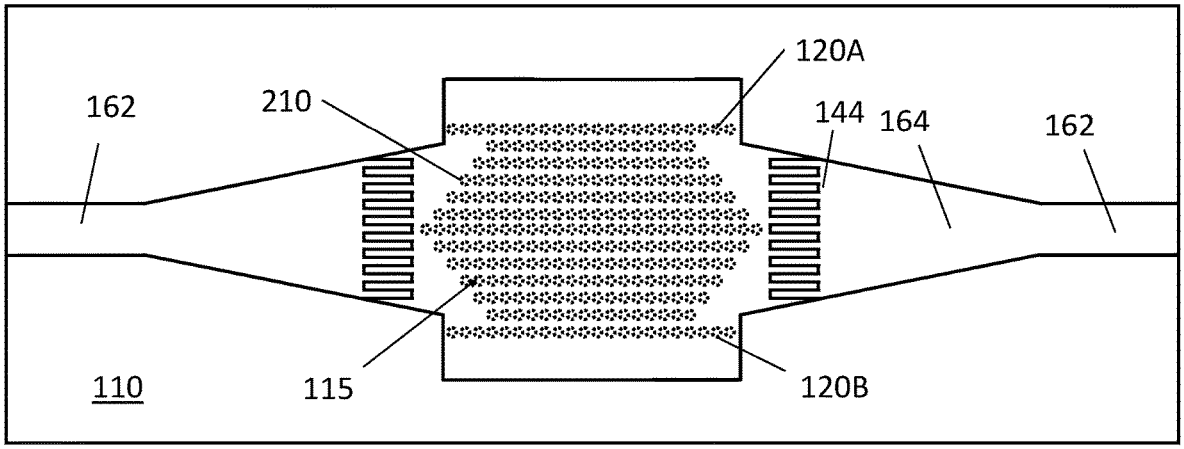
FIG. 20 is a top view of an alternative embodiment to FIG. 19 where a microstrip transmission line transitioning into a SIW includes material-filled vias within the propagating region of the waveguide and the metallized region between the microstrip transmission line input and output is interdigitated.

According to further embodiments, the microstrip transmission line of FIG. 19 may include any suitable additional features as disclosed herein, such as a locally-structured array of material-filled vias (FIGS. 5A-5D and FIGS. 6A-6F), one or more segmented electrodes (FIGS. 8A-8D, FIGS. 9A-9H, FIGS. 10A-10B), dielectric isolation layer(s) (FIGS. 11A-11F, FIGS. 12A-12B), blind vias (FIGS. 13A-13D), as well as combinations thereof (FIGS. 14A-14B). By way of example, FIG. 20 shows the incorporation of an interdigitated electrode pattern 144 into the transition regions 164 of the microstrip transmission line 162 of FIG. 19.

Figure 21:
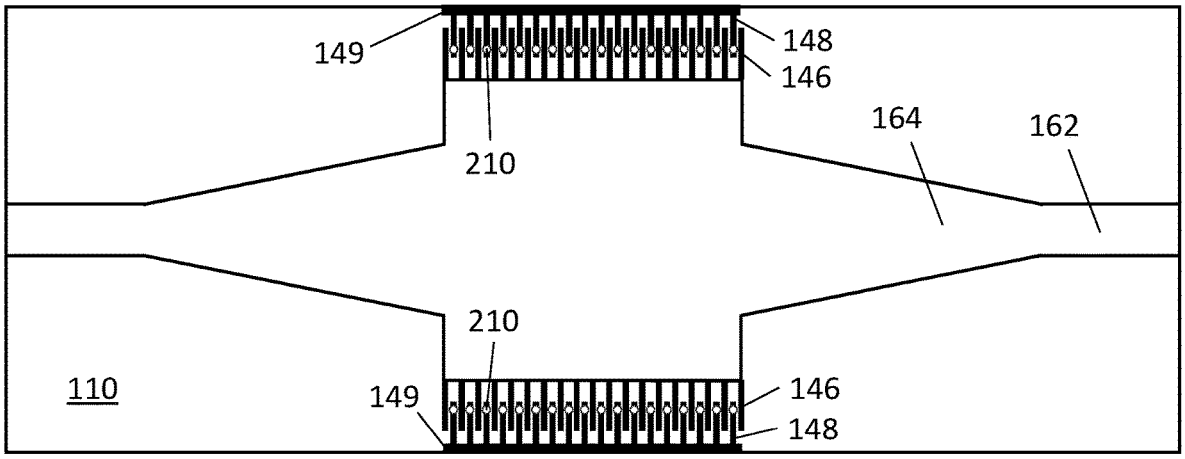
FIG. 21 shows the top view of a structure that includes a transition from a microstrip transmission line to a corrugated substrate-integrated waveguide back to a microstrip transmission line where interleaved in the quarter-wave stubs of the corrugated substrate-integrated waveguide are material-filled vias in the substrate and individual metallized interleaved comb fingers on the top substrate surface to apply an external voltage.

A further example waveguide that includes a dielectric substrate having material-filled vias with a tunable electric permittivity or magnetic permeability is illustrated in FIG. 21. The corrugated substrate-integrated waveguide of FIG. 21 includes quarter-wave open-circuit stubs in lieu of metal-filled sidewall vias to laterally confine a propagating EM field within substrate 110. Substitution of the stubs for the metal-filled vias may decrease manufacturing complexity but may limit operating frequency bandwidth.

The isolation structure of FIG. 21 includes interdigitated electrical lines or fingers 148 between quarter-wave stubs 146 and may include one or more material-filled vias 210 below each electrical line 148. A conductive region or schoopage 149 may electrically connect fingers 148 along each side of the corrugated substrate-integrated waveguide. The conductive region 149 may be configured to distribute voltage to each finger 148.

As disclosed herein, waveguide architectures that include a tunable, composite (material-filled via-containing) substrate may be used, for example, in phase shifters, delay lines, varicaps (voltage-controlled capacitors), resonators, and the like. In accordance with various embodiments, additional functionality may be provided by a microstrip Mach-Zehnder (MZ) modulator, which may provide amplitude modulation to an optical wave. An example Mach-Zehnder modulator integrated with a composite substrate is shown schematically in FIG. 22.

Figure 22:
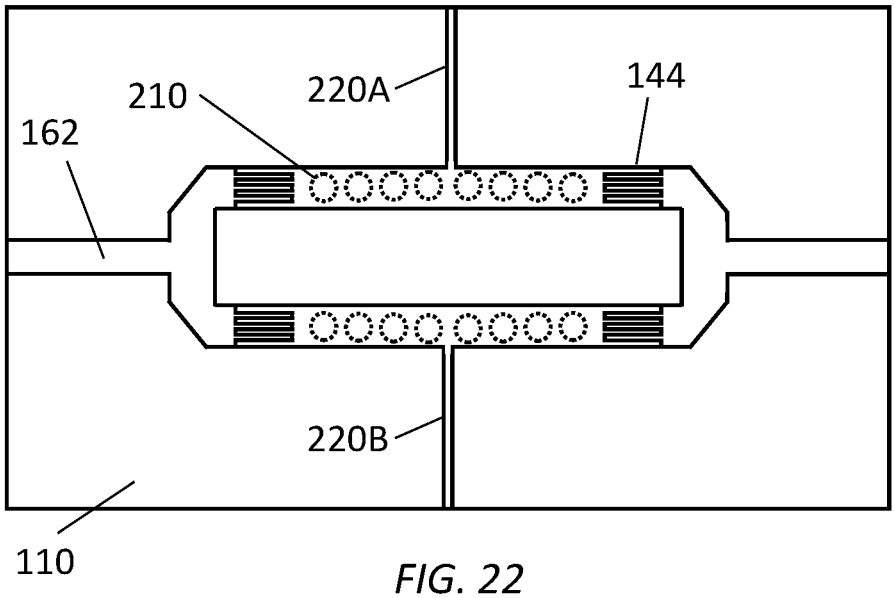
FIG. 22 is a top view of a microstrip transmission line configured as a Mach-Zehnder modulator and including material-filled vias within the propagation paths.

In the illustrated structure of FIG. 22, an EM field from an input microstrip transmission line 162 overlying dielectric substrate 110 may be split into two paths where the electric permittivity of each path may be independently controlled by a voltage applied through a respective electrode 220A, 220B to material-filled vias 210 located within the substrate 110 underlying the paths. When the two paths are recombined, a phase difference between the two waves may be converted to an amplitude modulation. In the example of FIG. 22, the top electrode may include an interdigitated pattern 144 to electrically isolate an applied, control voltage from the propagating EM field.

Figure 23:
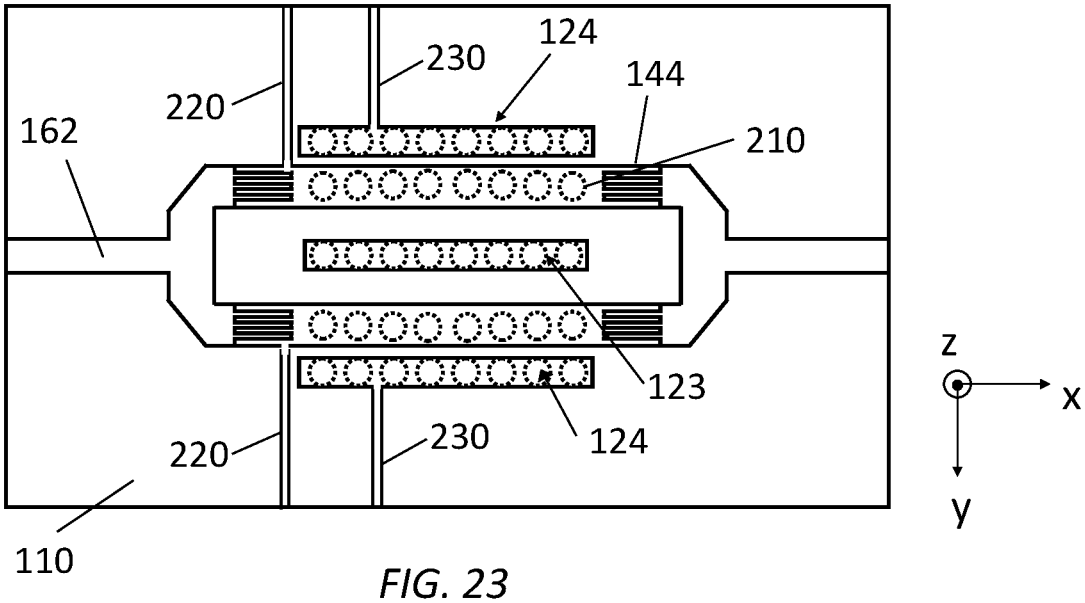
FIG. 23 is a top view of a microstrip transmission line configured as a Mach-Zehnder modulator and including material-filled vias and having a first set of electrodes and a second set of electrodes arranged to apply an electric field through the material-filled vias where the direction of the electric field created by the first set of electrodes is orthogonal to the direction of the electric field created by the second set of electrodes.

An alternative microstrip MZ modulator configuration is shown in FIG. 23 and includes two sets of electrodes for applying controlling electric fields transverse to a propagating EM field as well as orthogonal to each other. In the illustrated embodiment, an EM field may propagate through the modulator along an x-direction. As in the embodiment of FIG. 22, an input microstrip transmission line 162 is split into two paths where the electric permittivity of each path may be independently controlled by a voltage applied through a respective electrode 220 (i.e., between an electrode 220 and a ground electrode, not shown, e.g., along a z-direction) to material-filled vias 210 located within the paths. A central electroded array 123 of metal-filled vias may be located within substrate 110 between the paths, and lateral arrays 124 of metal-filled vias may be located within the substrate in contact with a respective electrode 230 adjacent to each path opposite to the central array 123. An additional voltage may be applied between each lateral array 124 of metal-filled vias and the central array 123 (i.e., along a y-direction).

Figure 24A:
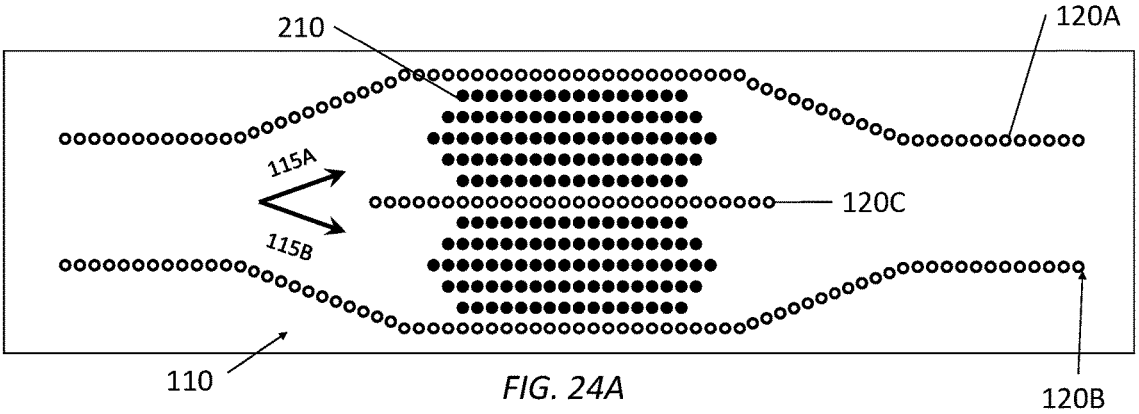
FIG. 24A is a top plan view of a substrate-integrated waveguide Mach-Zehnder modulator just below the top conductive layer with material-filled vias located in neighboring propagating regions.

A further example substrate-integrated waveguide Mach-Zehnder (MZ) modulator is shown in FIGS. 24A-24D. FIG. 24A is a top plan view of a substrate-integrated waveguide MZ modulator just below a top conductive layer. During operation, an EM field from an input is split into two paths (i.e., into propagating regions 115A, 115B) where the electric permittivity of each path may be independently controlled by applying a respective voltage across each array 210 of material-filled vias located within the propagating regions. Metal-filled via arrays 120A, 120B may laterally confine the propagating field within the substrate 110 while an additional metal-filled via array 120C may isolate the EM field traveling through propagating region 115A from the EM field traveling through propagating region 115B.

Figure 24B:
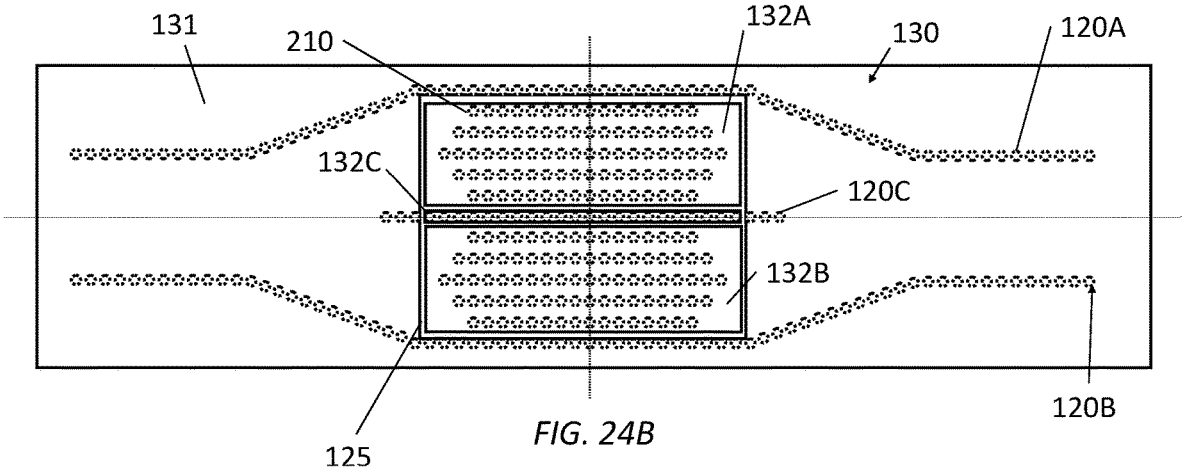
FIG. 24B is a top view of the substrate-integrated waveguide Mach-Zehnder modulator of FIG. 24A with material-filled vias located in the adjacent propagating regions.

FIG. 24B is a top view of the substrate-integrated waveguide MZ modulator of FIG. 24A with material-filled vias 210 located in the adjacent propagating paths. Top conductive layer 130 includes a region 131 overlying the input and output of the SIW as well as the lateral arrays of metal-filled vias 120A, 120B. Conductive regions 132A and 132B of top conductive layer 130 overlie the material-filled vias 210 within each respective propagating region, and conductive region 132C overlies metal-filled via array 120C located between the propagating paths.

Figure 24C:
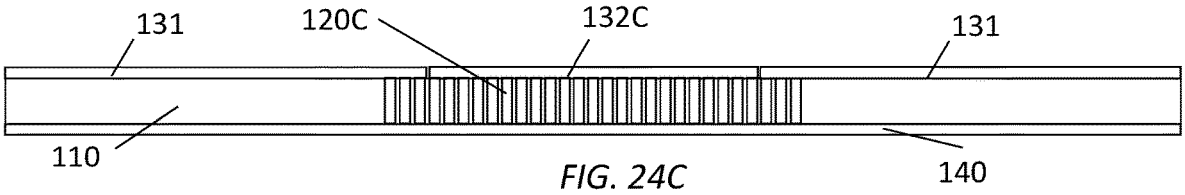
FIG. 24C is a side cross-sectional view of the substrate-integrated waveguide Mach-Zehnder modulator of FIG. 24A along the mid-line of the propagating region.
Figure 24D:
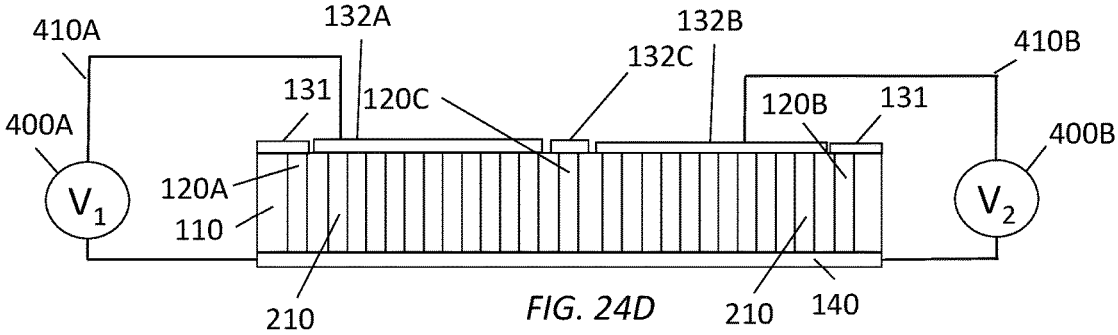
FIG. 24D is an end cross-sectional view of the substrate-integrated waveguide Mach-Zehnder modulator of FIG. 24A along the mid-plane.
Figure 25A:
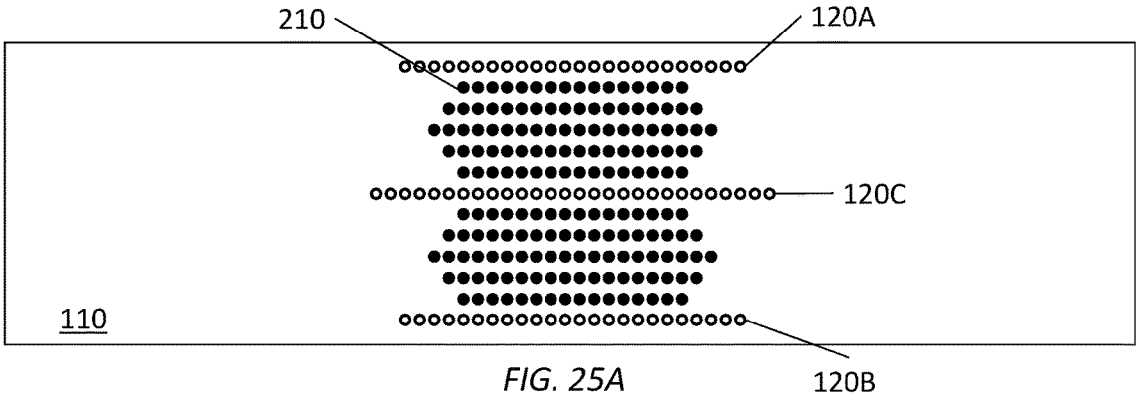
FIG. 25A is a top plan view of a Mach-Zehnder modulator just below the top conductive layer with material-filled vias in the neighboring propagating regions where the input and output include microstrip transmission lines and the central propagating paths include substrate-integrated waveguides.
Figure 25B:
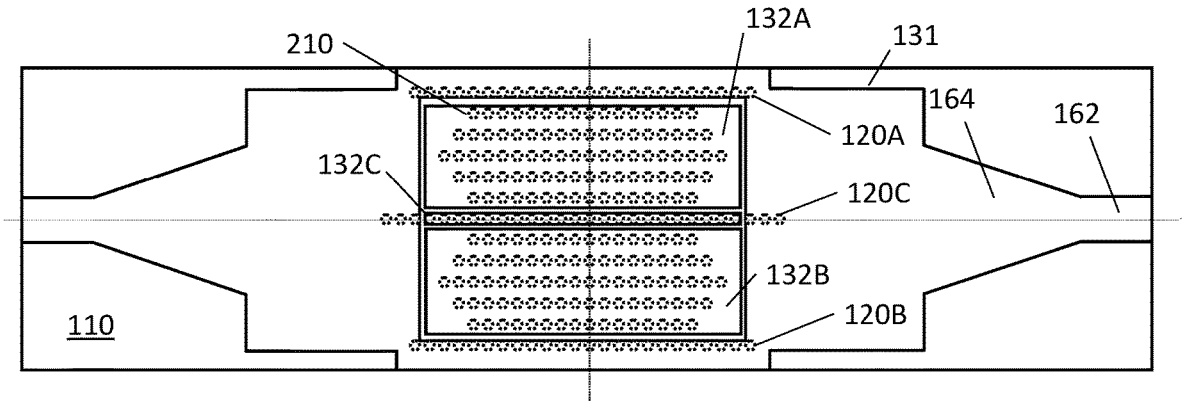
FIG. 25B is a top view of the microstrip Mach-Zehnder modulator of FIG. 25A showing material-filled vias in the adjacent propagating regions.
Figure 25C:
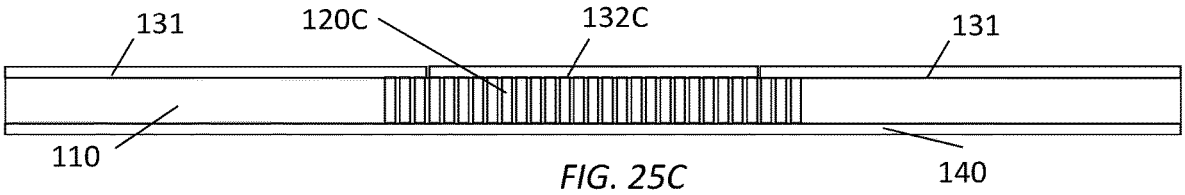
FIG. 25C is a side cross-sectional view of the microstrip Mach-Zehnder modulator of FIG. 25A along the mid-line of the propagating direction.
Figure 25D:
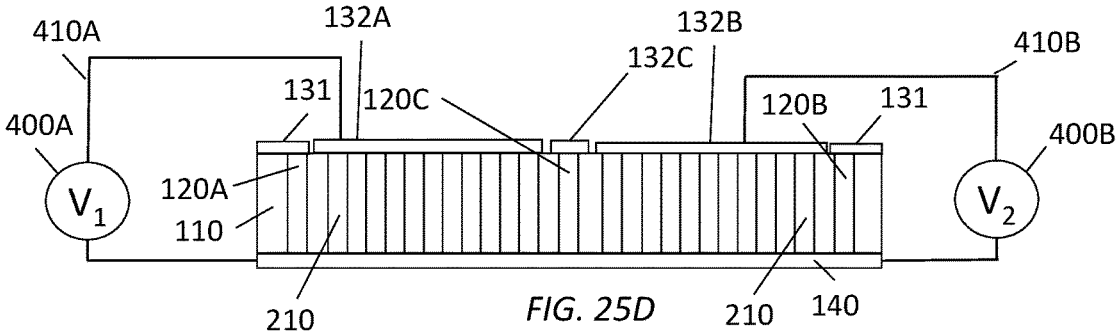
FIG. 25D is an end cross-sectional view of the microstrip Mach-Zehnder modulator of FIG. 25A along the mid-plane.

FIG. 24C is a side cross-sectional view of the substrate-integrated waveguide Mach-Zehnder modulator of FIG. 24A along the mid-section of the propagating direction. Shown in FIG. 24C is bottom conductive layer 140 underlying substrate 110. Referring to FIG. 24D, shown is an end cross-sectional view of the substrate-integrated waveguide Mach-Zehnder modulator of FIG. 24A along the mid-plane.

By applying a different voltage to conductive regions 132A, 132B through external electric circuits 410A, 410B using respective voltage sources 400A, 400B, the electric permittivity in each path of the modulator may be independently tuned. The applied voltages may be either DC or AC. For AC, the periodic applied voltage may be sinusoidal, square-wave, triangular or sawtooth over a variety of time scales from seconds to minutes for slowly varying signal control up to GHz for a modulator that encodes information on the propagating signal.

For single-ended electrical drive, a tuning voltage may be applied to only one conductive region 132A or 132B where the other conductive region may be grounded. Alternatively, the other conductive region may be omitted. In differential electrical drive, out of phase voltages having the same magnitude may be applied to conductive regions 132A, 132B.

A still further example Mach-Zehnder modulator configuration is illustrated in FIGS. 25A-25D. In the embodiment of FIGS. 25A-25D, the input and output regions of the SIW may include a conductive microstrip transmission line 162 and optional taper regions 164. As with the embodiment of FIGS. 24A-24D, the tuning voltage may be single-ended or differential and may have a wide range of periodicity and shapes, including sinusoidal, square-wave, triangular, sawtooth, and the like.

Figure 26A:
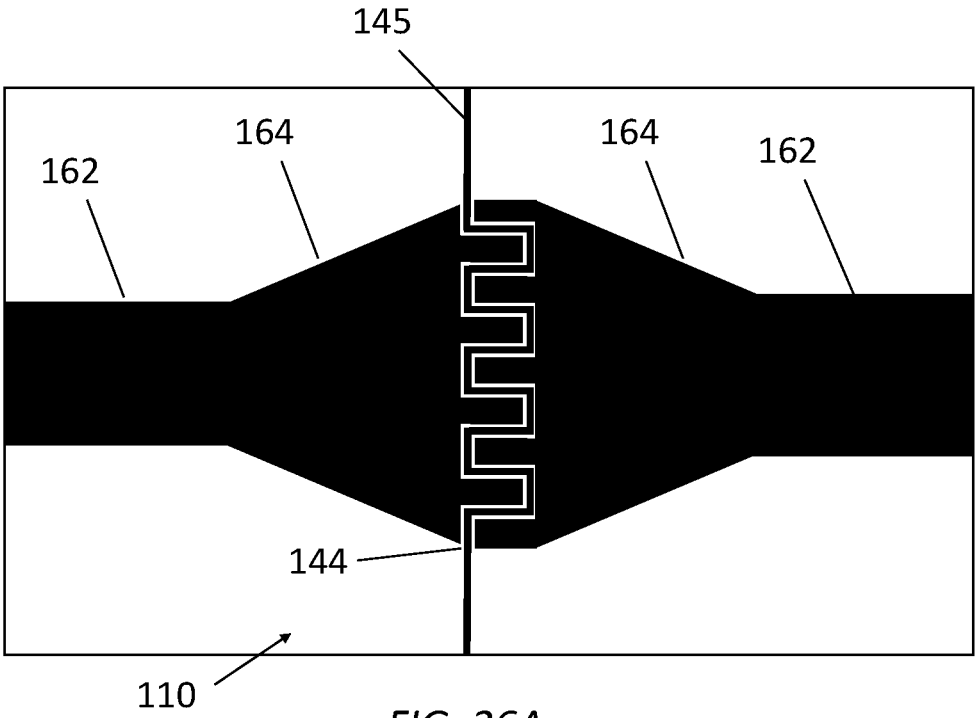
FIG. 26A is a top view of a microstrip transmission line including a transition to a region containing a conductive strip line and material-filled vias having a zig-zag arrangement.
Figure 26B:
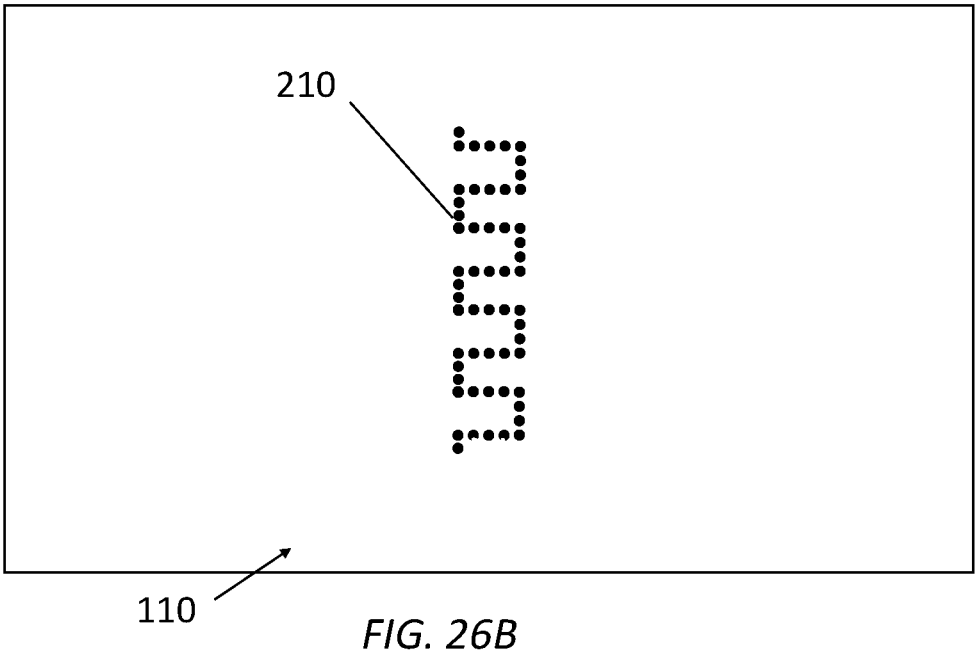
FIG. 26B is a top plan view of the microstrip transmission line of FIG. 26A just below the top conductive layers showing the material-filled vias in a zig-zag arrangement.

According to further embodiments, and with reference to FIG. 26A, shown is a composite substrate 110 that includes a microstrip transmission line 162 having optional taper regions 164 that transition to an isolated interdigitated pattern 144. A zig-zag conductive line 145 traverses the microstrip transmission line 162 and, as illustrated in FIG. 26B, overlies a corresponding zig-zag array of material-filled vias 210. The interdigitated portions of the microstrip transmission line 162 proximate to conductive line 145 may collectively act as a capacitor. An external voltage may be applied to conductive line 145 to control the electric permittivity of the material-filled vias 210 within the substrate 110.

In some embodiments, the composite substrates disclosed herein may be incorporated into antennae having a controllable frequency response, such as in connection with RF or microwave applications. Additionally, phased array antennae can be steered if the relative EM phase of individual antenna can be tuned with respect to each other.

Figure 27:
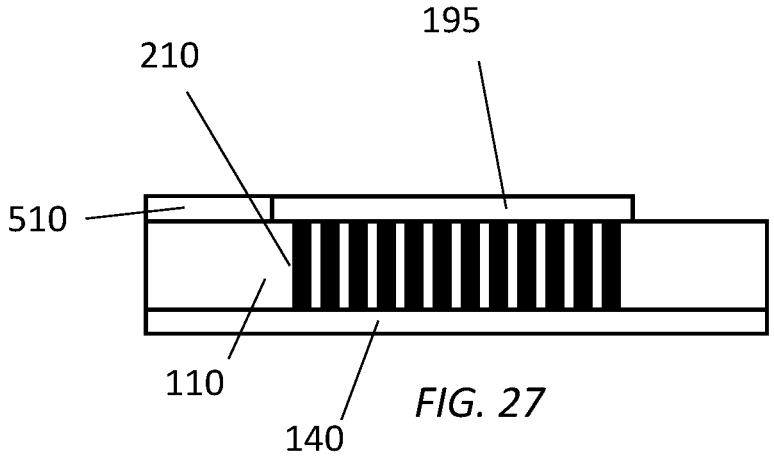
FIG. 27 is a side cross-sectional view of a patch antenna with material-filled vias located below the top antenna patch according to an embodiment.
Figure 28A:
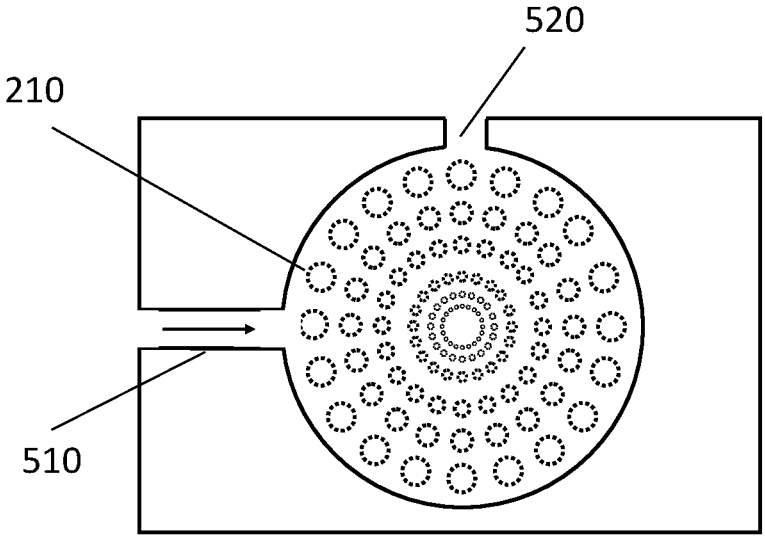
FIG. 28A is a top view of the patch antenna of FIG. 27 showing one arrangement of the material-filled vias below the top antenna patch according to an embodiment.
Figure 28B:
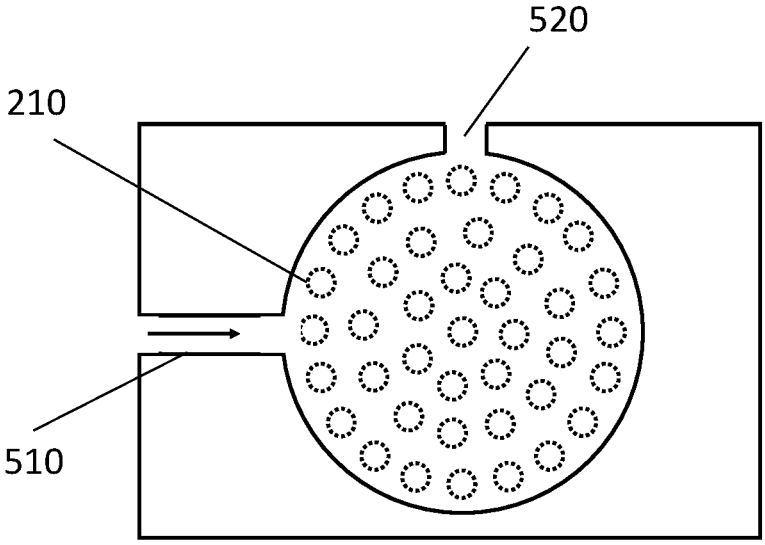
FIG. 28B is a top view of the patch antenna of FIG. 27 showing a second arrangement of the material-filled vias below the top antenna patch according to an embodiment.

A cross-sectional view of a patch antenna is shown in FIG. 27. Substrate 110 includes a ground electrode 140 disposed over a lower surface and an antenna (patch electrode) 195 disposed over the upper surface. Below the patch electrode 195, an array of material-filled vias 210 extends through the substrate 110. An input 510 is laterally offset from the patch electrode 195. Top views of the patch antenna of FIG. 27 according to different embodiments are shown in FIG. 28A and FIG. 28B. In FIG. 28A, a diameter of the material-filled vias changes along a radial direction, whereas in FIG. 28B, the material-filled via diameter is constant, although further configurations of the via diameter, placement, etc. are contemplated. A tuning voltage may be applied to the array of material-filled vias 210 through transmission line 520.

In some aspects, a substrate-integrated waveguide cavity may be located adjacent to an antenna, which may increase the antenna's response bandwidth. A benefit of a SIW-backed patch antenna may derive from a suppression of surface waves, resulting in effective isolation from surrounding elements. An embodiment that incorporates phase or frequency tunability to a SIW-backed patch antenna is shown in FIGS. 29A-29D.

Figures 29A, 29B, 29C, 29D:
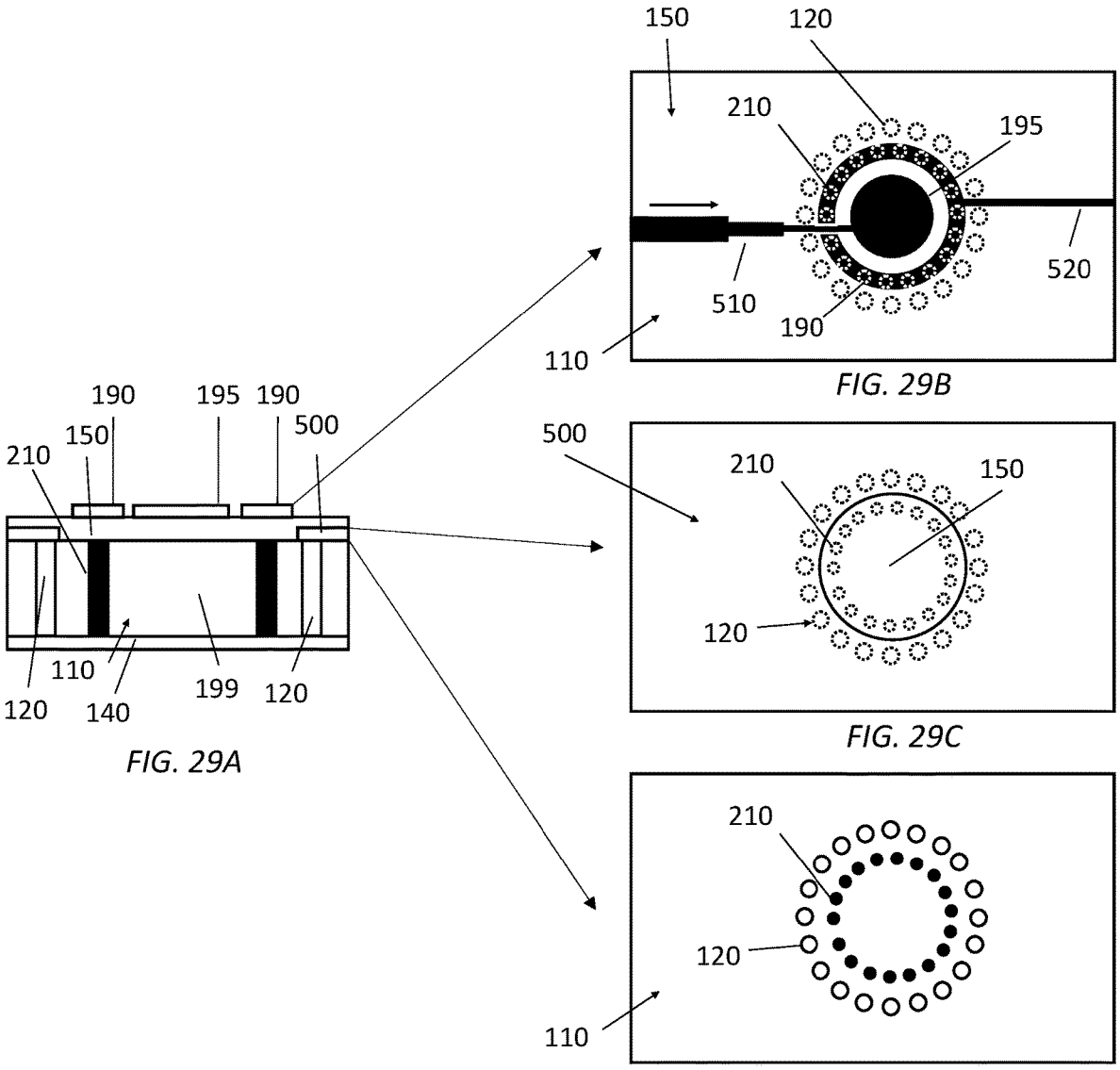
FIG. 29A is a side cross-sectional view through the midpoint of a SIW-backed patch antenna.
FIG. 29B is a top view of the SIW-backed patch antenna of FIG. 29A.
FIG. 29C is a top plan view of the SIW-backed patch antenna of FIG. 29A along the cross-section indicated by the arrow extending from FIG. 29A at the top of the SIW cavity.
FIG. 29D is a top plan view of the SIW-backed patch antenna of FIG. 29A along the cross-section indicated by the arrow extending from FIG. 29A at the substrate surface.

A cross-sectional view through the midline of a circular SIW-backed patch antenna is shown in FIG. 29A. The structure includes a dielectric substrate 110 having a bottom conductive layer (ground plane) 140 that is configured to reflect antenna radiation upward. Concentric arrays of metal-filled vias 120 and material-filled vias 210 are disposed within the substrate 110 where, in the present embodiment, the metal-filled via array 120 is located peripheral to the array 210 of material-filled vias. Both the metal-filled vias and the material-filled vias may extend entirely through substrate 110. A dielectric layer 150 overlies a top surface of substrate 110 and may electrically isolate the metal-filled vias from the material-filled vias.

Conductive layer 500 overlies the substrate 110 and may be in electrical contact with metal-filled vias 120. Circular tuning electrode 190 and the antenna (patch) electrode 195 are located over the dielectric layer 150 and respectively overlie the material-filled vias 210 and an SIW cavity 199, which is bounded by the conductive layer 140, metal-filled vias 120, and conductive layer 500. Dielectric layer 150 electrically isolates conductive layer 500 from the tuning electrode 190 and the patch electrode 195.

The electric permittivity of material-filled vias 210 may be modified by applying an external voltage between tuning electrode 190 and the ground conductive layer 140. The applied, external voltage may be transmitted from a microstrip transmission line 520 to the tuning electrode 190, which overlies and may be in electrical contact with each of the material-filled vias 210.

The external applied voltage (tuning voltage) may change the electric permittivity of the cavity 199 to tune the central frequency or phase of the radiated EM radiation. An EM field signal may be transmitted from a microstrip transmission line 510 to patch electrode 195 through a gap in the tuning electrode 190 overlying the material-filled vias. During operation of the SIW-backed patch antenna, an EM signal field may be coupled to the antenna (patch) electrode 195.

Top down views of the SIW-backed patch antenna of FIG. 29A are shown in FIGS. 29B-29D along cross-sections indicated by each respective arrow extending from FIG. 29A. Patch electrode 195 is shown as a circle in FIG. 29B but could be other shapes to enhance the far-field radiation pattern or frequency bandwidth of the SIW-backed patch antenna.

According to further embodiments, a material-filled via integrated dielectric substrate may be implemented to create materials having a desirable suite of properties. Such materials may be characterized as metamaterials. Metamaterials may include 2-D or 3-D assemblies that exhibit properties not found in naturally occurring materials. For instance, metamaterial surfaces may uniquely manipulate reflected or transmitted EM fields. In certain resonator architectures, for instance, the 2-D or 3-D electric permittivity and/or magnetic permeability may be less than unity, e.g., less than zero. So-called negative index metamaterials (or double negative metamaterials) may be formed where electric permittivity resonances and magnetic permeability resonances may create both a negative electric permittivity and a negative magnetic permeability over the same frequency range.

Figure 30A:
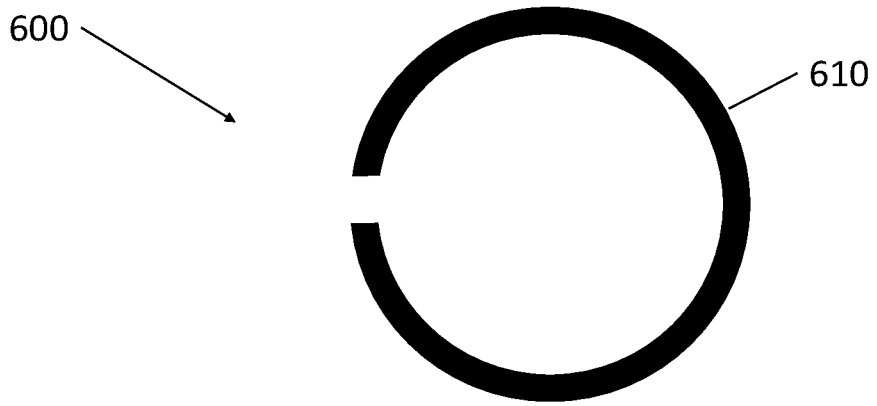
FIG. 30A is a top view of a comparative single split ring resonator used to alter the free space magnetic permeability.
Figure 30B:
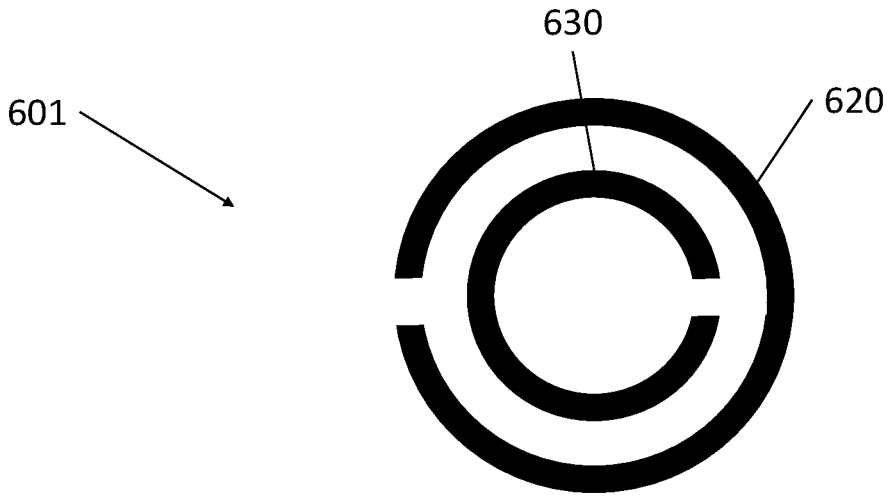
FIG. 30B is a top view of two nested split ring resonators used to alter the free space magnetic permeability.

Referring to FIG. 30A, shown is a top view of a comparative single split ring resonator (SRR). Split ring resonator 600 may include a single electrically conductive ring 610. FIG. 30B is a top view of a further comparative resonator 601 that includes a nested pair of split rings 620 and 630. In a nested configuration, the rings 620, 630 may be arranged such that the respective ring gaps are oriented at 180° relative to each other.

Rings 610-630 may include any suitable conductive material, such as copper, and may be formed using conventional photolithographic fabrication techniques although additional fabrication routes are contemplated. Rings 610-630 may be disposed over a dielectric substrate (not shown). As will be appreciated, exposure of a ring to a time-varying electric field may induce movement of electric charge around the ring and the generation of a magnetic field. In some aspects, a split ring may perform as a resonator having an equivalent series RLC circuit for the ring resistance (R), inductance (L), and capacitance (C).

As a 2-D array, for instance, a surface of a split ring resonator may act as a metamaterial. The dimension(s) of such an SSR, including the radius, the spacing between nested rings, and the pitch within the array, may be less than an operating wavelength. According to some embodiments, a split ring resonator may exhibit unique properties, such as a magnetic permeability less than unity, which may lead to a negative refractive index, a left-handed index, or other beneficial effects.

According to various embodiments, one or more split ring resonators (e.g., an array of split rings) may be formed over a dielectric substrate where at least one material-filled via is incorporated into the substrate. Material-filled vias may be located beneath a split ring, within the gap of a split ring, and/or between adjacent split rings, including within the space between nested split rings. In such embodiments, the frequency response of a single SRR or an array of SRRs having a metamaterial surface may be tuned by the application of an external voltage to the material-filled via(s). Electrical tuning of the resonance frequency and bandwidth may be achieved by applying a voltage to one or more electrodes located proximate to the material-filled via(s). A change in the electric permittivity of the material-filled via may induce a change in the capacitance of an individual ring, the coupling between nested rings, and/or the coupling between SRRs in an array.

Figure 31A:
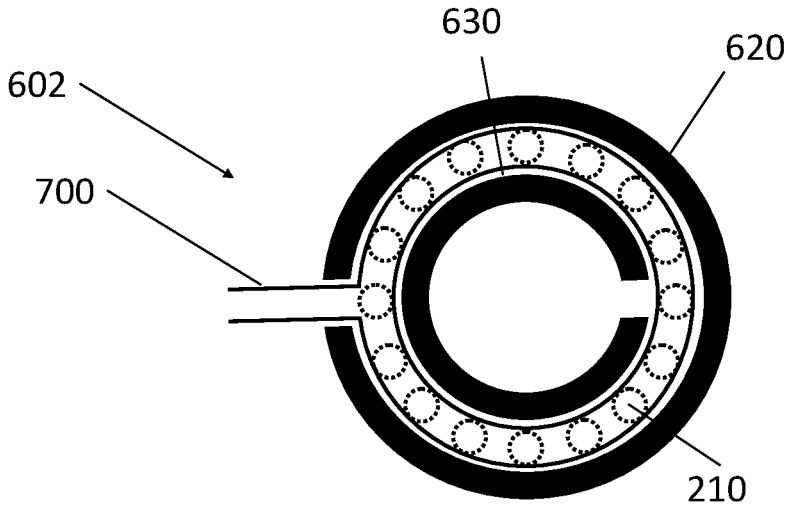
FIG. 31A is a top view of two nested split ring resonators configured to electrically tune the electric permittivity and magnetic permeability where material-filled vias are located within the space between the inner and outer split rings.

According to some embodiments, material-filled vias may be disposed between inner and outer rings of a nested split ring resonator. Referring to FIG. 31A, for example, a modified SSR 602 may include an outer split ring 620, an inner split ring 630, and a circular array of material-filled vias 210 located within the space between the rings. Referring also to the cross-sectional views of FIG. 31B and FIG. 31C, in certain embodiments, the material-filled vias may terminate at one or both major surfaces of dielectric substrate 110.

A voltage may be applied to the material-filled vias 210 through an overlying conductive layer 700. A voltage source 400 connected to an external circuit 410 may be used to apply a tuning voltage between the conductive layer 700 and a bottom electrode 710. The application of a voltage may be used to change the electric permittivity of the fill material within the material-filled vias and hence tune an effective electric permittivity of the dielectric substrate 110, which may accordingly change the coupling between the two nested ring resonators and impact the frequency response of an incident EM field.

Figure 31B:
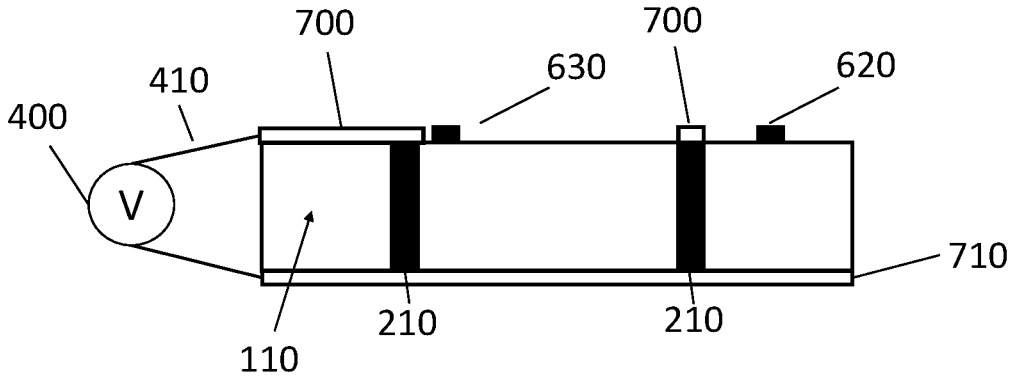
FIG. 31B is one embodiment of a side cross sectional view of the electrically-tunable split ring resonator of FIG. 31A illustrated along the horizontal mid-point.
Figure 31C:
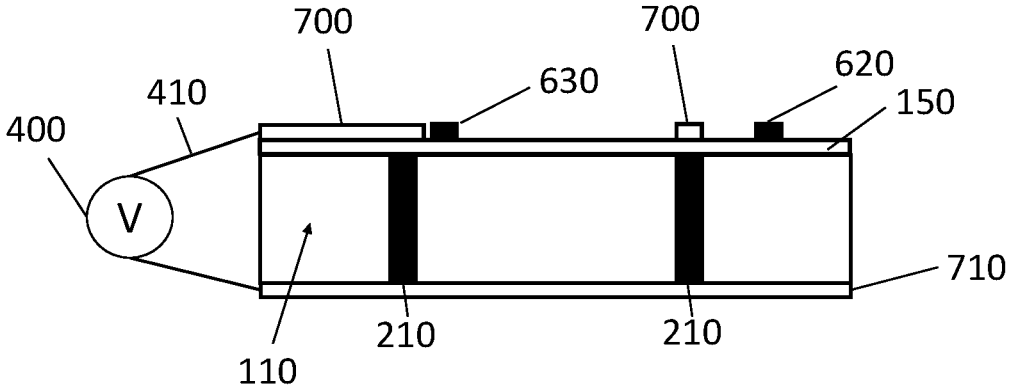
FIG. 31C is another embodiment of a side cross sectional view of the electrically-tunable split ring resonator of FIG. 31A illustrated along the horizontal mid-point with an additional dielectric layer overlying the substrate.

Conductive layer 700 may include a conductive metal such as copper or a conductive oxide such as indium tin oxide (ITO). As illustrated in FIG. 31B, conductive layer 700 may be disposed directly over substrate 110 or alternatively, as illustrated in FIG. 31C, a dielectric layer 150 may be disposed between conductive layer 700 and substrate 110. Dielectric layer 150 may be formed using any suitable thin film deposition process such as chemical vapor deposition, sputtering, evaporative coating, spin coating, and the like, and may include, for example, silicon dioxide.

According to some embodiments, material-filled vias may be disposed within the gap of a split ring. Top down views of exemplary split ring resonator structures are shown in FIG. 32A, which depicts a single ring resonator, and FIG. 32B, which depicts a resonator having nested rings.

Figure 32A:
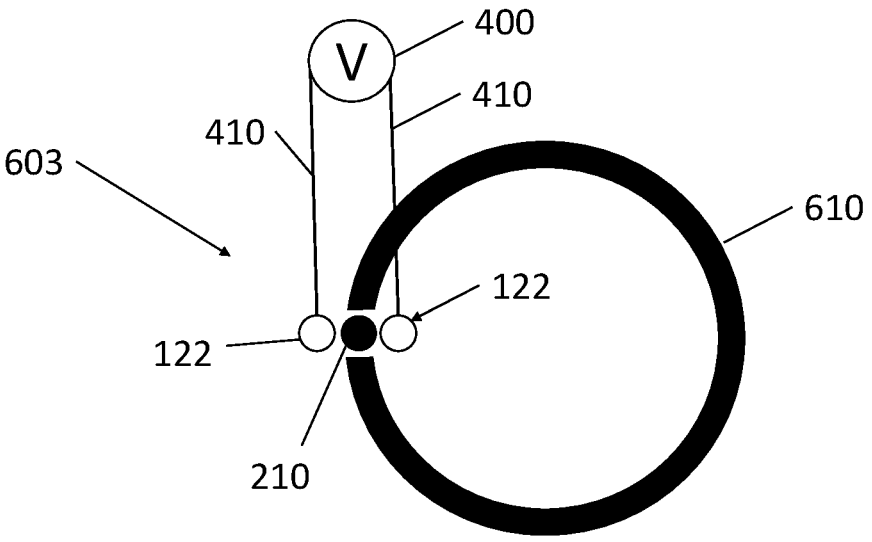
FIG. 32A is a top view of a single split ring resonator configured to electrically tune the electric permittivity and magnetic permeability where one or more material-filled vias are located within a gap in the split ring resonator conductor.

Referring to FIG. 32A, split ring resonator 603 includes a ring 610 disposed over a substrate (not shown) and further includes a material-filled via 210 located within the gap of the ring 610. A top electrode (not shown) for applying a tuning voltage orthogonal to a major surface of the substrate may be disposed over the material-filled via 210. Adjacent to the material-filled via 210, a pair of metal-filled vias are arranged orthogonal to the circumference of the split ring. Each metal-filled via may have an overlying electrical contact 122. An external voltage may be applied through the metal-filled vias, which may induce an applied field across the material-filled via 210 within the plane of the substrate. A voltage source 400 may apply the external voltage to the metal-filled vias through circuit 410. The applied tuning voltages may change the electric permittivity of the fill material within the material-filled via, which may change the capacitance across the split ring gap and the frequency response of an incident EM field.

Figure 32B:
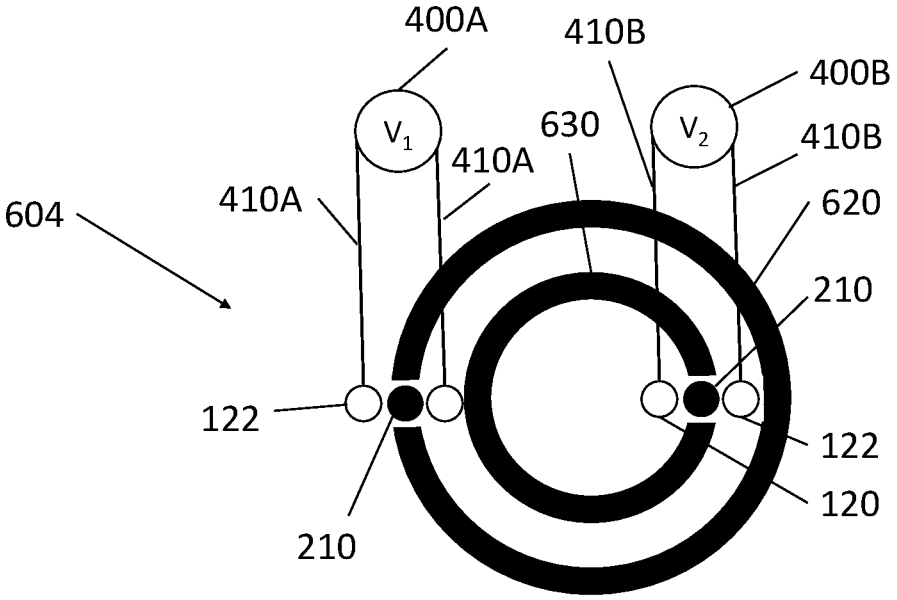
FIG. 32B is a top view of two nested or concentric split ring resonators configured to electrically tune the electric permittivity and magnetic permeability where one or more material-filled vias are located within the gap in the conductor of both the inner and outer split ring resonators.

Referring to FIG. 32B, split ring resonator 604 includes a pair of nested split rings 620, 630 disposed over a substrate (not shown) and further includes a material-filled via 210 located within the gap of each ring. A top electrode (not shown) for applying a tuning voltage orthogonal to a major surface of the substrate may be disposed over the material-filled vias 210. Adjacent to each material-filled via 210, a pair of metal-filled vias are arranged orthogonal to the circumference of each split ring. Each metal-filled via may have an overlying electrical contact 122. An external voltage may be applied through the metal-filled vias, which may induce an applied field across the respective material-filled vias 210 within the plane of the substrate. A pair of voltage sources 400A, 400B may apply the external voltage to the metal-filled vias through corresponding circuits 410A, 410B. The applied tuning voltages may change the electric permittivity of the fill material within the material-filled vias, which may change the capacitance across the split ring gaps and the frequency response of an incident EM field.

Figure 32C:
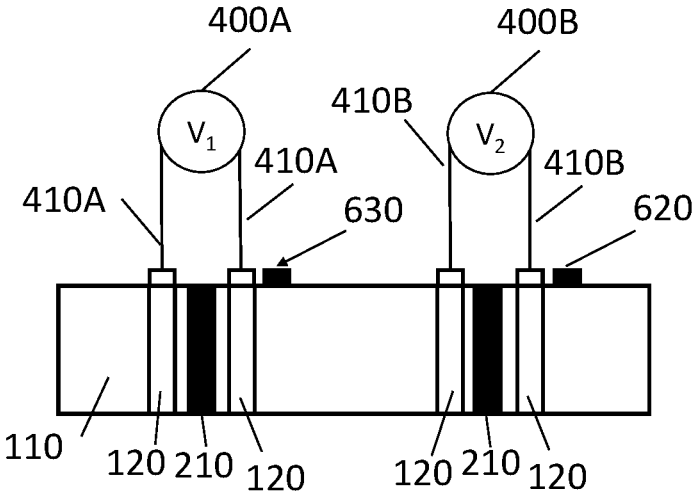
FIG. 32C is a side cross sectional view through the horizontal mid-point of the two nested split ring resonator of FIG. 32B where one or more material-filled vias are located within the gap in the conductor of both the inner and outer split ring resonators.
Figure 32D:
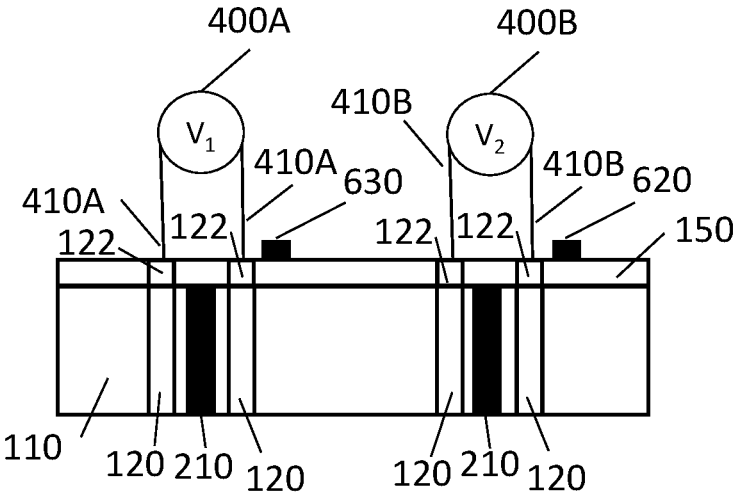
FIG. 32D is a side cross sectional view through the horizontal mid-point of the two nested split ring resonator embodiment of FIG. 32B where one or more material-filled vias are located within the gap in the conductor of both the inner and outer split ring resonators and an additional dielectric layer is disposed between the substrate and the split ring resonators.

Side cross sectional views through the horizontal midpoint of the two nested split ring resonator embodiment of FIG. 32B are shown in FIG. 32C and FIG. 32D. In the embodiment illustrated in FIG. 32D, an additional dielectric layer 150 is disposed between the substrate and the split ring resonators.

Figure 33:
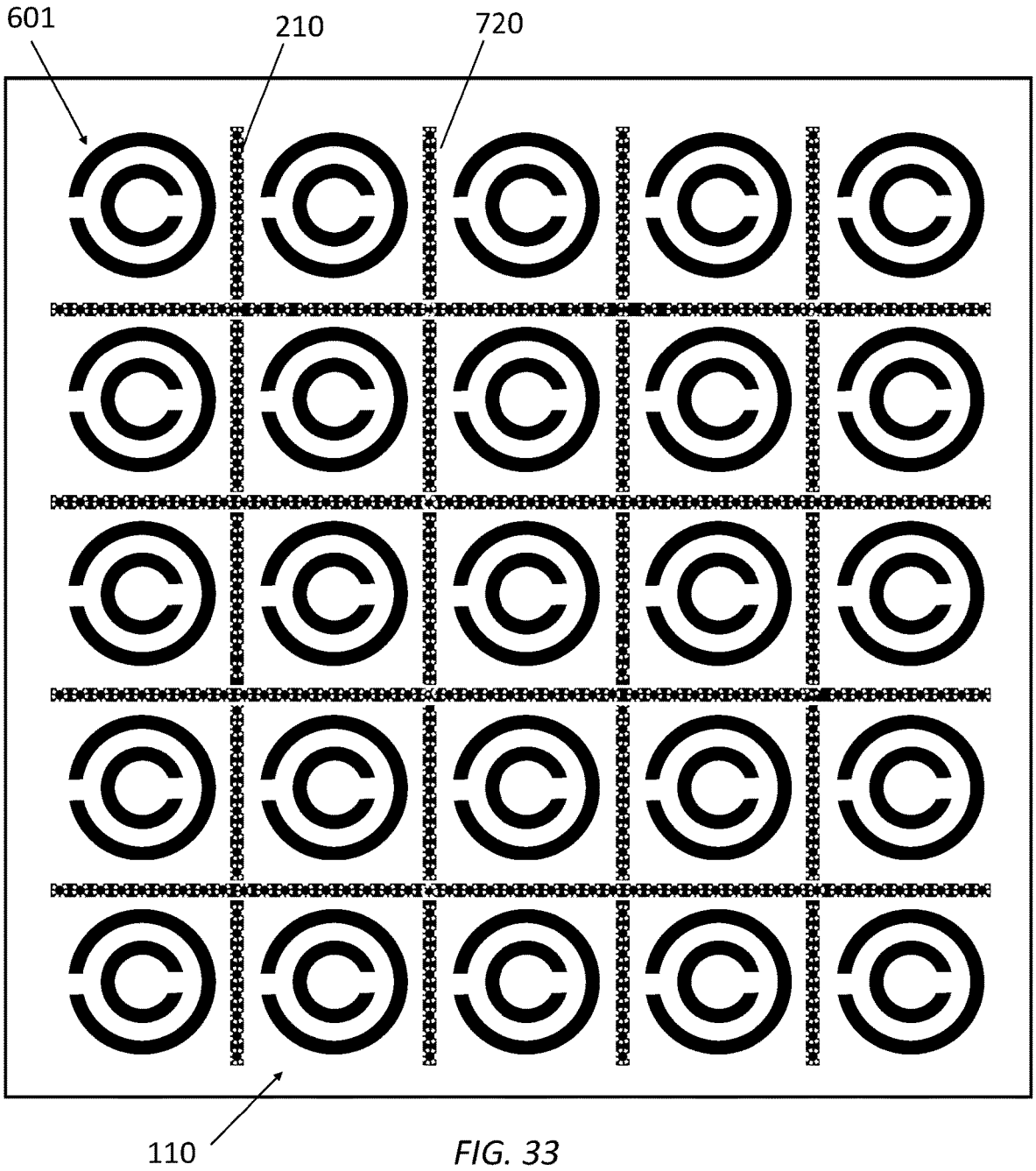
FIG. 33 is a top view of a 2-D array of nested split ring resonators forming a metamaterial surface with material-filled vias located between the nested split ring resonators.

According to some embodiments, a metamaterial surface may be formed by arranging nested SRRs into a 2-dimensional array across the surface of a substrate. Referring to FIG. 33, for example, such a surface may include plural nested split ring resonators 601 arrayed over dielectric substrate 110. Intersecting arrays of material-filled vias 210 may be disposed between the SSRs of the 2-D array. Top electrode contacts 720 may overlie the material-filled vias 210. For simplicity, the applied voltages and circuits are omitted.

Figure 34:
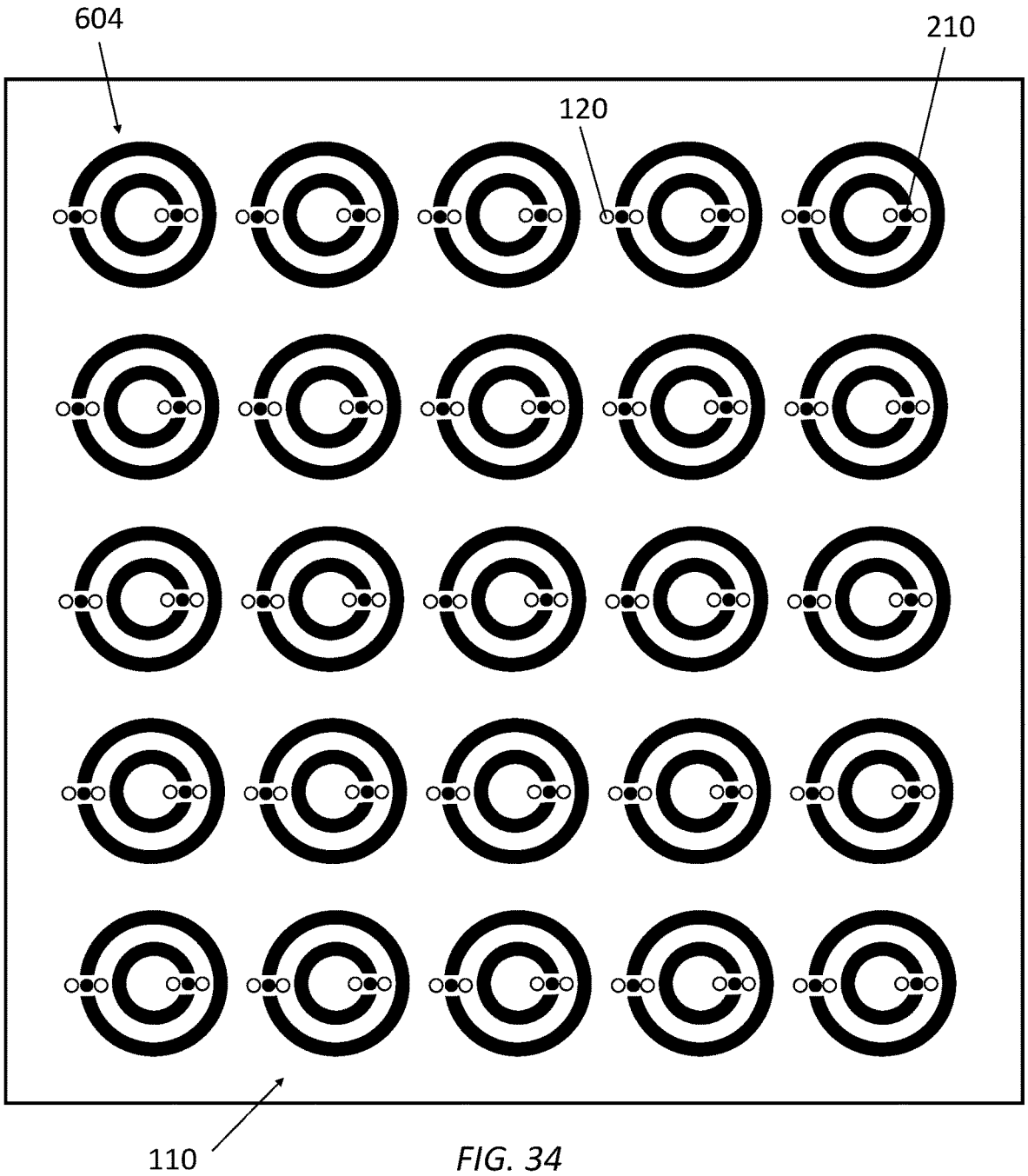
FIG. 34 is a top view of a metamaterial surface with a 2-D array of nested split ring resonators having material-filled vias located within each split ring resonator gap and metal-filled vias adjacent to the material-filled vias.

Referring to FIG. 34, a further metamaterial surface may include a 2-dimensional array of nested SSRs 604 disposed over dielectric substrate 110, where material-filled vias 210 are located within the gap of each ring and metal-filled vias 120 are located proximate to the material-filled vias 210. In the embodiments of FIG. 33 and FIG. 34, an applied voltage/field to the material-filled vias 210 may be used to control the EM coupling between each nested SRR 601, 604.

Figure 35A:
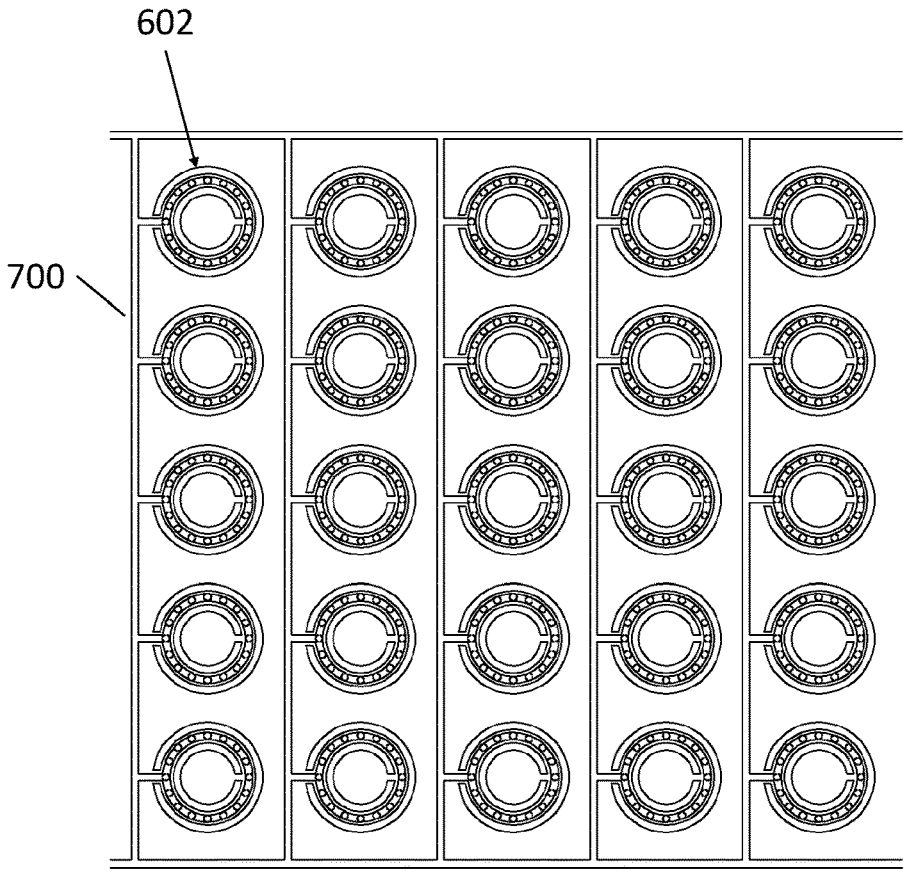
FIG. 35A is a top view of a 2-D array of nested split ring resonators forming a metamaterial surface with material-filled vias located within the substrate in between the two nested split rings of each resonator and a single electrode controlling the external voltage applied to the material-filled vias.
Figure 35B:
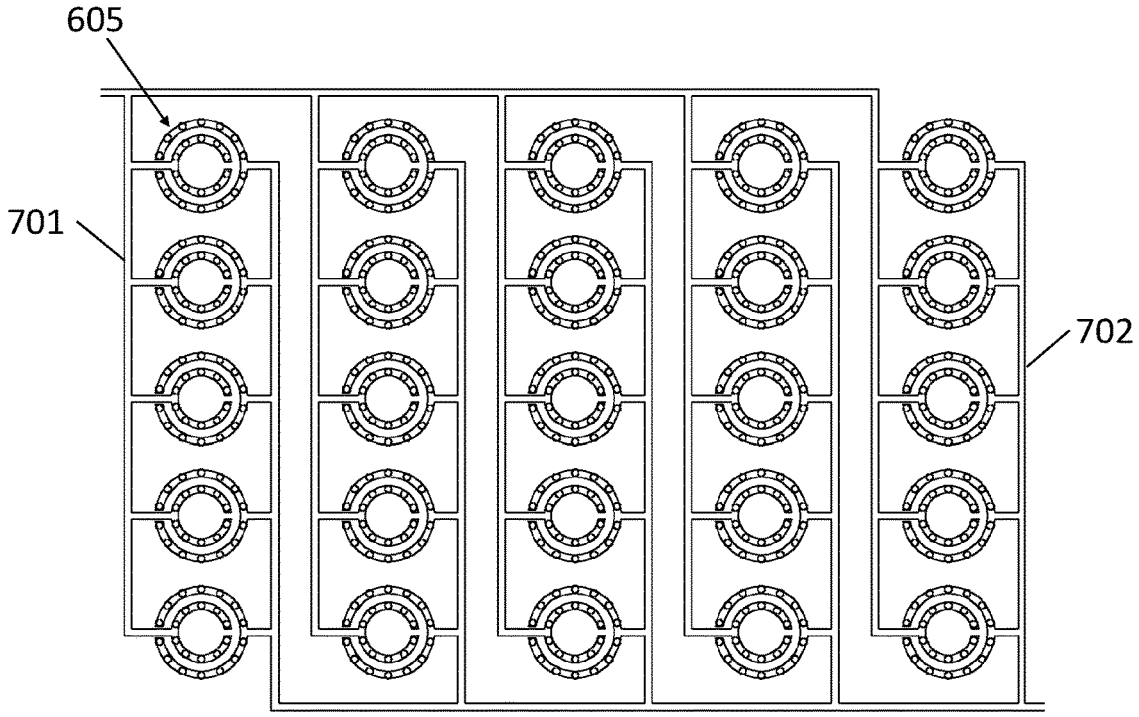
FIG. 35B is a top view of a 2-D array of nested split ring resonators forming a metamaterial surface with material-filled vias located within the substrate under each of the split ring resonators and two electrodes respectively controlling the external voltage applied to the material-filled vias of the outer and inner split ring resonators.

Co-integrated 2-D arrays of nested split ring resonators are shown in FIG. 35A and FIG. 35B. In FIG. 35A, the nested SSR array includes a single electrode 700 common to each resonator 602, which is configured to apply a voltage and an associated external electric field to all of the material-filled vias, i.e., material-filled vias 210 located within the space between each nested pair of rings, as shown in FIG. 31A.

FIG. 35B is an alternative 2-D array of nested split ring resonators 605 where material-filled vias are located below each of the split rings. In the embodiment of FIG. 35B, a first electrode 701 is configured to apply a voltage and an associated external electric field to the material-filled vias underlying the inner split ring, and a second electrode 702 is configured to apply a voltage and an associated external electric field to the material-filled vias underlying the outer split ring.

Figure 36A:
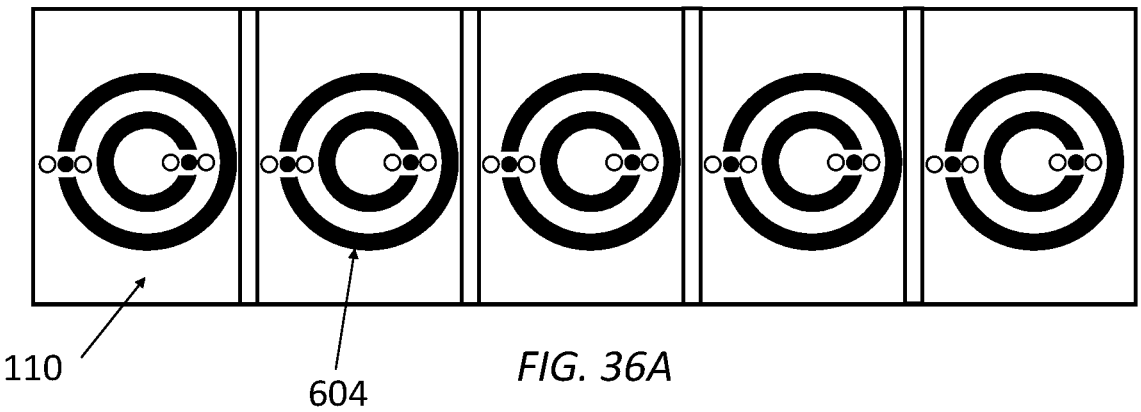
FIG. 36A is a side view of 2-D nested split ring array sheets that are interleaved to create a 3-D metamaterial.
Figure 36B:
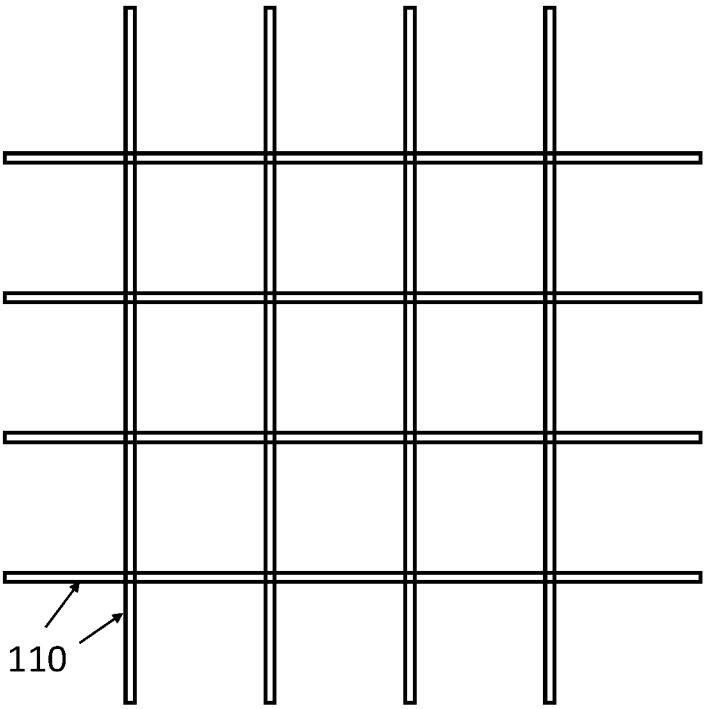
FIG. 36B is an end view of the metamaterial surface of FIG. 36A with a 3-D array of nested split ring resonators having material-filled vias in between each split ring resonator gap and metal-filled vias adjacent to the material-filled vias.
Figure 37A:
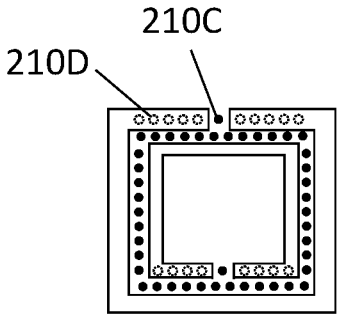
FIG. 37A is a top view of a two nested split ring resonators configured to electrically tune electric permittivity and magnetic permeability where material-filled vias are located within the space between the inner and outer split ring resonators, within the gap of the individual resonators, and under the resonators.
Figure 37B:
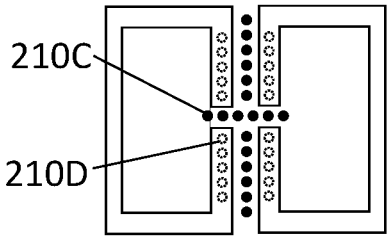
FIG. 37B is a top view of a two split ring resonators configured to electrically tune electric permittivity and magnetic permeability where material-filled vias are located within the space between the inner and outer split ring resonators, within the gap of the individual resonators, and under the resonators.
Figure 37C:
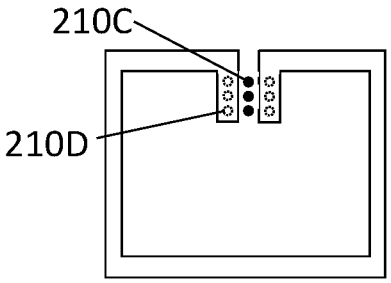
FIG. 37C is a top view of a single split ring resonator configured to electrically tune electric permittivity and magnetic permeability where material-filled vias are located within the gap of the resonator and under the resonator.
Figure 37D:
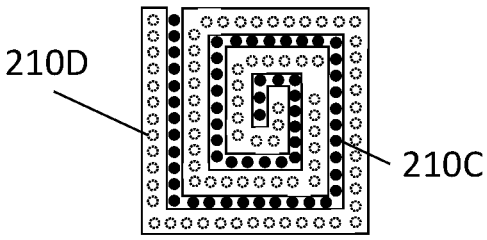
FIG. 37D is a top view of a single spiral resonator configured to electrically tune electric permittivity and magnetic permeability where material-filled vias are located within the gap of the resonator and under the resonator.
Figure 37E:
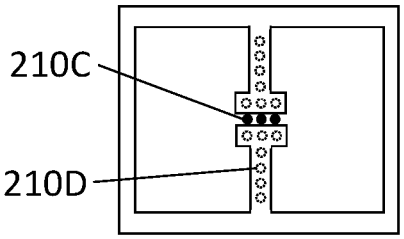
FIG. 37E is a top view of a single resonator configured to electrically tune electric permittivity and magnetic permeability where material-filled vias are located within the gap of the resonator and under the resonator.
Figure 37F:
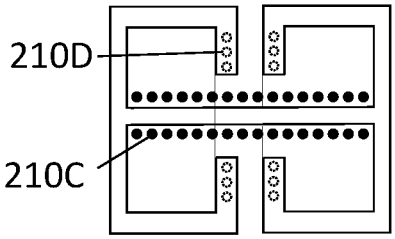
FIG. 37F is a top view of a single resonator configured to electrically tune electric permittivity and magnetic permeability where material-filled vias are located within the gap of the resonator and under the resonator.

Sheets of the 2-D metamaterials (e.g., as shown in FIG. 33, FIG. 34, FIG. 35A, and FIG. 35B) formed on a composite dielectric substrate 110 may be partitioned and assembled into an interlocking unit, i.e., analogous to cardboard box inserts, as shown in the side view of FIG. 36A and the corresponding end view of FIG. 36B. Although example nested SSRs are arranged as concentric circles, the SSRs may be configured alternately, e.g., as rectangles, squares, ovals, and other closed shapes, as well as spiral split rings, U-shapes, omega-shapes, S-shapes, and the like.

Further example resonator configurations are shown in FIGS. 37A-37F. The resonator of each illustrated embodiment is configured to generate resonance in the electric permittivity and/or magnetic permeability of an incoming electromagnetic field. The resonance may have values that range from greater than unity, to less than unity, including negative values in comparison to materials found in nature, where electric permittivity and magnetic permeability values are necessarily greater than one.

In the resonator structures of FIGS. 37A-37F, material-filled vias 210C, 210D may be located beneath the resonator structure, within a gap of an individual resonator, and/or within a space between the resonators. Example resonators may include smoothly varying shapes, as with the circular split-ring architectures shown in FIG. 31A, FIG. 32A, FIG. 32B, etc., or may include sharp cornered shapes. As with previous embodiments, the resonator structures of FIGS. 37A-37F may be configured as a 2-D array over a composite (material-filled via-containing) dielectric substrate, which may be interleaved to create a 3-D metamaterial.

As will be appreciated, various aspects of the present disclosure relate to a dynamically and spatially tunable dielectric substrate where, for example, the electric permittivity may be controlled within a given device or between devices of a circuit. In this regard, different voltages may be applied to different regions of the substrate within or between the devices. For example, there may be multiple rows of material-filled vias within a microstrip transmission line or a substrate-integrated waveguide and a desire to change the electric permittivity within a propagating region of the substrate along or transverse to the direction of a propagating EM field. In a further example, in connection with a phased array antenna, there may be a desire to change the delay in each line feeding the individual antennae to steer the resultant EM field radiated from the antenna array.

Figure 38:
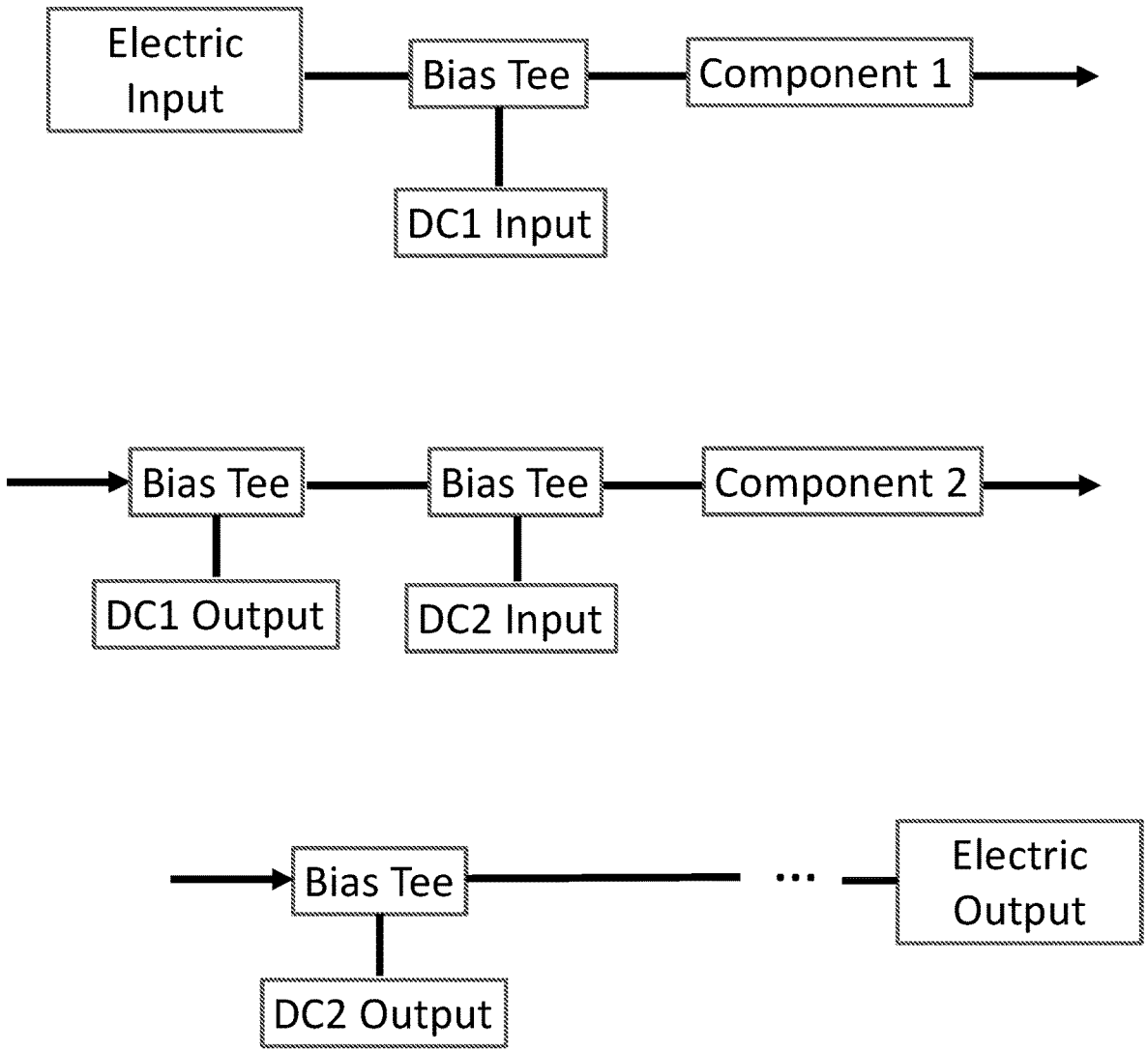
FIG. 38 is a block diagram of an electric circuit with a propagating electric field input and output and a cascade of DC inputs and outputs for individual applied voltages to the material-filled via regions.

FIG. 38 is a block diagram of an exemplary electric circuit having an electric input and an electric output and further including a cascade of individual DC inputs and DC outputs to achieve a desired operation. The electric input may be an RF, microwave, or millimeter wave propagating electromagnetic field. The applied voltage may be a DC voltage or a low frequency voltage and may be introduced and removed with a bias tee. For multiple applied voltages, the bias tees may be cascaded together.

In various aspects, the extent of overlap of an EM signal field with a material-filled via region may be increased or even maximized for a given device or system. This may be achieved by selecting the location of the material-filled vias, as well as their shape, size, spacing, etc. In particular embodiments, material-filled vias may be configured as a close-packed array where an individual material-filled via diameter may be substantially equal to the pitch of the array and each successive row of material-filled vias may be offset from neighboring rows by half the pitch.

According to some embodiments, the dielectric substrate may include a single, monolithic structure where additional layers (e.g., dielectric layers, conductive layers, etc.) may be formed over one or both major surfaces. According to further embodiments, the dielectric substrate may be assembled as a modular element, where portions of a multilayer substrate may be individually manufactured and later assembled. For instance, a core substrate including an embedded array of material-filled vias may be bonded to one or more cladding layers that include a desired device configuration, such as antennae, or split ring resonator structures.

Figure 39A:
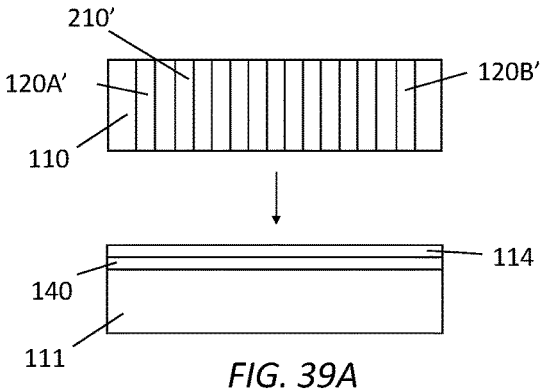
FIG. 39A is a side view prior to assembly of a via-containing substrate core to a lower substrate cladding.

Referring to FIG. 39A, a core substrate may include a dielectric substrate 110 having parallel arrays 120A', 120B' of unfilled vias and an intervening array 210' of unfilled vias.

The via openings may be formed using any suitable technique, including mechanical drilling, chemical etching, laser irradiation followed by chemical etching, laser ablation, plasma etching, electrical discharge machining, and the like. The vias may be characterized by an aspect ratio (length to diameter) of from approximately 3:1 to approximately 10:1 and a diameter of from approximately 20 micrometers to approximately 20 cm. Substrate 110 can be temporarily bonded to a handle substrate (not shown) to aid in the fabrication of the vias.

Referring still to FIG. 39A, a lower cladding layer may include a substrate 111. Substrate 111 may be a dielectric substrate and may include the same material or a different material as substrate 110. For example, substrate 110 may include glass and substrate 111 may include a PCB material such as FR4. A conductive electrode layer 140 may be formed over a top surface of substrate 111, and a polymer alignment layer 114 may be formed over the conductive electrode layer 140, e.g., as a templating layer for embodiments where material-filled vias include a liquid crystal composition.

Figure 39B:
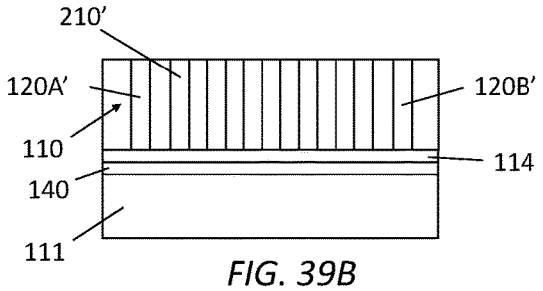
FIG. 39B is a side view after assembly of the substrate core of FIG. 39A.

Referring to FIG. 39B, substrates 110, 111 may be aligned and bonded, e.g., such that polymer alignment layer 114 is located proximate to via openings along a bottom surface of the substrate 110. A suitable adhesive for bonding the substrates 110, 111 may include a pressure sensitive adhesive, an epoxy adhesive, or a pre-impregnated composite.

Figure 40:
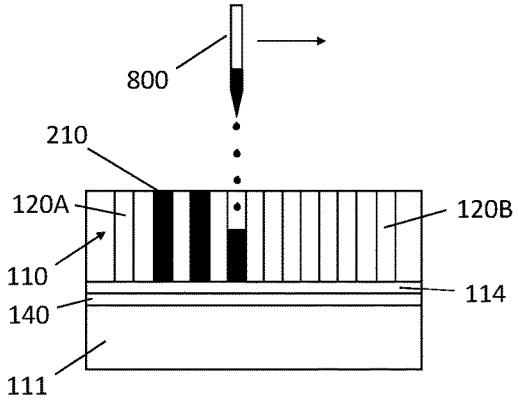
FIG. 40 is a side view of a process for filling the substrate core vias using micro dispensing of the tunable material.
Figure 41:
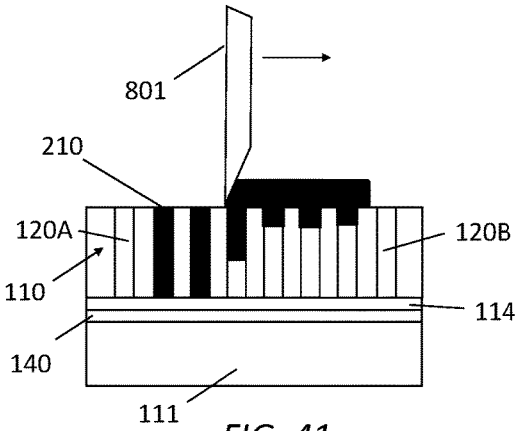
FIG. 41 is a side view of a process for filling the substrate core vias after bonding using a doctor blade to remove excess fill material.

With reference to FIG. 40, open vias 210' may be filled with a suitable fill material as disclosed herein. A microdispenser 800, for example, may be used to direct a fill material into individual vias 210' to form material-filled vias 210. In further embodiments, as illustrated in FIG. 41, a fill material may be deposited over the top surface of substrate 110 and a doctor blade or squeegee 801 moving across the top surface of the substrate 110 may be used to force the fill material into open vias 210' while removing excess fill material.

In some embodiments, the material-filled vias may include a bilayer of fill material. A bilayer may be used to form an electron donor-electron acceptor junction within the material-filled vias. During filling with an electron donor or electron acceptor material, a vacuum chuck positioned beneath the substrate 110 may be used to adjust the fill level of the first fill material prior to depositing the second fill material. A vacuum pressure and the duration of its application may be used to control the fill height.

Vias 120A', 120B' may be filled in a similar manner to form metal-filled vias 120A, 120B. A removable blocking layer (not shown) may be used to temporarily inhibit filling of vias 120A', 120B' during a process of filling of vias 210' (or vice versa).

Figure 42A:
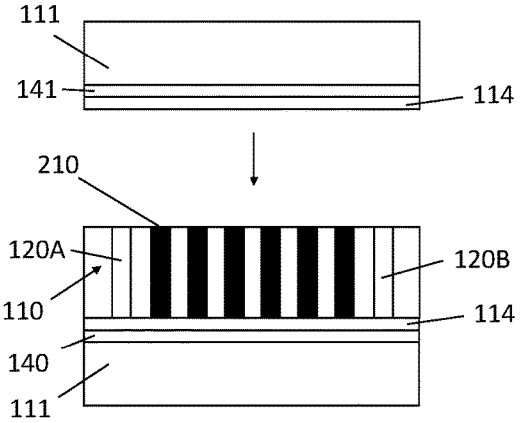
FIG. 42A is a side view prior to assembly of a substrate core with a lower substrate cladding to an upper substrate cladding.
Figure 42B:
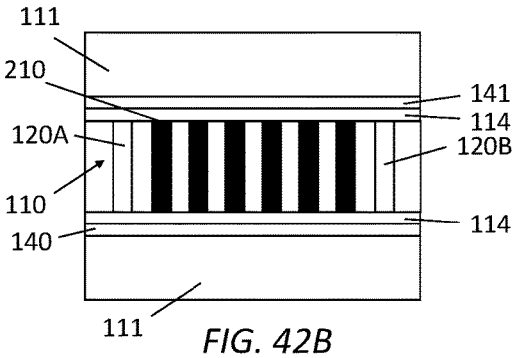
FIG. 42B is a side view after assembly of a substrate core with a lower substrate cladding to an upper substrate cladding.
Figure 43:
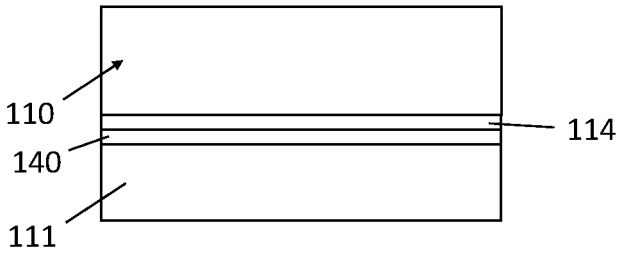
FIG. 43 is a side view after assembly of a substrate core with a lower substrate cladding prior to fabrication of vias.
Figure 44:
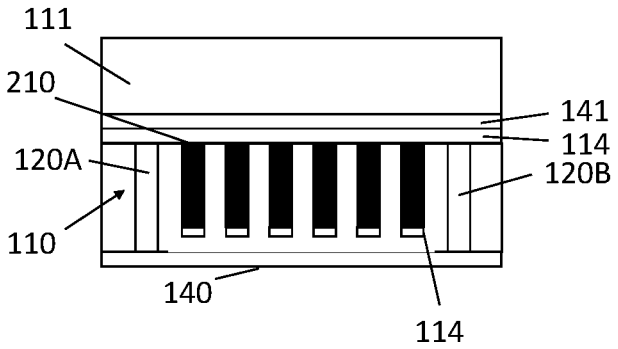
FIG. 44 is a side view after assembly of a substrate core with no lower substrate cladding to an upper substrate cladding.

As shown in FIG. 42A and FIG. 42B, after the vias are filled, an upper cladding layer may be added over a top surface of substrate 110. The upper cladding layer may include a substrate 111, an optional conductive electrode layer 141, and an optional alignment layer 114.

In an alternative manufacturing process, a core substrate may be bonded to a cladding layer prior to forming via openings in the core substrate. Such an approach is shown schematically in FIG. 43. Vias may then be formed in the combined core/lower substrate assembly and subsequently filled. In some embodiments, the core substrate 110 may include blind vias, which may facilitate filling of the vias with tunable fill material and/or deposition of a conductive electrode layer 140.

EXAMPLE EMBODIMENTS

Example 1: A system includes (i) a dielectric substrate having a propagating region for transmitting or reflecting an electromagnetic field, and (ii) material-filled vias disposed within the propagating region, where an effective electric permittivity or an effective magnetic permeability of the dielectric substrate within the propagating region is changed in response to an external electric or magnetic field applied to the material-filled vias.

Example 2: The system of Example 1, where a diameter of the material-filled vias is less than half of a wavelength of the electromagnetic field.

Example 3: The system of any of Examples 1 and 2, where the material-filled vias extend entirely through the dielectric substrate.

Example 4: The system of any of Examples 1-3, where the material-filled vias extend partially through the dielectric substrate.

Example 5: The system of any of Examples 1-4, where a distribution of the material-filled vias varies along a direction parallel to a propagation direction of the electromagnetic field through the propagating region.

Example 6: The system of any of Examples 1-5, where a distribution of the material-filled vias varies along a direction transverse to a propagation direction of the electromagnetic field through the propagating region.

Example 7: The system of any of Examples 1-6, where the material-filled vias include a fill material selected from liquid crystals, a ferroelectric crystal composite, a ferromagnetic crystal composite, organic semiconductors, electro-optic and magneto-optic polymers.

Example 8: The system of any of Examples 1-7, further including an upper conductive layer disposed over an upper surface of the dielectric substrate and a lower conductive layer disposed over a lower surface of the dielectric substrate.

Example 9: The system of Example 8, where the upper conductive layer includes a first segment disposed over a first plurality of the material-filled vias and a second segment electrically isolated from the first segment disposed over a second plurality of the material-filled vias.

Example 10: The system of any of Examples 1-9, where the dielectric substrate includes a central layer disposed between an upper cladding layer and a lower cladding layer, and the material-filled vias are disposed within the central layer.

Example 11: The system of any of Examples 1-10, further including a plurality of metal-filled vias extending through the dielectric substrate and along opposing lateral edges of the propagating region.

Example 12: The system of Example 11, further including an upper conductive layer disposed over an upper surface of the dielectric substrate, where the upper conductive layer includes: (i) a first segment for applying the external electric or magnetic field to the material-filled vias, and (ii) a second segment overlying the metal-filled vias and electrically isolated from the first segment.

Example 13: The system of any of Examples 1-12, further including a conductive resonator structure disposed over a surface of the dielectric substrate, where at least one of the material-filled vias is located at a position selected from: (i) within a gap in the conductive resonator structure, (ii) underlying the conductive resonator structure, and (iii) adjacent to the conductive resonator structure.

Example 14: The system of any of Examples 1-13, where the electromagnetic field includes a radio frequency field, a microwave field, or a millimeter wave field.

Example 15: A structure includes a dielectric substrate, an upper conductive layer disposed over an upper surface of the dielectric substrate and a lower conductive layer disposed over a lower surface of the dielectric substrate, and material-filled vias located within the dielectric substrate between the upper conductive layer and the lower conductive layer.

Example 16: The structure of Example 15, further including parallel arrays of metal-filled vias extending through the dielectric substrate and between the upper conductive layer and the lower conductive layer, where the material-filled vias are located between the parallel arrays of the metal-filled vias.

Example 17: A method includes (a) applying an electromagnetic signal or an electromagnetic power field to a system that includes (i) a dielectric substrate having a propagating region for transmitting or reflecting the electromagnetic signal or the electromagnetic power field, and (ii) material-filled vias disposed within the propagating region, and (b) applying an external electric field or an external magnetic field to the material-filled vias to change an effective electric permittivity or an effective magnetic permeability of the dielectric substrate within the propagating region.

Example 18: The method of Example 17, where changing the effective electric permittivity or the effective magnetic permeability of the dielectric substrate within the propagating region includes changing an electric permittivity or a magnetic permeability of a fill material within the material-filled vias.

Example 19: The method of any of Examples 17 and 18, where the applied external electric field is in phase with the electromagnetic signal or the electromagnetic power field and propagates along a direction substantially parallel to a propagation direction of the electromagnetic signal or the electromagnetic power field.

Example 20: The method of any of Examples 17-19, where the system includes a plurality of metal-filled vias extending through the dielectric substrate and along opposing lateral edges of the propagating region, and alternately applying: (i) the external electric field or the external magnetic field to the material-filled vias, and (ii) a drive voltage to the plurality of metal-filled vias.

As used herein, the term "substantially" in reference to a given parameter, property, or condition may mean and include to a degree that one of ordinary skill in the art would understand that the given parameter, property, or condition is met with a small degree of variance, such as within acceptable manufacturing tolerances. By way of example, depending on the particular parameter, property, or condition that is substantially met, the parameter, property, or condition may be at least approximately 90% met, at least approximately 95% met, or even at least approximately 99% met.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure. Those skilled in the art will appreciate that other modifications and variations can be made without departing from the spirit or scope of the invention.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

Terms such as "above," "below," "upper," "lower," "top," "bottom," and further terminology such as "horizontal" and "vertical" may be used herein to describe a relationship of one element, layer, or region to another element, layer, or region as illustrated in the drawings. It will be understood that these terms are relative and are intended to encompass different orientations in addition to the orientation(s) depicted in the drawings.

It will be understood that when an element such as a layer or a region is referred to as being formed on, deposited on, or disposed "on" or "over" another element, it may be located directly on at least a portion of the other element, or one or more intervening elements may also be present. In contrast, when an element is referred to as being "directly on" or "directly over" another element, it may be located on at least a portion of the other element, with no intervening elements present.

While various features, elements or steps of particular embodiments may be disclosed using the transitional phrase "comprising," it is to be understood that alternative embodiments, including those that may be described using the transitional phrases "consisting" or "consisting essentially of," are implied. Thus, for example, implied alternative embodiments to a fill material that comprises or includes a liquid crystal composition include embodiments where a fill material consists essentially of a liquid crystal composition and embodiments where a fill material consists of a liquid crystal composition.

What is claimed is:

1. A system comprising:

a dielectric substrate having a propagating region for transmitting or reflecting an electromagnetic field; and material-filled vias disposed within the propagating region, wherein a diameter of the material-filled vias is less than half of a wavelength of the electromagnetic field and an effective electric permittivity or an effective magnetic permeability of the dielectric substrate within the propagating region is changed in response to an external electric or magnetic field applied to the material-filled vias.

2. The system of claim 1, wherein the material-filled vias extend entirely through the dielectric substrate.

3. The system of claim 1, wherein the material-filled vias extend partially through the dielectric substrate.

4. The system of claim 1, wherein a distribution of the material-filled vias varies along a direction parallel to a propagation direction of the electromagnetic field through the propagating region.

5. The system of claim 1, wherein a distribution of the material-filled vias varies along a direction transverse to a propagation direction of the electromagnetic field through the propagating region.

6. The system of claim 1, wherein the material-filled vias comprise a fill material selected from the group consisting of liquid crystals, a ferroelectric crystal composite, a ferromagnetic crystal composite, organic semiconductors, electro-optic and magneto-optic polymers.

7. The system of claim 1, further comprising an upper conductive layer disposed over an upper surface of the dielectric substrate and a lower conductive layer disposed over a lower surface of the dielectric substrate.

8. The system of claim 7, wherein the upper conductive layer comprises a first segment disposed over a first plurality of the material-filled vias and a second segment electrically isolated from the first segment disposed over a second plurality of the material-filled vias.

9. The system of claim 1, wherein the dielectric substrate comprises a central layer disposed between an upper cladding layer and a lower cladding layer, and the material-filled vias are disposed within the central layer.

10. The system of claim 1, further comprising a plurality of metal-filled vias extending through the dielectric substrate and along opposing lateral edges of the propagating region.

11. The system of claim 10, further comprising an upper conductive layer disposed over an upper surface of the dielectric substrate, wherein the upper conductive layer comprises: (i) a first segment for applying the external electric or magnetic field to the material-filled vias, and (ii) a second segment overlying the metal-filled vias and electrically isolated from the first segment.

12. The system of claim 1, further comprising a conductive resonator structure disposed over a surface of the dielectric substrate, wherein at least one of the material-filled vias is located at a position selected from the group consisting of: (i) within a gap in the conductive resonator structure, (ii) underlying the conductive resonator structure, and (iii) adjacent to the conductive resonator structure.

13. The system of claim 1, wherein the electromagnetic field comprises a radio frequency field, a microwave field, or a millimeter wave field.

14. The system of claim 1, wherein the material-filled vias are configured as a bilayer, the respective layers comprising an electron donor and an electron acceptor.

15. The system of claim 1, further comprising a bias tee configured to apply the external electric or magnetic field to the material-filled vias.

16. The system of claim 1, wherein the material-filled vias are configured as a close-packed array having a pitch that is substantially equal to a diameter of the material-filled vias and each successive row of material-filled vias is offset from neighboring rows by half the pitch.

17. A method comprising:

applying an electromagnetic signal or an electromagnetic power field to a system comprising:

a dielectric substrate having a propagating region for transmitting or reflecting the electromagnetic signal or the electromagnetic power field, and material-filled vias disposed within the propagating region, wherein a diameter of the material-filled vias is less than half of a wavelength of the electromagnetic signal or the electromagnetic power field; and applying an external electric field or an external magnetic field to the material-filled vias to change an effective electric permittivity or an effective magnetic permeability of the dielectric substrate within the propagating region.

18. The method of claim 17, wherein changing the effective electric permittivity or the effective magnetic permeability of the dielectric substrate within the propagating region comprises changing an electric permittivity or a magnetic permeability of a fill material within the material-filled vias.

19. The method of claim 18, wherein the applied external electric field is in phase with the electromagnetic signal or the electromagnetic power field and propagates along a direction substantially parallel to a propagation direction of the electromagnetic signal or the electromagnetic power field.

20. The method of claim 17, wherein the system comprises a plurality of metal-filled vias extending through the dielectric substrate and along opposing lateral edges of the propagating region, and alternately applying: (i) the external electric field or the external magnetic field to the material-filled vias, and (ii) a drive voltage to the plurality of metal-filled vias.

* * * * *